US007521164B2

(12) United States Patent
Nakayama et al.

(10) Patent No.: US 7,521,164 B2
(45) Date of Patent: Apr. 21, 2009

(54) TONER, AND, DEVELOPER, TONER CONTAINER, PROCESS CARTRIDGE, IMAGE FORMING APPARATUS AND IMAGE FORMING METHOD

(75) Inventors: Shinya Nakayama, Numazu (JP); Satoshi Mochizuki, Numazu (JP); Yasuaki Iwamoto, Numazu (JP); Yasuo Asahina, Numazu (JP); Akihiro Kotsugai, Numazu (JP); Masayuki Ishii, Numazu (JP); Osamu Uchinokura, Numazu (JP); Hisashi Nakajima, Numazu (JP); Tomoyuki Ichikawa, Numazu (JP); Tomoko Utsumi, Ebina (JP); Koichi Sakata, Numazu (JP); Hideki Sugiura, Fuji (JP); Shigeru Emoto, Numazu (JP); Junichi Awamura, Sunto-gun (JP); Masami Tomita, Numazu (JP); Takahiro Honda, Numazu (JP); Shinichiro Yagi, Numazu (JP); Tomomi Suzuki, Numazu (JP); Hiroshi Yamada, Numazu (JP); Toshiki Nanya, Mishima (JP); Hiroto Higuchi, Numazu (JP); Fumihiro Sasaki, Fuji (JP); Naohito Shimota, Sunto-gun (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/059,199

(22) Filed: Mar. 31, 2008

(65) Prior Publication Data

US 2008/0268366 A1 Oct. 30, 2008

Related U.S. Application Data

(60) Division of application No. 11/378,653, filed on Mar. 20, 2006, now Pat. No. 7,374,851, which is a continuation of application No. PCT/JP2004/013559, filed on Sep. 16, 2004.

(30) Foreign Application Priority Data

Sep. 18, 2003 (JP) ..... 2003-325532
Jan. 9, 2004 (JP) ..... 2004-004424

(51) Int. Cl.
*G03G 9/00* (2006.01)

(52) U.S. Cl. ..... 430/111.4; 430/109.4

(58) Field of Classification Search ..... 430/111.4, 430/109.4

See application file for complete search history.

(56) References Cited

U.S. PATENT DOCUMENTS 6,221,549 B1 4/2001 Emoto et al.

(Continued)

FOREIGN PATENT DOCUMENTS

EP 0130790 1/1985

(Continued)

OTHER PUBLICATIONS

U.S. Appl. No. 12/203,278, filed Sep. 3, 2008, Yamada, et al.

*Primary Examiner*—Mark A Chapman
(74) *Attorney, Agent, or Firm*—Oblon, Spivak, McClelland, Maier & Neustadt, P.C.

(57) ABSTRACT

A toner which includes a toner material, wherein the toner satisfies the following formula:

$$0° C. \leqq \Delta Tm \leqq 20° C.$$

where ΔTm represents Tma (° C.)−Tmb (° C.), Tma (° C.) is ½ flown-out temperature of the toner by a capillary type flow tester, and Tmb (° C.) is ½ flown-out temperature of a melt kneaded mixture of the toner by the capillary type flow tester, and wherein Tma is from 130° C. to 200° C.

7 Claims, 14 Drawing Sheets

U.S. PATENT DOCUMENTS

| | | | |
|---|---|---|---|
| 6,416,917 | B1 | 7/2002 | Nakanishi et al. |
| 6,660,443 | B2 | 12/2003 | Sugiyama et al. |
| 6,821,697 | B2 | 11/2004 | Takayanagi et al. |
| 2002/0042011 | A1 | 4/2002 | Anno et al. |
| 2003/0022084 | A1 | 1/2003 | Sugiyama et al. |
| 2003/0125479 | A1 | 7/2003 | Kinsho et al. |
| 2003/0134220 | A1 | 7/2003 | Emoto et al. |
| 2003/0138717 | A1 | 7/2003 | Yagi et al. |
| 2003/0180644 | A1 | 9/2003 | Nanya et al. |

FOREIGN PATENT DOCUMENTS

| | | |
|---|---|---|
| EP | 1243976 | 9/2002 |
| EP | 1296194 | 3/2003 |
| JP | 05-053372 | 3/1993 |
| JP | 05-107803 | 4/1993 |
| JP | 05-289399 | 11/1993 |
| JP | 05-297630 | 11/1993 |
| JP | 05-313413 | 11/1993 |
| JP | 05-341617 | 12/1993 |
| JP | 06-027733 | 2/1994 |
| JP | 06-075426 | 3/1994 |
| JP | 06-118702 | 4/1994 |
| JP | 06-266143 | 9/1994 |
| JP | 06-342224 | 12/1994 |
| JP | 08-146661 | 6/1996 |
| JP | 2537503 | 7/1996 |
| JP | 09-204071 | 8/1997 |
| JP | 09-258474 | 10/1997 |
| JP | 09-325550 | 12/1997 |
| JP | 11-133665 | 5/1999 |
| JP | 11-149180 | 6/1999 |
| JP | 2000-292973 | 10/2000 |
| JP | 2000-292978 | 10/2000 |
| JP | 2000-292981 | 10/2000 |
| JP | 3141783 | 12/2000 |
| JP | 2001-042684 | 2/2001 |
| JP | 2001-166538 | 6/2001 |
| JP | 2001-175025 | 6/2001 |
| JP | 2001-330992 | 11/2001 |
| JP | 2002-055486 | 2/2002 |
| JP | 2002-123119 | 4/2002 |
| JP | 2002-284881 | 10/2002 |
| JP | 2003-084495 | 3/2003 |
| JP | 2003-091100 | 3/2003 |
| JP | 2003-140378 | 5/2003 |
| JP | 2003-140381 | 5/2003 |
| JP | 2003-140394 | 5/2003 |
| JP | 2003-140395 | 5/2003 |
| JP | 2003-156877 | 5/2003 |
| JP | 2003-156878 | 5/2003 |
| JP | 2003-167382 | 6/2003 |
| JP | 2003-202701 | 7/2003 |
| JP | 2003-280269 | 10/2003 |
| JP | 2003-295494 | 10/2003 |
| JP | 2003-295495 | 10/2003 |

FIG. 14
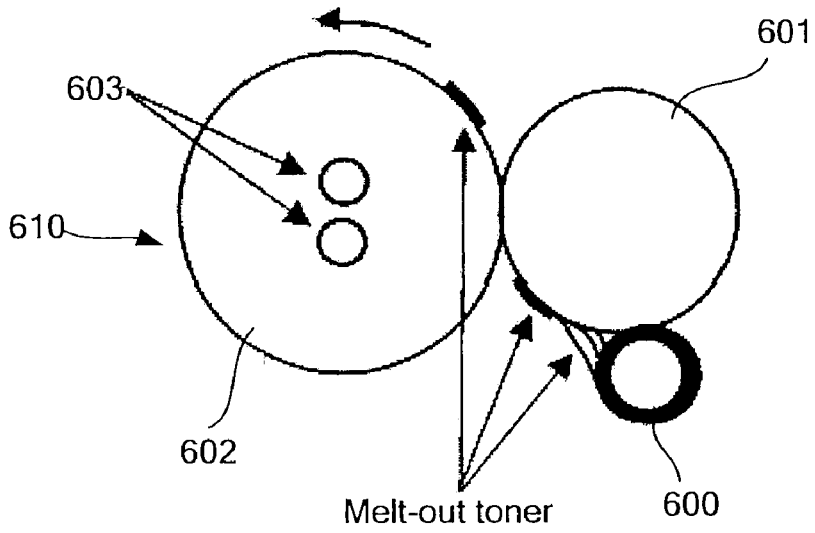
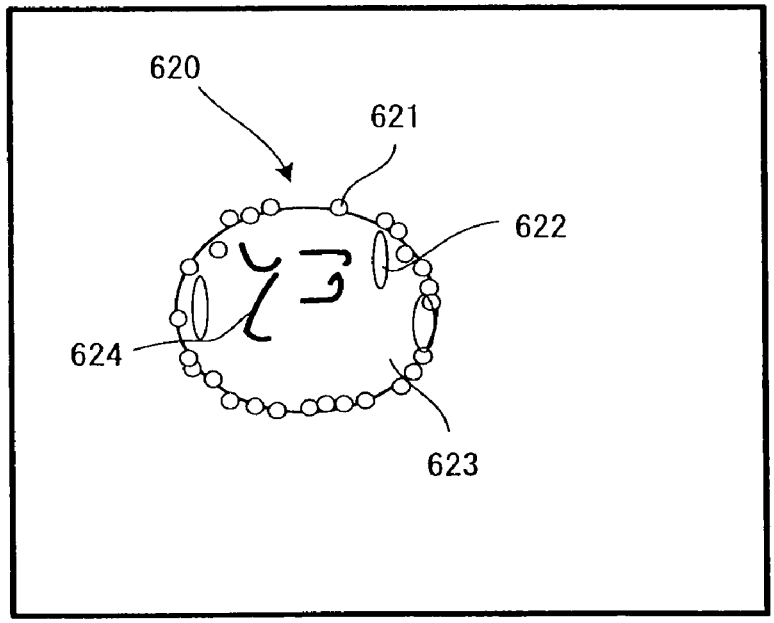
FIG. 15

TONER, AND, DEVELOPER, TONER CONTAINER, PROCESS CARTRIDGE, IMAGE FORMING APPARATUS AND IMAGE FORMING METHOD

CROSS-REFERENCE TO RELATED APPLICATIONS

This is a continuation of Application PCT/JP2004/013559, filed on Sep. 16, 2004

BACKGROUND OF THE INVENTION

1. Field of the Invention

The present invention relates to toners for developing electrostatic images of electrophotography, electrostatic recording, electrostatic printing, and the like; and to developers, toner containers, process cartridges, image forming apparatuses, and image forming methods using the toners.

2. Description of the Related Art

Image formation by e.g. electrophotographic method is generally carried out by a series of processes including: forming a latent electrostatic image on a photoconductor (latent electrostatic image bearing member); developing the latent electrostatic image by a developer containing a toner to form a visible image (toner image); then transferring the visible image to a recording medium such as paper; and fixing the image to form an fixed image.

The toner is a colored particle comprising a binder (binder resin), colorant, charge controlling agent, etc. which are contained in the binder. As the method for producing the toner, pulverization and suspension polymerization are mainly known.

The pulverization is a method for producing a toner in which a colorant, charge controlling agent, etc. are melt-mixed and are uniformly dispersed into a binder to obtain a toner composition, and the obtained toner composition is grinded, classified, etc. to form a toner. The pulverization has drawbacks as follows. Specifically, a grinder, etc., are required to grind a toner composition, resulting in high cost, and thus the method is not effective. In addition, during the grinding, toner particles with wide distribution of particle diameter tend to be formed. Therefore, in order to obtain images with high resolution and high gradation, a portion of the toner particles, for example, minute particles of 5 μm or less in diameter and large grains of 20 μm or more, must be removed by classification, inviting a significant reduction of yield. Furthermore, it is difficult to disperse additives such as a colorant, and charge controlling agent into the binder uniformly. The use of the toner in which the additives are not dispersed uniformly deteriorates flowability, developability, durability, image quality, etc.

Recently, to overcome these problems in pulverization, a method for producing a toner by polymerization of monomer is proposed and carried out. For example, toner particles are produced by suspension polymerization. However, toner particles obtained by suspension polymerization are generally spherical and have drawback of poor cleaning ability poor cleaning ability causes non-transferred residual toner on a photoconductor, and the accumulation of such residual toner leads to background smear. Moreover, residual toner contaminates components such as a charging roller, which charges a photoconductor by contact charging, and subsequently reduces the charging performance of the charging roller.

Therefore, a method for producing toner particles is proposed in which emulsion polymerization is used to form resin fine particles, which are subsequently associated to obtain toner particles having irregular shapes (See Japanese Patent (JP-B) No. 2537503). However, toner particles formed by emulsion polymerization have residual surfactants in large amounts inside the particles as well as on the surface thereof even after being washed by water. As a result, charge stability of toner is reduced, the distribution of the amount of charge is increased, causing background smear on a printed image. In addition, the residual surfactant contaminates photoconductor, charging roller, developing roller, etc. Therefore, toner cannot fulfill its original function.

On the other hand, for the fixing process by contact heating, in which heating members such as a heating roller are used, the toner particles must possess releasability, which may be referred to as "offset resistance" hereinafter, from the heating members. In such case, offset resistance can be improved by allowing a releasing agent to exist on the surface of toner particles. In contrast, methods to improve offset resistance are disclosed in which resin fine particles are not only contained in toner particles, but are concentrated at the surface of the toner particles (See Japanese Patent Application Laid-Open (JP-A) No. 2000-292973 and JP-A No. 2000-292978).

These proposals, however, cause increase of lowest fixing temperature, resulting in unsatisfactory fixing ability at low temperatures, i.e. energy-saving fixing ability. In addition, this method, in which resin fine particles obtained by emulsion polymerization are associated to provide irregular-shaped toner particles, has another problem. Generally, releasing agent particles are additionally associated to improve the offset resistance. However, the releasing agent particles are captured inside the toner particles and therefore the improvement of the offset resistance is not sufficient. Moreover, since each toner particle is formed by a random adhesion of molten resin fine particles, releasing agent particles, colorant particles, and the like, the composition (the ratio at which each component is contained), molecular mass of the resin, and the like may be different and dispersed for each obtained toner particle. In result, the surface properties of toner particles are different from one another, and it is impossible to form stable images for a long period. Additionally, in a low-temperature fixing system, the resin fine particles that are concentrated at the surface of the toner particles inhibit fixing and therefore the range of fixing temperature is not sufficient.

Recently, a new method for producing a toner, called solution suspension method (Emulsion-aggregation method (EA method), has been suggested (See JP-B No. 3141783). In this method, particles are formed from polymers that are dissolved in an organic solvent or the like whereas in suspension polymerization, polymer particles are formed from monomers, and the method is advantageous in that, for example, there is a larger selection of resins that can be used and polarity can be controlled. Furthermore, the method is advantageous in that it is possible to control the structure of toner particles (core/shell structure control). However, the shell structure is a layer consisting only of a resin and the purpose thereof is to lower the exposure of pigment and wax to the surface. The purpose is not to alter the structure in the resin, and the structure is not capable for such purpose (See "The characteristics of newly developed toner and the vision for the future" by Takao Ishiyama, and two others from The $4^{th}$ Joint Symposium of The Imaging Society of Japan and The Institute of Electrostatics Japan on Jul. 29, 2000). Therefore, although the toner particle has a shell structure, the surface of the toner particle is a usual resin without any ingenious feature so that when the toner particle is targeted at fixing at a lower temperature, there is a problem that it is not satisfactory from the standpoint of anti-heat preservability and environmental charge stability.

In any of the conventional methods such as the suspension polymerization, emulsion polymerization, and solution suspension, styrene-acrylic acid ester copolymer is used as a binder resin in many cases. Polyester resins are not generally used because they are difficult to be made into particles, it is uneasy to control particle diameter, diameter distribution, particle shape, etc., and their fixing ability is insufficient under the condition of fixing at a lower temperature.

In pulverization, in order to achieve fixing at low temperatures, a polyester resin having a high acid value is used. For example, JP-B No. 3141783 and JP-A No. 09-204071 propose toners comprising a resin of which acid value, hydroxyl value, molecular mass distribution, THF insoluble content, or the like, are defined. The toner in these proposals, however, causes the reduction of melting temperature at the same time, resulting in the deterioration of offset resistance. In order to achieve all of fixing property at low temperatures, offset resistance and anti-heat preservability, further improvement is needed.

Much work has been done from various angles of approach in the field of electrophotography to improve quality, and it is being recognized that it is extremely effective to reduce the size and increase the sphericity of the toner particle. However, as the diameter of toner particles becomes smaller, the transferability and fixing ability tend to decrease, and image quality becomes poor. Especially, with respect to fixing, fixing ability at a halftone portion becomes worse. This is because at the halftone portion, the adhesive amount of toner is low, the toner, transferred to the concave portion on a transfer material, is given extremely small amount of heat from a fixing roller, causing generation of offset phenomenon easily. In addition, it is known that by making toner particles round, the transferability rises (See JP-A No. 09-258474).

In such situation, ever-faster image production is desired in the field of color copiers and printers. For a faster printing, the "tandem method" is effective (See JP-A No. 05-341617). The "tandem method" is a method in which images formed by respective image forming units are overlaid and sequentially transferred onto a sheet of paper that is advanced by a transfer belt so that a full-color image is obtained on the sheet. In a color image forming apparatus using tandem method, various kinds of paper can be used, the quality of full-color images is high, and full-color images can be formed at high speed. The high-speed output of full-color images is especially characteristic and no other color image reproduction machines have that characteristic. There are other attempts to increase speed while improving the quality by using round toner particles. In order to increase speed more, the round toner is required to be fixed quickly; however, in a present situation, such round toner that has both quick fixing ability and fixing ability at low temperature has not been achieved.

Toner may be subjected to severe circumstances such as high temperature and humidity, and low temperature and humidity during storage and transport after the production. There has been a demand for a toner which does not aggregate to each other, of which flowability, transferability, and fixing ability do not deteriorate or rarely do, and which has excellent preservability, even after storage for a long period under such circumstances. However, in the present situation, effective means for such demand has not been found especially with respect to spherical toner.

In electrophotographic system, a heat-pressure fixing method by means of a heating roller is conventionally used. In the method, while the surface of a heat roller possessing releasability for a toner is brought contact with the toner image on the surface of a receiving sheet under pressure, the receiving sheet is allowed to pass through to thereby fix the toner image. In this method, the surface of the heat roller and toner image on the receiving sheet are brought into contact with each other under pressure. Thus, heat efficiency during the melt-fixing of toner image on the receiving sheet is extremely satisfactory, which enables quick fixation.

By the way, in the heat-pressure fixing method by means of a heating roller, the surface of the heating roller and toner image are brought into contact with each other in a melted state and under pressure. A portion of toner image is transferred to the surface of fixing roller to adhere, and the transferred portion of toner image is re-transferred to the next receiving sheet, leading to the pollution of the receiving sheet. This so-called offset phenomenon is greatly influenced by the fixing speed and fixing temperature. This is because almost constant amount of heat for fixing toner is given to toner without depending on the fixing speed.

In general, when the fixing speed is slow, the surface temperature of heating roller is set to relatively low temperature. In contrast, when the fixing speed is fast, the surface temperature of heating roller is set to relatively high temperature.

The toner on the receiving sheet forms several toner layers. Thus, particularly, in a system where fixing speed is fast, the surface temperature of heating roller is high, an uppermost layer of toner layers which contacts with a heating roller and a lowermost of toner layers which contacts with the receiving sheet temperature difference becomes large. Therefore, when the surface temperature of heating roller is high, the toner of the uppermost layer tends to cause offset phenomenon, and when the surface temperature of heating roller is low, toner does not fix to the receiving sheet because the toner of the lowermost layer does not melt sufficiently, causing low-temperature offset phenomenon easily.

As a way to solve this problem, when the fixing speed is fast, a method is normally carried out in which pressure during fixing is increased, making the toner to be anchored to the receiving sheet. This method can reduce heating roller temperature to some degree, and can prevent high-temperature offset phenomenon of the uppermost layer of toner layers. However, shearing force on the toner becomes very large, receiving sheet winds around the fixing roller, i.e., so-called winding offset occurs, and a trace of separating pawls for separating the receiving sheet from the fixing roller is likely to appear on a fixed image. Further, inferior fixed images are likely to occur, such as such as failure of line images during fixing and toner scattering, due to a high pressure.

Moreover, in a high-speed fixing system, a toner having a lower melt viscosity is generally used than in the case of low speed fixation, and the surface temperature of the heating roller and fixing pressure are lowered. Thus, a toner image is fixed while obviating the high-temperature offset and winding offset. However, the use of such a toner having a low melt viscosity in low speed fixation is likely to cause an offset phenomenon at high temperature.

Accordingly, in fixing, there has been demand for a toner which shows a wide fixable temperature range and excellent offset resistance and is applicable from a low-speed apparatus to a high-speed apparatus.

In order to obtain high quality image, an attempt to make the size of toner particles smaller has been made. Smaller particle size toner increases the resolution and clearness of an image, but impairs the fixability of a halftone image. This phenomenon is particularly noticeable in high-speed fixation. This is because the adhesive amount of toner in a halftone part is small and the toner transferred to a concave portion of a receiving sheet receives only a small quantity of heat from a heating roller and the pressure applied thereto is also suppressed because of the convex portion of the receiving sheet. The toner transferred onto the convex portion of the receiving sheet in a halftone part receives a larger shearing force per toner particle because of thin toner layer thickness, compared with that in a solid image part with thick toner layer thickness. Thus, offset phenomenon is likely to be caused and fixed image is likely to have low quality.

Until now, in order to pursue fixing performance and anti-hot offset, a variety of studies, mainly on binder resin, have been made. For example, JP-A No. 05-107803 proposes resin having a molecular mass distribution such that the distribution has at least one local maximal value in each of the region of a molecular mass of $10^3$ to $7\times10^4$ and the region of a molecular mass of $10^5$ to $2\times10^6$ in a chromatograph by gel permeation chromatography (GPC) of resin for toner. Further, in JP-A No. 05-289399 and JP-A No. 05-313413, the molecular mass distribution of vinyl copolymer is defined and releasing agent such as polyethylene is added to pursue fixing ability and hot offset. Furthermore, in JP-A No. 05-297630, by combining a resin having low viscosity with resin having high viscosity, an attempt to improve fixing property at low temperatures and hot offset property simultaneously is made. In other Patent Literatures, many techniques have been proposed that pursue optimization of balance of preservability, fixing ability, and hot offset that are difficult to pursue simultaneously by widening the molecular mass distribution of binder resin (See e.g. JP-A No. 05-289399, 05-313413, 05-053372, 06-027733, 06-075426, and 06-118702).

In electrophotography, anti-heat preservability, which is influenced by elements with a low molecular mass, must be also satisfied besides these two properties that are difficult to pursue simultaneously. For example, in JP-A No. 08-146661, attempts to improve anti-heat preservability, etc. by using a novolac type phenol resin or polyurethane other than molecular mass distribution have been made.

In these proposals, the effect by defining the molecular mass distribution or the effect by olefin having low molecular mass improves fixing at low temperatures and anti-heat preservability; however, these binder resins do not meet the recent demand for energy-saving and low-power enough and further investigation has been desired.

In particular, in order to improve fixing property at low temperatures, it is required to lower the glass-transition temperature (Tg) and molecular mass of binder resin. However, in the present situation, it is difficult to develop such toner that satisfies all these properties in light of balance between hot offset property and preservability.

For example, JP-A No. 11-133665 proposes a dry toner containing a urethane-modified polyester (A) as a toner binder obtained by elongation reaction and having a practical sphericity of 0.90 to 1.00 in order to improve the fluidity, fixing property at low temperatures, and hot offset property. Further, a dry toner is proposed that has excellent powder fluidity and transferability, although the toner has a small particle diameter, and is also excellent in any of anti-heat preservability, fixing property at low temperatures, and hot offset resistance. The dry toner produces glossy images, especially, when used in e.g. a full-color copier and does not require application of oil to a heat roller.

Although the dry toner proposed by JP-A No. 11-133665 is novel in that binder obtained as a result of a urethane reaction is employed, it is produced by a pulverization process and does not have satisfactory fixing ability at low temperatures. In addition, specific conditions enabling a small particle diameter and controlling particle shape so as to be spherical are not described.

Moreover, JP-A No. 11-149180 and JP-A No. 2000-292981 propose a dry toner comprising a toner binder formed from an elongation and/or a crosslinking reaction of an isocyanate group-containing prepolymer, and a colorant, wherein the dry toner is formed of particles formed from an elongation and/or a crosslinking reaction of the modified polyester (A) by amines (B) in an aqueous medium. JP-A Nos. 11-149180 and 2000-292981 also propose a method for producing the toner, which is an economically affordable method to obtain a dry toner.

The toners proposed in these JP-A Nos. 11-149180 and 2000-292981 are prepared by granulation in water. However, in such granulation in water, a pigment in an oil phase aggregates at the interface with an aqueous phase, which leads to decreased volume resistivity or uneven pigment distribution and causes problems in fundamental properties of the toner. To achieve simultaneously a small particle diameter and a satisfactorily controlled shape of a toner for use in a machine without application of oil, the specific shape and/or properties must be defined and without such specified shape and/or properties, effect cannot be achieved. However, each Patent Literature dose not describe adequately the effects of the combination of properties and/or processes or effects of the balance between detailed conditions, and thus effects on the problems may not be significantly achieved. Particularly, in the case of toner particles prepared by granulation in water, pigment and/or wax is likely to gather on the surface of the particles of toner. Toner particles having a particle diameter of about 6 μm or less have a large specific surface area, thus design of the particle surface becomes important for achieving desired charging properties fixing properties in addition to the design of the polymer component.

In general conventional electrophotographic image forming apparatus comprises a heat fixing unit in which a pressure member such as a pressure roller is brought into contact with a heating member such as heating roller having a heat source inside thereof a recording medium on which image has been transferred is passed therebetween and while the recording medium being transported, toner images on the recording medium are fixed.

In this type of heat fixing unit, so-called offset phenomenon that toner on the recording medium adheres to a heating member may occur. It is known that when this offset phenomenon occurs, offset toner also adheres to the pressure member, and toner adhered to those heating member and pressure member is transferred back to a recording medium to contaminate the recording medium. In order to prevent the occurrence of offset, in a conventional heat fixing unit, for example, the surface of a heating member was coated with fluorine. However, it is difficult to prevent offset phenomenon completely depending on environmental conditions, types of recording medium, etc, eventually causing reverse transfer.

Therefore, a heat fixing unit is proposed in which a cleaning member such as cleaning roller is provided in contact with a heating member and pressure member to thereby remove toner adhered to the heating member and pressure member. In this heat fixing unit, cleaning member, made of pure metal material is brought into contact with a heating member or pressure member having improved surface releasability, thereby removing toner due to the difference of surface releasability.

Recently, an image forming apparatus has been constructed in the following manner in order to prevent a waste of energy. Specifically, during the stand-by state, current to the heat source of a heat fixing unit is stopped, only when image forming starts, current is allowed to flow to the heat source, and the temperature of the heating member is raised to the fixing temperature. Therefore, the heating member is required to have improved response to temperature, for example, a heating roller has a thickness of 1 mm or less, thereby shortening the time to rise to a fixing temperature to approximately 10 seconds.

In such image forming apparatus, the heating member of a heat fixing unit has a low thermal capacity, thus heat easily moves to a recording medium at the time of fixing or to a member contacting with the heating member, or the heating member is liable to be influenced by the flow of the wind around the heating member. These cause a problem that the temperature distribution of the heating member is likely to become uneven in the direction of width. Therefore, it is impossible to make the temperature distribution even over the entire region in terms of space and cost.

In a heat fixing unit, uneven temperature distribution of heating member in the direction of width leads to unstability of fixing performance, and at the same time, offset is likely to occur. In addition, there is a problem that deterioration by heat makes the lifetime of a heating member shorter. In particular, the use of polymerized toner produced by polymerization described in JP-A Nos. 11-133665 and 2000-292981 causes a problem that tone adheres to a cleaning member and accumulates thereon, and the masses of toner melt again and the toner is transferred back to a recording medium. This is because when pulverized toner produced by pulverization is used, the toner adhered to the cleaning member has a high storage modulus and is unlikely to melt; however, when polymerized toner produced by polymerization is used, the toner adhered to the cleaning member has a low storage modulus, as is expected to toner produced by polymerization.

This problem is caused especially when recording medium, e.g. a paper, with small size compared with maximum size to which sheet is run through is passed through. The reason for this is considered as follows. The passed region by a recording medium with small size is narrow and thus the contact area with a heating member is small. Therefore, only the narrow region has decreased temperature and temperature sensor corresponding to the region dictates switch-on of a heat source, resulting in unnecessary rise in temperature of the region where sheet has not passed. This causes the toner on a cleaning member corresponding to the region where sheet has not passed to melt and be transferred back.

In attempting to solve such problem of back transfer, JP-A No. 09-325550 proposes a heat fixing unit in which in order to make the temperature distribution of heating roller uniform in the direction of width, wind is applied, thereby preventing the region where sheet has not passed of the heating roller from having excessively raised temperature.

In addition, JP-A No. 2002-123119 proposes a heat fixing unit in which air holes are provided along a cleaning roller so that air in the heat fixing unit is circulated with rotation of the cleaning roller to thereby prevent the temperature of the cleaning roller from being raised.

However, there has not been provided a toner which can fix satisfactorily immediately after power activation and even under low-power condition, which has releasability applicable to from low-speed through high-speed image forming apparatuses, which is excellent in offset resistance, blocking resistance, and flowability, which does not affect fixing efficiency in a heat fixing unit, and which is not transferred back when adhered to a cleaning member; and related techniques. Thus, in the present situation, it has been desired that such toner and related techniques are provided as soon as possible.

SUMMARY OF THE INVENTION

A first object of the invention is to provide a toner such that the toner corresponds to a low-temperature fixing system, is excellent in both of offset resistance and anti-heat preservability and especially, even after a large number of copies are to be produced over a long period, the toner does not aggregate to each other, deterioration of flowability, transferability, and fixing ability is extremely rare, the toner makes it possible to form stable images on any transferring medium without transfer errors and with good reproducibility, and further does not contaminate fixing unit and images; and is also to provide a developer, toner container, process cartridge, image forming apparatus, and image forming method using the toner.

A second object of the invention is to provide a toner which can fix satisfactorily immediately after power activation and even under low-power condition, which has releasability applicable to from low-speed to high-speed image forming apparatuses, which is excellent in offset resistance, blocking resistance, and flowability, which does not affect fixing efficiency in a heat fixing unit, and which is not transferred back when adhered to a cleaning member; and is also to provide a developer, toner container, process cartridge, image forming apparatus, and image forming method using the toner.

A third object of the invention is to provide a toner such that images with high density and resolution without fogging can be obtained from low-speed to high-speed image forming apparatuses; and is also to provide a developer, toner container, process cartridge, image forming apparatus, and image forming method using this toner.

From a dedicated investigation of relationship between fixing ability, particularly, offset resistance, and heat characteristic obtained from a capillary type flow tester that has been carried out by the present inventors to settle above issues, it is found that the following toner can settle above issues. Specifically, firstly, the toner has a ½ flown-out temperature, Tma of 130° C. to 200° C. Secondly, temperature difference ΔTm, Tma−Tmb, is 0° C. to 20° C., wherein Tma is ½ flown-out temperature of the toner and Tmb is ½ flown-out temperature of a melt kneaded mixture of the toner in which the toner is completely uniformly melted and dispersed by sufficient melting, shearing, and kneading.

Namely, the primary cause of hot offset is a resin having a low softening point in the toner, and thus it is important to make this resin to have an appropriate flow temperature. In addition to above-noted resin, toner typically also contains a resin having highly cross-linked structure such as a gel component, releasing agent, etc., and a capillary type flow tester is suitable for measuring comprehensive flow temperature of these. The higher the heat characteristic is, especially, the higher the ½ flown-out temperature is, the better hot offset resistance tends to become; however, the correlation between them was low. The reason for this is considered, for example, as follows. In the case of toner having a so-called core/shell structure where a resin having highly cross-linked structure concentrates on the toner surface and a resin having a low softening point exists inside the toner; or toner having a sea-island structure where a gel component is present in a resin having a low softening point, only measurement of heat characteristic of toner itself is not considered to be appropriate to know the heat characteristic of the toner at the time when heat and pressure are sufficiently applied in a fixing section. Therefore, even if toner having a core/shell structure, as polymerized toner often has, or the like has a sufficiently high ½ flown-out temperature, the core/shell structure is destroyed at the time of fixing and a resin having a low melting point flows out to the outside of the shell which may cause offset. In contrast, the present inventors have found that there is a high correlation between: ½ flown-out temperature of a kneaded mixture of toner in which toner composition is completely uniformly melted and dispersed by melting, shearing, and kneading of toner; and hot offset resistance, and particularly, have found that remarkably high hot offset resistance can be obtained by satisfying the above-mentioned first and second conditions of the invention.

Further, the present inventors have found that when toner is obtained by dissolving or dispersing a polymer (prepolymer) that is reactive with an active hydrogen group-containing compound, releasing agent and colorant at least in an organic solvent to form a toner solution, dispersing the solution or dispersion in an aqueous medium, reacting the polymer that is reactive with an active hydrogen group-containing compound, after or during the reaction, removing the organic solvent, washing and drying, the toner improves the effect of the invention.

In addition, the present inventors further intensively investigated toner which is excellent in flowability, transferability, fixing ability, hot offset property, image quality, and anti-heat preservability, which does not affect fixing efficiency in a heat fixing unit, and which is not transferred back when adhered to a cleaning roller. As a result, the dry toner described in JP-A Nos. 11-149180 and 2000-292981 is formed of particles formed from an elongation and/or a crosslinking reaction of the modified polyester (A) by amines (B) in an aqueous medium and the toner is granulated in water. The dry toner has a particle structure wherein the particle surface of the toner is moderately coated with a modified polyester, low Tg polyester and modified polyester are present inside the particle of toner, wax as a releasing agent is dispersed near the particle surface, and further, the surface is coated with polymeric resin fine particles which serves as a surface layer of the toner particle. It realized that in the heat roller type fixing, a low softening polymer having low heat characteristic inside the particle bleeds out promptly to contribute to fixing. In addition, it has found that formation of thin layer made of resin fine particles as a surface layer of toner enables preservability (especially heat resistance) at the same time due to control of heat characteristic and molecular mass, in particular, since binder having a low softening point prevents blocking by its heat.

Moreover, it has found that by the improvement of fixing ability as a result of allowing toner particle to have a small particle diameter, toner has fixing property at low temperatures, preservability, fixing property at low temperatures, releasability, small particle diameter, and highly dispersed pigment, thereby enabling high image quality.

In normal image output, the toner, adhered to a fixing roller from a recording paper due to electrostatic offset or the like, is transferred to a pressure roller at a nip portion where the fixing roller and pressure roller contacts to each other. The toner adhered to the pressure roller is collected by a cleaning roller at a nip portion between the pressure roller and cleaning roller. The toner adhered to the fixing roller through such process is collected by the cleaning roller and approximately several grams of toner are collected by the cleaning roller after copied 150,000 sheets.

Here, as shown in FIG. 14, when a toner is adhered to a cleaning roller 600 and a fixing unit 610 is rotated under the heater control of a heater 603 arranged inside of a fixing roller 602 without making a recording paper to pass through, no problem occurs in the case of pulverized toner composed of conventional uniform dispersion of pigment, wax, and resin. This is because the resin used as a binder has a relatively high glass-transition temperature (Tg), around 60° C., thus the toner, which adheres to a cleaning roller during cleaning, has a high viscosity, and even if the temperature rises as the number of copy increases, the adhered toner is unlikely to remelt. This is also because the temperature at which toner melts doe not vary before and after fixing process due to uniformity of the adhered toner.

On the other hand, when polymerized toner having a core/shell structure, as described in JP-A No. 2000-292981, is used, heat is required for melting polymeric resin of a shell at the time of fixing. However, once toner undergoes fixing process, the core/shell structure is destroyed, temperature characteristic of low molecular mass resin, which melts at relatively low temperature, becomes dominant and the toner tends to melt at lower temperature than the temperature set for fixing. Therefore, as shown in FIG. 14, when a toner is adhered to a cleaning roller 600 and a fixing unit 610 is rotated under the heater control of a heater 603 arranged inside of a fixing roller 602 without making a recording paper to pass through, collected toner adversely remelts and adheres again to the pressure roller 601 and fixing roller 602. If images are formed with this state, a problem is caused that the remelted toner adheres to a recording paper, contaminating both sides of the recording paper. In order to achieve fixing property at low temperatures, this core/shell structure is very advantageous toner structure in that a resin having a lower glass-transition temperature (Tg) compared with that of resin in pulverized toner can be used and that even if low molecular mass resin is used, both of preservability and fixing property at low temperatures can be pursued. However, it has found that with respect to adhesion of toner to the fixing cleaning roller, the adhered toner has a glass-transition temperature (Tg) lower than that of pulverized toner by about 5° C. to about 15° C., the toner adhered to the cleaning roller remelts due to the heat of fixing roller during copying and is transferred back to the fixing roller.

Accordingly, the present inventors have developed a toner such that the toner structure remains to be a core/shell structure, fixing property at low temperatures and preservability, hot offset property, and prevention of remelting of toner from a cleaning roller of a fixing roller are pursued at the same time, and further the toner enables images with high resolution.

Specifically, it has found that the toner including a toner material and has resin fine particles on the surface thereof wherein the toner has a glass-transition temperature (Tg) of 30° C. to 46° C., the resin fine particles have a glass-transition temperature (Tg) of 50° C. to 70° C., when the toner is masticated with Labo Plastomill, the ½ flown-out temperature is 95° C. to 120° C., and before the toner is masticated, ½ flown-out temperature is 120° C. to 145° C., is unlikely to cause remelting of toner and can satisfy fixing property at low temperatures and hot offset property.

The invention is based on the above-mentioned findings by the present inventors and the means for solving the problems are as follows. Specifically, <1> A toner including a toner material, wherein the toner satisfies the following formula:

$$0° C. \leqq \Delta Tm \leqq 20° C.$$

where ΔTm represents Tma (° C.)−Tmb (° C.), Tma (° C.) is ½ flown-out temperature of the toner by a capillary type flow tester, and Tmb (° C.) is ½ flown-out temperature of a melt kneaded mixture of the toner by the capillary type flow tester, and wherein Tma is from 130° C. to 200° C.

<2> The toner according to the <1>, wherein the toner satisfies the following formula:

$$5° C. \leqq \Delta Tm \leqq 20° C.$$

where ΔTm represents Tma−Tmb, and wherein Tma is from 130° C. to 200° C.

<3> The toner according to the <2>, wherein the toner satisfies the following formula:

$$7° C. \leqq \Delta Tm \leqq 15° C.$$

where ΔTm represents Tma−Tmb, and wherein Tma is from 145° C. to 180° C.

<4> The toner according to any one of the <1> to <3>, wherein a tetrahydrofuran (THF) insoluble content (gel content) in the toner is from 10% by mass to 55% by mass.

<5> The toner according to any one of the <1> to <4>, wherein the molecular mass distribution of the toner measured by gel permeation chromatography (GPC) has at least one peak in a molecular mass region of 5,000 to 25,000.

<6> The toner according to any one of <1> to <5>, wherein the toner has a glass-transition temperature, Tg, of 50° C. to 70° C., <7> The toner according to any one of <1> to <6>, wherein the average circularity of the toner is 0.94 to 0.99.

<8> A toner including a toner material and resin fine particles on a surface of the toner, wherein the toner has a glass-transition temperature, Tg, of from 30° C. to 46° C., the resin fine particles have a glass-transition temperature, Tg, of from 50° C. to 70° C., and wherein, when the toner has been masticated with Labo Plastomill the toner has a ½ flown-out temperature of from 95° C. to 120° C., and before the mastication of the toner, the toner has a ½ flown-out temperature of from 120° C. to 145° C.

<9> The toner according to the <8>, wherein a tetrahydrofuran (THF) insoluble content (gel content) in the toner is from 5% by mass to 25% by mass.

<10> The toner according to one of the <8> and <9>, wherein, in a particle size distribution measured by a flow type particle image measuring apparatus, the content of minute particles having a particle diameter of 2 μm or less is 15% or less.

<11> The toner according to any one of the <8> to <10>, wherein, in a distribution of particle diameter measured by a Coulter method, the content of large grains having a particle diameter of 8 μM or more is 2% by mass or less.

<12> The toner according to any one of the <8> to <11>, wherein, in a distribution of particle diameter measured by a Coulter method, the content of minute particles having a particle diameter of 3 μm or less is 2% by mass or less.

<13> The toner according to any one of the <8> to <12>, wherein the toner has an average circularity of from 0.900 to 0.960 and has a spindle shape.

<14> The toner according to any one of the <8> to <13>, wherein the average particle diameter of the resin fine particles is 10 nm to 200 μm.

<15> The toner according to any one of the <1> to <14>, wherein the volume average particle diameter (Dv) of the toner is 3.0 μm to 7.0 μm, and the ratio of the volume average particle diameter (Dv) to the number average particle diameter (Dn), Dv/Dn, is 1.25 or less.

<16> The toner according to any one of the <1> to <15>, wherein the toner is obtained by:

at least one of dissolving and dispersing the toner material including an active hydrogen group-containing compound and a polymer that is reactive with the active hydrogen group-containing compound in an organic solvent to form a toner solution;

at least one of emulsifying and dispersing the toner solution in an aqueous medium containing resin fine particles to prepare a dispersion;

reacting the active hydrogen group-containing compound with the polymer that is reactive with the active hydrogen group-containing compound in the aqueous medium to granulate adhesive base materials; and removing the organic solvent.

<17> The toner according to the <16>, wherein the adhesive base material includes a polyester resin.

<18> The toner according to the <17>, wherein the acid value of the polyester resin is 15 mgKOH/g to 45 mgKOH/g.

<19> The toner according to one of the <17> and <18>, wherein the polyester resin includes a tetrahydrofuran soluble component and the tetrahydrofuran soluble component has a molecular mass distribution such that a main peak is present in a molecular mass region of 2,500 to 10,000 and that the number average molecular mass thereof is in the range of 1,500 to 15,000.

<20> A developer including the toner of any one of the <1> to <19>.

<21> The developer according to the <20>, which is one of a one-component developer and a two-component developer.

<22> A toner container including: a container; and the toner of any one of the <1> to <19> contained therein.

<23> A process cartridge including: a latent electrostatic image bearing member; and a developing unit configured to develop a latent electrostatic image on the latent electrostatic image bearing member using the toner of any one of the <1> to <19> to form a visible image.

<24> An image forming apparatus including: a latent electrostatic image bearing member; a latent electrostatic image forming unit configured to form an latent electrostatic image on the latent electrostatic image bearing member; a developing unit configured to develop the latent electrostatic image using the toner of any one of the <1> to <19> to form a visible image; a transferring unit configured to transfer the visible image onto a recording medium; and a fixing unit configured to fix the transferred image on the recording medium.

<25> The image forming apparatus according to the <24>, wherein the latent electrostatic image bearing member includes an amorphous silicon.

<26> The image forming apparatus according to one of the <24> and <25>, wherein the fixing unit is a heat fixing unit which fixes a toner image on a recording medium while the recording medium is passed between a heating member and a pressure member and is transported.

<27> The image forming apparatus according to the <26>, wherein the heat fixing unit includes a cleaning member which removes a toner adhered to at least one of the heating member and the pressure member, and wherein a surface pressure (roller load/contact area) applied between the heating member and the pressure member is $1.5\times10^5$ Pa or less.

<28> The image forming apparatus according to one of the <24> and <25>, wherein the fixing unit includes: a heating member equipped with a heat generator; a film which contacts with the heating member; and a pressure member which makes pressure contact with the heating member via the film, wherein the recording medium, on which an unfixed image is formed after electrostatic transfer, is passed between the film and the pressure member to thereby heat and fix the unfixed image.

<29> The image forming apparatus according to one of the <24> and <25>, wherein the fixing unit includes: a heating roller; a fixing roller arranged parallel to the heating roller; an endless belt-like toner heating medium; and a pressure roller, wherein the heating roller includes a magnetic metal and is heated by electromagnetic induction; the toner heating medium is spanned over the heating roller and the fixing roller, is heated by the heating roller, and is rotated by these rollers; the pressure roller is brought into pressure contact with the fixing roller via the toner heating medium and rolls in the forward direction towards the toner heating medium to form a fixing nip portion, and wherein a recording medium, on which an unfixed image is formed after electrostatic transfer, is passed between the toner heating medium and the pressure member to thereby heat and fix the unfixed image.

<30> An image forming method including: forming a latent electrostatic image on a latent electrostatic image bearing member; developing the latent electrostatic image using the toner of any one of the <1> to <19> to form a visible image; transferring the visible image onto a recording medium; and fixing the transferred image on the recording medium.

<31> The image forming method according to the <30>, wherein a charging member is contacted to the latent electrostatic image bearing member and a voltage is applied to the charging member to charge the latent electrostatic image bearing member.

<32> The image forming method according to one of one of the <30> and <31>, wherein, when developing the latent electrostatic image on the latent electrostatic image bearing member, an alternate electric filed is applied to a charging member.

The toner of the invention, in a first aspect, includes toner material, wherein the toner satisfies the following formula:

$$0° C. \leqq \Delta Tm \leqq 20° C.$$

where ΔTm represents Tma (° C.)−Tmb (° C.), Tma (° C.) is ½ flown-out temperature of the toner by a capillary type flow tester, and Tmb (° C.) is ½ flown-out temperature of a melt kneaded mixture of the toner by the capillary type flow tester, and wherein Tma is from 130° C. to 200° C. As a result, although the toner is a polymerized toner having a core/shell structure, the toner is excellent in both of offset resistance and anti-heat preservability and especially, even after a large number of copies are to be produced over a long period, the toner does not aggregate to each other, deterioration of flowability, transferability, and fixing ability is extremely rare, and the toner makes it possible to form stable images on any transferring medium without transfer errors and with good reproducibility.

The toner of the invention, in a second aspect, includes a toner material and resin fine particles on the surface of the toner, wherein the toner has a glass-transition temperature (Tg) of from 30° C. to 46° C., the resin fine particles have a glass-transition temperature (Tg) of from 50° C. to 70° C., and wherein, when the toner has been masticated with Labo Plastomill, the toner has a ½ flown-out temperature of from 95° C. to 120° C., and before the mastication of the toner, the toner has a ½ flown-out temperature of from 120° C. to 145° C. As a result, such toner can be provided that the toner can fix satisfactorily immediately after power activation and even under low-power condition; has releasability applicable to from low-speed to high-speed image forming apparatuses; is excellent in offset resistance, blocking resistance, and flowability; does not affect fixing efficiency in a heat fixing unit; is not transferred back when adhered to a cleaning member; and can form images with high density and resolution without fogging.

The developer of the invention includes the toner according to one of the first and second aspects of the invention. Therefore, when image formation is carried out by electrophotographic method using the developer, images with high quality can be obtained wherein the toner forming the image corresponds to a low-temperature fixing system, is excellent in both of offset resistance and anti-heat preservability and especially, even after a large number of copies are to be produced over a long period, the toner does not aggregate to each other, deterioration of flowability, transferability, and fixing ability is extremely rare, and the toner makes it possible to form stable images on any transferring medium without transfer errors and with good reproducibility.

The toner container of the invention includes a container and the toner according to one of the first and second aspects of the invention contained therein. Therefore, when image formation is carried out by electrophotographic method using the developer, images with high quality can be obtained wherein the toner forming the image corresponds to a low-temperature fixing system, is excellent in both of offset resistance and anti-heat preservability and especially, even after a large number of copies are to be produced over a long period, the toner does not aggregate to each other, deterioration of flowability, transferability, and fixing ability is extremely rare, and the toner makes it possible to form stable images on any transferring medium without transfer errors and with good reproducibility.

The process cartridge of the invention includes a latent electrostatic image bearing member for bearing a latent electrostatic image and a developing unit for developing the latent electrostatic image on the latent electrostatic image bearing member using the toner of the invention to form an visible image. Because the process cartridge is conveniently detachable onto/from an image forming apparatus and uses toner according to one of the first and second aspects of the invention, clear images with high quality can be obtained wherein the toner forming the image corresponds to a low-temperature fixing system, is excellent in both of offset resistance and anti-heat preservability and especially, even after a large number of copies are to be produced over a long period, the toner does not aggregate to each other, deterioration of flowability, transferability, and fixing ability is extremely rare, and the toner makes it possible to form stable images on any transferring medium without transfer errors and with good reproducibility.

The image forming apparatus of the invention includes: a latent electrostatic image bearing member; a latent electrostatic image forming unit configured to form an latent electrostatic image on the latent electrostatic image bearing member; a developing unit configured to develop the latent electrostatic image using the toner according to one of the first and second aspects of the invention to form a visible image; a transferring unit configured to transfer the visible image onto a recording medium; and a fixing unit configured to fix the transferred image on the recording medium. In the image forming apparatus, the latent electrostatic image forming unit forms a latent electrostatic image on the latent electrostatic image bearing member. The transferring unit transfers the visible image onto the recording medium. The fixing unit fixes the transfer image onto the recording medium. As a result, high quality electrophotographic images can be formed wherein the toner forming the image corresponds to a low-temperature fixing system, is excellent in both of offset resistance and anti-heat preservability and especially, even after a large number of copies are to be produced over a long period, the toner does not aggregate to each other, deterioration of flowability, transferability, and fixing ability is extremely rare, and the toner makes it possible to form stable images on any transferring medium without transfer errors and with good reproducibility.

The image forming method of the invention includes: forming a latent electrostatic image on a latent electrostatic image bearing member; developing the latent electrostatic image using the toner according to one of the first and second aspects of the invention to form a visible image; transferring the visible image onto a recording medium; and fixing the transferred image on the recording medium. In the image forming method, the latent electrostatic image is formed on the latent electrostatic image bearing member in the latent electrostatic image forming. The visible image is transferred onto the recording medium in the transferring. The transferred image is fixed on the recording medium in the fixing. As a result, high quality electrophotographic images can be formed wherein the toner forming the image corresponds to a low-temperature fixing system, is excellent in both of offset resistance and anti-heat preservability and especially, even after a large number of copies are to be produced over a long period, the toner does not aggregate to each other, deterioration of flowability, transferability, and fixing ability is extremely rare, and the toner makes it possible to form stable images on any transferring medium without transfer errors and with good reproducibility.

BRIEF DESCRIPTION OF THE DRAWINGS

FIG. 14

FIG. 15 is a schematic diagram showing an example of the toner particle of the invention.

DESCRIPTION OF THE PREFERRED EMBODIMENTS (Toner)

Figure 1:
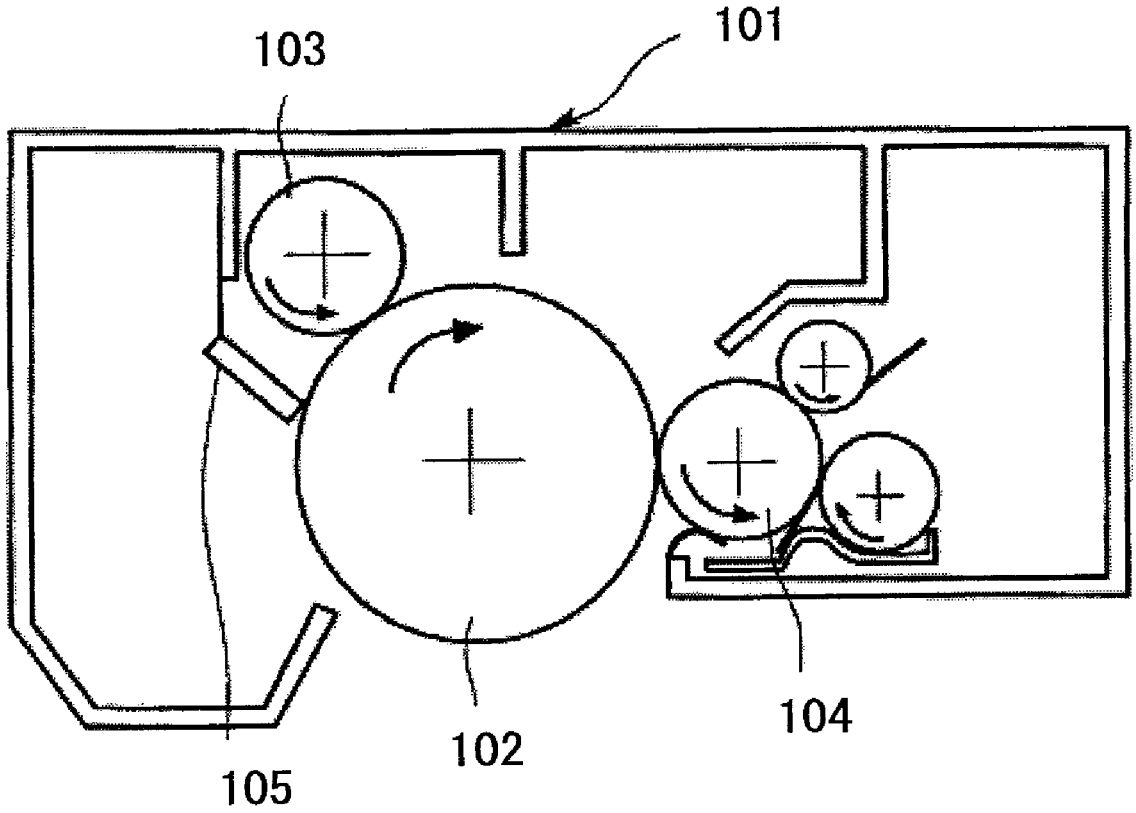
FIG. 1 is a schematic view showing an example of the process cartridge of the invention.

The toner of the invention, in a first aspect, comprises toner material, wherein the toner satisfies the following formula:

$$0° \text{ C.} \leqq \Delta Tm \leqq 20° \text{ C.}$$

where ΔTm represents Tma (° C.)−Tmb (° C.), Tma (° C.) is ½ flown-out temperature of the toner by a capillary type flow tester, and Tmb (° C.) is ½ flown-out temperature of a melt kneaded mixture of the toner by the capillary type flow tester, and wherein Tma is from 130° C. to 200° C.

Here, the toner in the melt kneaded mixture of toner can be melted and kneaded by any method without limitation if the toner is sufficiently melted, sheared and kneaded, compositions such as a binder resin and releasing agent in a toner can be completely and uniformly melted and dispersed by the method and the method can be appropriately selected according to the purpose. Examples of the kneading machine include such as a uniaxial extruding kneader, biaxial extruding kneader, batch-type kneader, and the like. The kneading temperature is preferably 130° C. to 150° C. Conditions of kneading such as torque, rotation number, and time are preferably such a degree that molecular chain of the composition of toner such as a binder resin is not cleaved. The conditions are determined approximately to the degree where gel content in a toner does not vary between before and after kneading. Details about measurement of gel content will be described later.

Here, the melt-kneading was carried out as follows. Specifically, batch type kneading was carried out using a Labo Plastomill 4C 150 type (by Toyo Seiki Seisaku-sho, Ltd) and a melt kneaded mixture of toner was obtained. The toner amount used in kneading was 45 g, the heating temperature was 130° C., the rotation number was 50 rpm, and the kneading time was 15 minutes.

In the toner of the first aspect of the invention, ½ flown-out temperature Tma obtained from capillary type flow tester is required to be 130° C. to 200° C., preferably 145° C. to 180° C. If the Tma is lower than this range, satisfactory hot offset resistance can not be obtained, besides, anti-heat preservability may be deteriorated. In addition, toner offset to the fixing member such as fixing roller is cleaned with e.g. a cleaning device on a fixing roller, which toner may cause such phenomenon that accumulated toner melts again and is transferred to fixing member, leading to contamination. Tma higher than this range is not preferable because offset resistance becomes extremely satisfactory, but fixing property at low temperatures is impaired, thus not preferable.

The temperature difference ΔTm between ½ flown-out temperature of the toner Tma and ½ flown-out temperature of toner mixture Tmb, in which toner compositions are sufficiently evenly melted and dispersed by sufficient melting, shearing, and kneading of the toner, is required to be 0° C. to 20° C., preferably 5° C. to 20° C., more preferably 7° C. to 15° C., most preferably 7° C. to 10° C. Larger temperature difference than this range causes fusion of resins having a low softening point to a fixing member easily even if the ½ flown-out temperature of toner Tma satisfies 130° C. to 200° C., and therefore it is impossible to expect sufficient hot offset resistance. Further, it is required to have appropriate temperature difference. This indicates that toner has a core/shell structure, which makes mechanical strength of toner strong and also has an effect of reducing exposure of wax to the surface, thus enabling prevention of wax spent. Furthermore, even if resin having low molecular mass is used in a toner, less contamination of photoconductor, developing member, carrier, etc. by toner occurs because the resin on the surface serves as a shell.

Here, the ½ flown-out temperature is measured using, for example, a capillary type flow tester (CFT-500C, by Shimadzu Corporation) and is the value representing the temperature at the time when half of the sample has flown out. Measurement was carried out under the condition of Load: 30 kg, Die diameter: 1 mm, Temperature rising rate: 3° C./min.

Preferably, the toner of the first aspect of the invention has volume average particle diameter (Dv), volume average particle diameter (Dv)/number average particle diameter (Dn), average circularity, gel content, molecular mass peak, glass-transition temperature (Tg), etc. as described below.

The volume average particle diameter (Dv) of the toner is, for example, preferably 3 μm to 7 μm, more preferably 4 μm to 7 μm, most preferably 5 μm to 6 μm. Here, the volume average particle diameter is defined as: $Dv=[(\Sigma(nD^3)/\Sigma n)/^{1/3}$, where n is number of particle and D is particle diameter.

When the volume average particle diameter is less than 3 μm, the toner of two-component developer is likely to fuse onto the carrier surfaces as a result of stirring in the developing unit for a long period and the charging capability of carrier may be deteriorated. On the other hand, one-component developer is likely to cause filming to the developing roller or fusion to the members such as blade for reducing toner layers thickness. If the volume average particle diameter is more than 7 μm, obtaining high-resolution, high-quality images becomes difficult, and the particle diameter of toner may fluctuate when toner inflow/outflow is implemented in the developer.

The ratio (Dv/Dn) of the volume average particle diameter (Dv) to the number average particle diameter (Dn) in the toner is preferably 1.25 or less, more preferably 1.00 to 1.20, and most preferably 1.10 to 1.20.

When the ratio is 1.25 or less, the toner is likely to have relatively sharp particle size distribution, thus improving the fixing properties. When the ratio is less than 1.00, the toner of two-component developer is likely to fuse onto the carrier surfaces due to stirring in a developing unit for a long period, thereby de grading charging capability of the carrier or cleaning properties, and one-component developer is likely to cause filming to the developing roller or fusion to the member such as blade for reducing toner layer thickness. When the ratio is more than 1.20, obtaining high-resolution, high-quality images becomes difficult, and the particle diameter of toner may fluctuate when toner inflow/outflow is implemented in the developer.

The volume average particle diameter and the ratio (Dv/Dn) of the volume average particle diameter to the number average particle diameter are measured using a measuring device for particle size distribution of toner according to a Coulter counter method. Examples of the measuring device include a Coulter counter TA-II, and Coulter Multisizer IIe (both by Beckman Coulter Inc.). In the invention, measurement is carried out using the Coulter counter TA-II connected with an Interface producing a number distribution and a volume distribution (by The Institute of Japanese Union of Scientists & Engineers) and a personal computer PC9801 (by NEC Corporation).

The average circularity can be obtained by dividing the circumference of an equivalent circle having the same area as the projected area of the shape of toner particle by the circumference of actual toner particle. For example, the average circularity is preferably 0.94 to 0.99 and more preferably 0.950 to 0.98. Preferably, the amount of the particle having an average circularity of less than 0.94 is 15% or less.

When the average circularity is less than 0.94, sufficient transfer properties or high quality images with no dust may not be obtained. When the average circularity is more than 0.99, it is likely to cause image smears resulted from cleaning failures on the photoconductor or transfer belt in the image-forming system utilizing cleaning blades. Specifically, in the case of image formation having large image area such as photo graphic images, a residual toner resulted from forming untransferred images on the photoconductor due to paper feed failure or the like, is accumulated and causes background smear on the formed image, or pollutes charging rollers which contact-charge the photoconductor and inhibit charging rollers to exhibit original charging ability.

The average circularity is measured, for example, by the optical detection zone method in which a suspension containing toner is passed through an image-detection zone disposed on a plate, the particle images of the toner are optically detected by CCD camera, and the obtained particle images are analyzed. For example, the flow-type particle image analyzer FPIA-2100 by Sysmex Corp. may be employed for such method.

The THF insoluble content of toner refers to polymer gel content with a crosslinked structure. Gel content contained in a toner is preferably 10% by mass to 55% by mass, more preferably 10% by mass to 40% by mass, and most preferably 15% by mass to 30% by mass. If the gel content is less than this range, improvement of hot offset resistance can not be expected. Conversely, larger gel content may deteriorate fixing property at low temperatures.

Here, the gel content is measured as follows. 1 g of toner is weighed, to this, 100 g of tetrahydrofuran (THF) is added, and left at 10° C. for 20 hours to 30 hours. After 20 hours to 30 hours, gel fraction, THF insoluble components, absorbs THF as a solvent, and swells to precipitate, and then this is separated with a filter paper. Separated gel fraction is heated at 120° C. for 3 hours, absorbed THF is volatilized, and then mass is weighed. Thus, gel fraction is measured.

Preferably, the molecular mass distribution of the toner measured by gel permeation chromatography (GPC) has at least one peak in a molecular mass region of 5,000 to 25,000. Molecular mass 8,000 to 20,000 in the molecular mass distribution is more preferable, most preferably molecular mass 13,000 to 18,000. The toner having molecular mass peak in this range has satisfactory balance of fixing property at low temperatures and hot offset resistance.

Here, the molecular mass distribution is measured according to the following method. First, the column inside the heat chamber of 40° C. is stabilized. To the column at this temperature, THF as a solvent is drained at a current speed of 1 ml/minute and 50 μl to 200 μl of THF sample solution of the toner whereof a sample density is adjusted to 0.05% by mass to 0.6% by mass, is poured and measured. In the measurement of molecular mass of the sample, a molecular mass distribution of the sample is calculated from the relationship between log values of the analytical curve made from several monodisperse polystyrene standard samples and counted numbers. The standard polystyrene sample for making analytical curves is preferably the one with a molecular mass of $6\times10^2$, $2.1\times10^2$, $4\times10^2$, $1.75\times10^4$, $5.1\times10^4$, $1.1\times10^5$, $3.9\times10^5$, $8.6\times10^5$, $2\times10^6$ and $4.48\times10^6$ by Pressure Chemical Co. or Tosoh Corporation and at least using approximately 10 pieces of the standard polystyrene sample is preferable. A refractive index (RI) detector may be used for above-mentioned detector.

The glass-transition temperature (Tg) of the toner is not particularly limited and can be appropriately selected according to the purpose, for example, preferably 50° C. to 70° C., more preferably 55° C. to 65° C. In the toner, polyester resins which underwent a crosslinking reaction and/or an elongation reaction are existed together, which allows the toner to show satisfactory preservability although the toner has low glass-transition temperature compared with a conventional polyester resin.

If the glass-transition temperature (Tg) is less than 50° C., the anti-heat preservability of toner may be deteriorated. If Tg exceeds 70° C., the fixing property at low temperatures may not be sufficient.

The glass-transition temperature can be measured using, for example, TG-DSC system TAS-100 (by Rigaku Denki Co., Ltd.) according to the following method. Initially, about 10 mg of toner is placed in an aluminum sample vessel. The vessel is placed on a holder unit, which is then set in an electric furnace. The sample is heated from room temperature to 150° C. at a temperature rising rate of 10° C./min. After being allowed to stand at 150° C. for 10 minutes, the sample is cooled to room temperature and allowed to stand for 10 minutes. Then, in a nitrogen flow, DSC measurement is carried out using a differential scanning calorimeter (DSC) while heating the sample to 150° C. at a temperature rising rate of 10° C./min. Glass-transition temperature (Tg) is determined using the analyzing system of the TG-DSC system TAS-100 system as a temperature at the intersection of the base line and a tangential line of the endothermic curve near the glass-transition temperature (Tg).

The toner of the invention, in a second aspect, comprises a toner material and resin fine particles on the surface of the toner, wherein the toner has a glass-transition temperature (Tg) of from 30° C. to 46° C., the resin fine particles have a glass-transition temperature (Tg) of from 50° C. to 70° C., and wherein, when the toner has been masticated with Labo Plastomill, the toner has a ½ flown-out temperature of from 95° C. to 120° C., and before the mastication of the toner, the toner has a ½ flown-out temperature of from 120° C. to 145° C.

In the toner of the second aspect of the invention, resin fine particles adhered to the surface of the toner is solider than the resin inside of toner. Thus, when heat characteristic is measured with a flow tester, the heat characteristic cannot be evaluated appropriately because of influence of the resin particles adhered to the surface. Therefore, appropriate evaluation becomes possible by masticating with certain energy to destroy a layer of resin fine particles of the surface and by measuring heat characteristic of the toner layer inside the particle. With respect to the conditions under which toner is masticated with Labo Plastomill, if shearing energy is high, not only resin particles on the toner particle surface but also resin molecules of the toner layer inside the toner particle are cut, making it impossible to achieve goal, that is, to measure heat characteristic of the toner layer inside the toner. In contrast, if shearing energy is weak, it is impossible to evaluate due to the influence of resin fine particles on the surface. Therefore, the condition under which toner is masticated with Labo Plastomill is such that resin fine particle layer of the toner surface is destroyed, but the toner layer inside of a toner particle is not destroyed. Specifically, evaluation is carried out under the following conditions.

<Labo Plastomill Kneading Condition>

| | |
|---|---|
| Mixer | R60 |
| Temperature | 130° C. |
| Time | 15 minutes |
| Sample amount | 45 g |
| Mixer rotation number | 50 rpm |

In the case of pulverized toner, it is not necessary to masticate a toner because resin fine particles are not adhered to the surface. However, the toner having a core/shell structure of the invention needs this evaluation because when the toner is used in a copying machine, this influence of toner surface and heat characteristic inside of the toner influences largely on fixing quality.

When the toner is masticated with Labo Plastomill ½ flown-out temperature is 95° C. to 120° C. The ½ flown-out temperature before the mastication of toner is 120° C. to 145° C.

If the ½ flown-out temperature after mastication with the Labo Plastomill is less than 95° C., hot offset and remelting of toner from a fixing cleaning roller may be likely to occur. If the ½ flown-out temperature exceeds 120° C., remelting of toner is improved, but fixing property at low temperatures is not satisfactory. The value of flow tester before mastication is a range for obtaining optimum value after mastication. If this value is not satisfied, it is difficult to satisfy both fixing property at low temperatures and hot offset property.

Preferably, THF insoluble content (gel content) contained in the toner of the second aspect is 5% by mass to 25% by mass. This allows the toner adhering to a cleaning roller to have high elasticity, making it difficult for the toner to remelt even if the temperature of the cleaning roller increased. In the case of conventional toner, remelting of toner was not serious technical problem. Specifically, it was difficult to make the glass-transition temperature (Tg) below about 55° C., thus the toner adhering to the cleaning roller of a fixing roller is a toner having high softening point because resin component having relatively high glass-transition temperature (Tg) adheres to the cleaning roller. Therefore, the conventional toner does not remelt easily after the increase of roller temperature. However, in the case of this capsule-like toner, resin having low Tg is used in the toner inside the particle in order to enable fixing at lower temperature. Thus, the toner adhering to the fixing roller is such a toner having low Tg, leading to easy occurrence of remelting from the cleaning roller, and this characteristic of the toner is in a trade-off relationship with fixing at low temperatures. As a result of investigation of this toner adhered to the fixing cleaning roller, it was found that the adhered toner had remarkable fewer wax component which was added during initial time. When molecular mass distribution of the adhered toner was measured by GPC, it was observed that higher-molecular mass components of resins constituting toner adhered, indicating that toner components fixing are low-molecular mass components having affinity to a paper.

In this case, in the heat fixing unit in which a recording medium is passed through between a heating member and pressure member and while the recording medium being conveyed, toner images on the recording medium are fixed, the toner to be fixed adheres to a heating roller in trace amount. The adhered toner is a component which does not contain wax in the particle, or a toner component which is a component with high elasticity and cannot fix.

Therefore, conditions under which remelting of toner from the fixing cleaning roller does not occur are as follows.

(1) The amount of adhering to a roller is as small as possible.

(2) The adhering toner is high-molecular components of toner and when components with high softening point or components with high elasticity adhered, the toner does not remelt easily.

(3) Toner in which wax is dispersed uniformly in the particle does not adhere to a cleaning roller easily.

(4) The sharper the distribution in a particle size distribution is, the less the adhesion of toner in trace amount occur because heat is uniformly applied to toner at the time of fixing, thus smaller amount of toner adheres to a fixing cleaning roller.

It is estimated that fixing to a paper by a roller fixing or belt fixing begins at an effective temperature of near 70° C. to 100° C. in recent energy saving copiers, printers, facsimiles, etc. For enabling melting of toner, toner must begin to flow near this temperature, thus it is said that toner must be softened and begin to fix at least near 90° C. to 110° C.

However, in order for a toner to be softened at 90° C., glass transition must be 46° C. or less based on preservability data. The glass-transition temperature (Tg) of such polymer is also relates to molecular mass. Normally, when the glass-transition temperature (Tg) of toner becomes 46° C. or less, fixing ability becomes satisfactory, but preservability is not satisfied.

Therefore, in the toner of the second aspect of the invention, toner is designed by a binder so that the toner has a glass-transition temperature (Tg) of 30° C. to 46° C., which is extremely low temperature, and resin fine particles having a glass transition of 50° C. to 70° C. are present on the surface layer of the particle by 0.3% by mass to 2.0% by mass relative to toner particle. Particles uniformly coating toner particles serve as particles constituting pseudocapsule that protect binder having low softening from heat. The reason for the effect for hot offset, fixing property at low temperatures, and anti-heat preservability is that the binder resin of the toner surface has high-molecular mass by a urea bond resulting from reaction of prepolymer and amines, and part of the surface has a network structure and adopts three-dimensional structure which is relative strong to stress.

Further, while resin fine particles having the same heat characteristic as that of a conventional toner are used on the surface layer of the particle, inside the particle, polyester resin having low Tg is used as a toner binder, which is a structure advantageous to fixing property at low temperatures compared to an uniformly kneaded pulverized toner. FIG. 15 shows this toner particle model. 620, 621, 622, 623, and 624 represent a toner, resin fine particle, wax, polyester resin not being modified, and modified polyester resin, respectively. During fixing, the resin fine particle 621 coating the toner surface layer must respond to the thermal capacity of the heating roller quickly and make the toner particle binder soak out of surface layer. The balance between anti-heat preservability and the degree of soaking out is controlled by the amount of resin fine particles to be adhered.

Therefore, the average particle diameter of the resin fine particles adhered to the toner surface is preferably 10 nm to 200 nm. The amount of the adhering resin fine particles is 0.3% by mass to 2% by mass. If the average particle diameter is less than 10 nm, the resin fine particles do not work properly, and if it exceeds 200 nm, the resin fine particles remain thickly on the surface layer, causing the decrease of fixing ability.

The glass-transition temperature (Tg) of the toner is required to be 30° C. to 46° C., the range enabling lower temperature fixing. If the Tg of the toner is less than 30° C., the toner is difficult to be made into particle, and if it is more than 46° C., fixing property at low temperatures may not be obtained effectively.

The glass-transition temperature of the toner can be measured in the same way as in the first aspect.

Here, the residue rate (adhesion rate) of the resin fine particles can be measured by analyzing substances not resulting from toner particles but from resin fine particles with a pyrolysis gas-chromatography mass spectrometer, and by calculating the peak area. Detector is preferably a mass spectrometer, but is not particularly limited.

The volume average particle diameter (Dv) of the toner of the second aspect of the invention is preferably 3.0 μm to 7.0 μm, more preferably 3.0 μm to 6.0 μm. The ratio of the volume average particle diameter (Dv) to the number average particle diameter (Dn) is preferably 1.25 or less, more preferably $1.00 \leqq Dv/Dn \leqq 1.20$. This makes it possible to obtain a toner allowing high resolution and quality. This allows the toner to be excellent in any of anti-heat preservability, fixing property at low temperatures, and hot offset resistance. Particularly, fixing property at low temperatures had been achieved by lowering Tg; however, there was a limitation for lowering Tg in terms of preservability. Thus, by making the particle diameter small further lower temperature fixing was made possible. On the other hand, if the toner contains particles having a particle diameter of 8 μm or more in large quantity, not only fixing ability but also tone is impaired. From the point of quality, 2% by mass or less of the particles having a particle diameter of 8 μm or more do not cause large drawback. Further, in a two-component developer, even when toner inflow/outflow is implemented for a long period, the particle diameter of toner in the developer fluctuates less, and even in the case of stirring in a developing device for a long period, satisfactory and stable developability can be obtained. Generally, it is said that the smaller the particle diameter of toner is, the more advantageous to produce high resolution and quality images. However, it is disadvantageous for transferability and cleanability.

When the volume average particle diameter is smaller than the above-mentioned range, the toner in a two-component developer adheres to the surface of a carrier due to stirring in a developing device for a long period, resulting in deterioration of chargeability of the carrier. The toner in a one-component developer tends to cause filming over a developing roller and adhere to a cleaning member such as a blade for reducing toner layer thickness.

The particle diameter distribution around 3 μm largely relates to these phenomena, in particular, when the particles with a particle diameter of 3 μM or less by Coulter method exceed 2% by mass, it causes adhesion to carrier or adversely affects stability of charge at high level. In addition, cleanability as well as shape remarkably deteriorates.

Conversely, when the volume average particle diameter of the toner is larger than 6.0 μm, exceeding the range defined in the invention, obtaining high-resolution, high-quality images becomes difficult, and the particle diameter of toner fluctuates in many cases when toner inflow/outflow is implemented in the developer. This is also true of the toner with a volume average particle diameter/number average particle diameter more than 1.20.

The volume average particle diameter and the ration of volume average particle diameter to the number average particle diameter (Dv/Dn) can be measured in the same way as in the first aspect.

In the toner of the second aspect of the invention, molecular mass distribution of the binder component of the toner is measured by the method shown below. About 1 g of toner is precisely weighed in a conical flask, then 10 g to 20 g of tetrahydrofuran (THF) is added to prepare a THF solution with a binder concentration of from 5% to 10%. The column inside the heat chamber of 40° C. is stabilized. To the column at this temperature, THF as a solvent is drained at a current speed of 1 ml/minute and 20 μl of THF sample solution is poured. Molecular mass of the sample is calculated from the relationship between log values of the analytical curve made from several monodisperse polystyrene standard samples and retention time. The analytical curve is prepared using a polystyrene standard sample. The monodisperse polystyrene standard sample is, for example, a product by Tosoh Corporation, having a molecular mass of $2.7\times10^2$ to $6.2\times10^6$. A refractive index (RI) detector can be used as the detector. The columns are, for example, combinations of TSKgel, G1000H, G2000H, G2500H, G3000H, G4000H, G5000, G6000H, G7000H and GMH, all of which are available from Tosoh Corporation.

THF soluble component has a molecular mass distribution such that a main peak molecular mass is preferably from 2,500 to 10,000, more preferably from 2,500 to 8,000, most preferably from 2,500 to 6,000. When the amount of the component having the molecular mass less than 2,500 is increased, anti-heat preservability of the resultant toner tends to deteriorate. When the amount of the component having a molecular mass greater than 10,000 is increased, fixing property at low temperatures of the resultant toner simply deteriorates. However, a balance control of the content can prevent the deterioration. A content of a component having a molecular mass greater than 30,000 is from 1% to 10%, and preferably from 3% to 6%, although depending on the toner material.

The number average molecular mass of the THF soluble component is 1,500 to 15,000. 1,500 or less results in difficulty of pigment dispersion and control of making into particles during emulsion, causing a problem in wax dispersibility, and more than 15,000 makes it difficult to form particles.

The shape and diameter distribution, based on the number, of the toner of the second aspect of the invention can be measured, for example, by a flow type particle image analyzer, FPIA-2100 by Sysmex Corporation. The diameter distribution by a flow type particle image analyzer is more accurate than that by Coulter method in the measurement of particle less than 2 μm. The shape is represented by circularity. The circularity can be measured by the method described later, the circularity is the value calculated by dividing the circumference of an equivalent circle having the same projected area as the projected area of toner particle by the circumference of actual toner particle. Therefore, the circularity of perfect circle is 1.000. As the value becomes smaller from 1, the shape tend to become spindle shaped (ellipse shaped).

Figure 18:
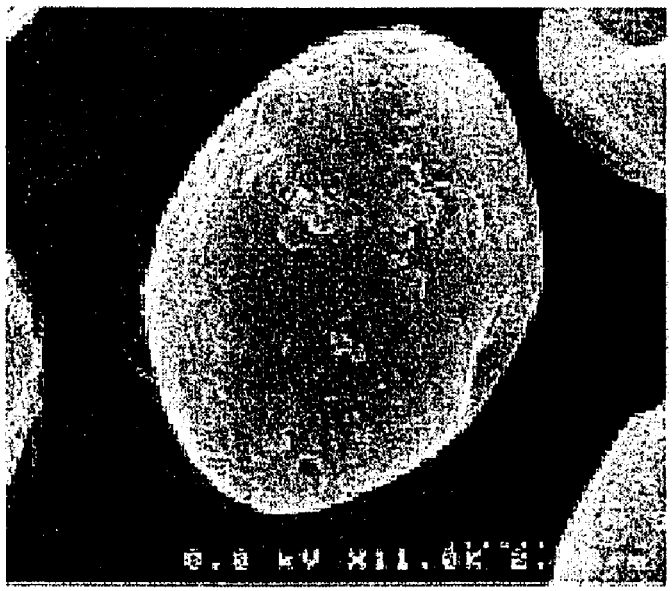
FIG. 18 is a scanning electron microscope (SEM) picture of toner obtained in Example B-1.

The average circularity of the toner of the second aspect of the invention is 0.900 to 0.960, and the toner preferably has spindle shape as shown in FIG. 18. The toner having an average circularity less than 0.900 has irregular shape and sufficient transferability or high quality images with no dust cannot be obtained. Particles having irregular shape have many contact points with smooth media such as a photoconductor, and charge concentrates on the top of projection at the high points. Thus, particles having irregular shape have relatively stronger van der Waals force and image force than spherical particles. Therefore, in the case of toners where irregular particles and spherical particles are mixed, in an electrostatic transfer step, spherical particles move selectively and resulted in dropouts in letter images or line images. Moreover, the residue toner must be removed for the next developing step, leading to the requirement for a cleaning unit, or problems occur such as low toner yield (the rate of toner to be used in image forming). The circularity of pulverized toner measured by this analyzer is normally 0.910 to 0.920.

The average circularity can be measured in the same way as in the first aspect.

The production method or material of the toner according to the first and second aspects of the invention is not particularly limited as long as the above-mentioned conditions are satisfied, and can be appropriately selected according to the purpose. For example, the binder resin to be used is preferably polyester resin in terms of fixing property at low temperatures.

Those prepared by the following way is suitable as the toner. Specifically, toner material containing at least active hydrogen group-containing compounds and reactive polymers thereof is dissolved in an organic solvent to prepare toner solution, then the toner solution is dispersed into an aqueous medium to prepare dispersion, the active hydrogen group-containing compounds and reactive polymers thereof are allowed to react in the aqueous medium to generate an adhesive base material in particle form, and the organic solvent is removed to obtain toner.

The above-mentioned production method of polymerized toner has high selectivity of resin and in the method, polyester resin having high fixing property at low temperatures can be used. In addition, because of the excellent ability to form particles and easily controlled particle diameter, particle size distribution and shape, the toner produced by the above-mentioned production method is preferable.

The toner material contains at least active hydrogen group-containing compounds and reactive polymers thereof, binder resin, releasing agent, adhesive base material produced by reaction with colorant, and other element such as resin fine particles, charge controlling agent, and the like as necessary.

—Adhesive Base Material—

The adhesive base material may exhibit adhesiveness with recording medium such as paper and contain adhesive polymer produced from a reaction between the active hydrogen group-containing compounds and reactive polymers thereof and may also contain binder resin selected from known binder resins.

The average molecular mass (Mw) of adhesive base material is not particularly limited and can be appropriately selected according to the purpose. For example, it is preferably 1,000 and more, more preferably 2,000 to 10,000,000 and most preferably 3,000 to 1,000,000.

If the average molecular mass is less than 1,000, hot offset resistance may be deteriorated.

The storage modulus of the adhesive base material is not particularly limited and may be selected according to the purpose. For example, the temperature TG', at which the storage modulus determined at 20 Hz is 10,000 dyne/cm$^2$, is normally 100° C. or more and preferably from 110° C. to 200° C. If the temperature TG' is less than 100° C., hot offset resistance may be deteriorated.

The viscosity of adhesive base material is not particularly limited and may be selected accordingly. For example, the temperature (Tη), at which the viscosity determined at 20 Hz is 1,000 poises, is normally 180° C. or less and preferably from 90° C. to 160° C. If the temperature (Tη) is more than 180° C., fixing ability at low temperature may be deteriorated.

From the viewpoint of simultaneous pursuit of hot offset resistance and fixing ability at low temperature, the temperature TG' is preferably higher than the temperature Tη. Specifically, the difference between TG' and Tη, TG'-Tη, is preferably 0° C. or more, and more preferably 10° C. or more and most preferably 20° C. and more. The higher the difference, the better the effect will be.

From the viewpoint of simultaneous pursuit of hot offset resistance and fixing ability at low temperature, the difference between TG' and Tη is preferably from 0° C. to 100° C., more preferably from 10° C. to 90° C. and most preferably from 20° C. to 80° C.

Specific examples of adhesive base material are not particularly limited and may be selected accordingly. Suitable examples thereof are polyester resin, and the like.

The polyether resin is not particularly limited and may be selected accordingly. Suitable examples thereof are urea-modified polyester, and the like.

The urea-modified polyester is obtained by a reaction between amines (B) as an active hydrogen group-containing compound, and isocyanate group-containing polyester prepolymer (A) as a polymer reactive with active hydrogen group-containing compound in the aqueous medium.

In addition, the urea-modified polyester may include a urethane bond as well as a urea bond. A molar ratio of the urea bond content to the urethane bond content is preferably 100/0 to 10/90, more preferably 80/20 to 20/80, and most preferably 60/40 to 30/70.

If a molar ratio of the urea bond is less than 10%, hot-offset resistance may be deteriorated.

Specific examples of the urea-modified polyester are preferably the following (1) to (10): (1) A mixture of (i) polycondensation product of bisphenol A ethyleneoxide dimole adduct and isophthalic acid, and (ii) urea-modified polyester prepolymer which is obtained by reacting isophorone diisocyanate with a polycondensation product of bisphenol A ethyleneoxide dimole adduct and isophtalic acid, and modifying with isophorone diamine;

(2) A mixture of (iii) a polycondensation product of bisphenol A ethyleneoxide dimole adduct and terephthalic acid, and (ii) urea-modified polyester prepolymer which is obtained by reacting isophorone diisocyanate with a polycondensation product of bisphenol A ethyleneoxide dimole adduct and terephthalic acid, and modifying with isophorone diamine; (3) A mixture of (iv) polycondensation product of bisphenol A ethyleneoxide dimole adduct, bisphenol A propyleneoxide dimole adduct and terephthalic acid, and (v) urea-modified polyester prepolymer which is obtained by reacting isophorone diisocyanate with polycondensation product of bisphenol A ethyleneoxide dimole adduct, bisphenol A propyleneoxide dimole adduct and terephthalic acid, and modifying with isophorone diamine; (4) A mixture of (vi) polycondensation product of bisphenol A propyleneoxide dimole adduct and terephthalic acid, and (v) urea-modified polyester prepolymer which is obtained by reacting isophorone diisocyanate with polycondensation product of bisphenol A ethyleneoxide dimole adduct, bisphenol A propyleneoxide dimole adduct and terephthalic acid, and modifying with isophorone diamine; (5) A mixture of (iii) polycondensation product of bisphenol A ethyleneoxide dimole adduct and terephthalic acid, and (vii) urea-modified polyester prepolymer which is obtained by reacting isophorone diisocyanate with polycondensation product of bisphenol A ethyleneoxide dimole adduct and terephthalic acid, and modifying with hexamethylene diamine; (6) A mixture of (iv) polycondensation product of bisphenol A ethyleneoxide dimole adduct, a bisphenol A propyleneoxide dimole adduct and terephthalic acid, and (vii) urea-modified polyester prepolymer which is obtained by reacting isophorone diisocyanate with polycondensation product of bisphenol A ethyleneoxide dimole adduct and terephthalic acid, and modifying with hexamethylene diamine; (7) A mixture of (iii) polycondensation product of bisphenol A ethyleneoxide dimole adduct and terephthalic acid, and (viii) urea-modified polyester prepolymer which is obtained by reacting isophorone diisocyanate with polycondensation product of bisphenol A ethyleneoxide dimole adduct and terephthalic acid, and modifying with ethylene diamine; (8) A mixture of (i) polycondensation product of bisphenol A ethyleneoxide dimole adduct and isophthalic acid, and (ix) urea-modified polyester prepolymer which is obtained by reacting diphenylmethane diisocyanate with polycondensation product of bisphenol A ethyleneoxide dimole adduct and isophthalic acid, and modifying with hexamethylene diamine; (9) A mixture of (iv) polycondensation product of bisphenol A ethyleneoxide dimole adduct, bisphenol A propyleneoxide dimole adduct, terephthalic acid and dodecenylsuccinic anhydride, and (x) urea-modified polyester prepolymer which is obtained by reacting diphenylmethane diisocyanate with polycondensation product of bisphenol A ethyleneoxide dimole adduct, bisphenol A propyleneoxide dimole adduct, terephthalic acid and dodecenylsuccinic anhydride, and modifying with hexamethylene diamine; (10) A mixture of (i) polycondensation product of bisphenol A ethyleneoxide dimole adduct and isophthalic acid, and (xi) urea-modified polyester prepolymer which is obtained by reacting toluene diisocyanate with polycondensation product of bisphenol A ethyleneoxide dimole adduct and isophthalic acid, and modifying with hexamethylene diamine.

—Active Hydrogen Group-Containing Compound—

The active hydrogen group-containing compound functions as an elongation initiator or crosslinking agent at the time of elongation reactions or crosslinking reactions with the polymer reactive with aforesaid compounds in the aqueous medium.

The active hydrogen group-containing compounds are not particularly limited as long as containing active hydrogen group, and may be selected accordingly. For example, if a polymer reactive with the active hydrogen group-containing compounds is an isocyanate group-containing polyester prepolymer (A), from the viewpoint of ability to increase molecular mass by reactions such as elongation reaction, crosslinking reaction, or the like. with the isocyanate group-containing polyester prepolymer (A), amines (B) may be suitably used.

Active hydrogen groups are not particularly limited and may be selected accordingly. Examples include hydroxyl groups such as alcoholic hydroxyl group and phenolic hydroxyl group, amino groups, carboxyl groups, mercapto groups, and the like. These may be used alone or in combination. Of these, alcoholic hydroxyl group is especially preferable.

The amines (B) are not particularly limited and may be selected accordingly. Examples of amines (B) include diamine (B1), polyamine having 3 or more valence (B2), amino alcohol (B3), amino mercaptan (B4), amino acid (B5), block compound in which the amino group of (B1) to (B5) is blocked (B6), and the like.

These may be used alone or in combination. Of these, diamine (B1) and a mixture of diamine (B1) with a small amount of polyamine having 3 or more valence (B2) are especially preferable.

Examples of diamine (B1) include aromatic diamine, acyclic diamine and aliphatic diamine. Examples of aromatic diamine are phenylene diamine, diethyltoluene diamine, 4,4',-diminophenylmethane, and the like. Examples of alicyclic diamine are 4,4'-diamino-3,3'-dimethyldicycrohexylmethane, diamine cyclohexane, isophorone diamine, and the like. Examples of aliphatic diamine are ethylene diamine, tetramethylene diamine, hexamethylene diamine and the like.

Examples of polyamine having 3 or more valence (B2) include diethylene triamine, triethylene tetramine, and the like.

Examples of amino alcohol (B3) include ethanolamine, hydroxyethylaniline and the like.

Examples of amino mercaptan (B4) include aminoethylmercaptan, aminopropylmercaptan, and the like.

Examples of amino acid (B5) include amino propionic acid, amino capric acid, and the like.

Examples of block compound in which the amino group of (B1) to (B5) is blocked (B6) include ketimine compound, oxazoline compound, and the like obtained from amines of (B1) to (B5) and ketones such as acetone, methylethylketone, methylbutylketone and the like.

A reaction terminator may be used to stop elongation reaction, crosslinking reaction, or the like between active hydrogen group-containing compound and polymers reactive with the compound. It is preferable to use reaction terminator because it enables to control molecular mass of adhesive base material within a preferable range. Examples of reaction terminator include monoamine such as diethylamine, dibutylamine, butylamine, laurylamine, and the like, block compounds in which these monoamines are blocked such as ketimine compound, or the like.

The mixture ratio of amines (B) and the isocyanate group-containing prepolymer (A), in terms of mixture equivalent ratio of isocyanate group [NCO] in the isocyanate group-containing prepolymer (A) and amino group [NHx] in the amines (B), [NCO]/[NHx], is preferably from 1/3 to 3/1, more preferably from 1/2 to 2/1 and most preferably from 1/1.5 to 1.5/1.

When the mixture equivalent ratio [NCO]/[NHx] is less than 1/3, fixing ability at low temperature may deteriorate, and when it is more than 3/1, the molecular mass of urea-modified polyester becomes low, possibly imparing hot offset resistance.

—Polymer Reactive with Active Hydrogen Group-Containing Compound—

The polymer reactive with active hydrogen group-containing compound (hereinafter may be referred to as "prepolymer" is not particularly limited as long as it contains at least a reactive site with active hydrogen group-containing compound and may be selected from known resins, etc. accordingly. Examples of polymer reactive with active hydrogen group-containing compound include polyol resin, polyacryl resin, polyester resin, epoxy resin, derivative resins thereof and the like.

These may be used alone or in combination. Of these, from the view point of having high flowability and transparency in the fusing process, polyester resin is especially preferable.

A reactive site with active hydrogen group-containing compounds of the prepolymer is not particularly limited and may be selected from known substituents accordingly. Examples of substituents include isocyanate group, epoxy group, carboxylic acid, acid chloride group, and the like.

These may be used alone or in combination. Of these, isocyanate group is especially preferable.

Among prepolymers, polyester resin containing urea bond formation group (RMPE) is especially preferable, because it is easy to control the molecular mass of polymer elements and has oilless fixing ability at low temperature, as well as ability to sustain favorable releasing and fixing abilities even when it lacks releasing oil coating system for the heating medium for fixation.

Examples of urea bond formation group include isocyanate group, and the like. When the urea bond formation group of above-mentioned polyester resin containing urea bond formation group (RAPE) is an isocyanate group, isocyanate group-containing polyester prepolymer (A) is especially preferable as an polyester resin (RMPE).

The isocyanate group-containing polyester prepolymer (A) is not particularly limited and may be selected accordingly. Examples of isocyanate group-containing polyester prepolymer (A) include polycondensates of polyol (PO) and polycarboxylic acid (PC), provided that they are also reactants of active hydrogen group-containing polyester resin and polyisocyanate (PIC).

The polyol (PO) is not particularly limited and may be selected accordingly. Examples of polyol (PO) include diol (DIO), polyol having 3 or more valence (TO), a mixture of diol (DIO) and polyol having 3 or more valence (TO), and the like. These can be used alone or in combination. Of these, diol (DIO) alone, a mixture of diol (DIO) and a small amount of polyol having 3 or more valence (TO), or the like are preferable.

Examples of diol (DIO) include alkylene glycol, alkylene ether glycol, alicyclic diol, alkylene oxide adducts of alicyclic diol, bisphenols, alkylene oxide adducts of bisphenols, and the like.

The alkylene glycols of 2 to 12 carbon numbers are preferable and examples include ethylene glycol, 1,2-propylene glycol, 1,3-propylene glycol, 1,4-butanediol, and 1,6-hexanediol; alkylene ether glycols include diethylene glycol, triethylene glycol, dipropylene glycol, polyethylene glycol, polypropylene glycol, and polytetramethylene ether glycol; alicyclic diols such as 1,4-cyclohexane dimethanol and hydrogenated bisphenol A; alkylene oxide adducts of above-noted alicyclic diol such as ethylene oxide, propylene oxide, and butylene oxide; bisphenols such as bispheonol A, bisphenol F; and bisphenol S; and alkylene oxide adducts of the above-noted bisphenols such as ethylene oxide, propylene oxide, and butylene oxide.

Among them, alkylene glycol having carbon number 2 to 12 and alkylene oxide adducts of bisphenols are preferable, and alkylene oxide adducts of bisphenols and a combination of alkylene oxide adducts of bisphenols and alkylene glycol having carbon number 2 to 12 are particularly preferable.

The polyol having 3 or more valence (TO) is preferably having valency of 3 to 8, or more and examples thereof are polyaliphatic alcohol having 3 or more valence, polyphenols having 3 or more valence, alkylene oxide adducts of polyphenols having 3 or more valence, and the like.

Examples of polyol having 3 or more valence (TO) include polyaliphatic alcohol having 3 or more valence such as glycerine, trimethylol ethane, trimethylol propane, pentaerythritol, sorbitol, and the like. Examples of polyphenols having 3 or more valence include trisphenol PA, phenol novolac, cresol novolac, and like. The alkylene oxide adducts of above-mentioned polyphenols having 3 or more valence include ethylene oxide, propylene oxide, butylene oxide, and the like.

The mixing mass ratio, DIO:TO, of diol (DIO) and polyol having 3 or more valence (TO) is preferably 100:0.01 to 100:10 and more preferably 100:0.01 to 100:1.

Polycarboxilic acid (PC) is not particularly limited and may be selected accordingly. Examples of polycarboxilic acid include dicarboxylic acid (DIC), polycarboxilic acid having 3 or more valence (TC), a combination of dicarboxylic acid (DIC) and polycarboxilic acid having 3 or more valence, and the like.

These may be used alone or in combination. Of these, dicarboxylic acid (DIC) alone, or a combination of DIC and a small amount of polycarboxylic acid having 3 or more valence (TC) are preferable.

Examples of dicarboxylic acid include alkylene dicarboxylic acid, alkenylene dicarboxylic acid, aromatic dicarboxylic acid, and the like.

Examples of alkylene dicarboxylic acid include succinic acid, adipic acid, sebacic acid, and the like. Alkenylene dicarboxylic acid is preferably with carbon number 4 to 20 and examples thereof include maleic acid, fumar acid, and the like. Aromatic dicarboxylic acid is preferably with carbon number 8 to 20 and examples thereof include phthalic acid, isophthalic acid, terephthalic acid, naphthalendicarboxylic acid, and the like.

Of these, alkenylene dicarboxylic acid with carbon number 4 to 20 and aromatic dicarboxylic acid with carbon number 8 to 20 are preferable.

The valency number of polycarboxylic acid (TO) with 3 or more valence is preferably 3 to 8 or not less than the range and examples thereof include aromatic polycarboxylic acid, and the like.

Aromatic polycarboxylic acid is preferably with carbon number 9 to 20 and examples thereof include trimellitic acid, pyromellitic acid, and the like.

The polycarboxylic acid (PC) may be an acid anhydride or a lower alkyl ester of one selected from dicarboxylic acid (DIC), polycarboxylic acid having 3 or more valence and a combination of dicarboxylic acid (DIC) and polycarboxylic acid having 3 or more valence. Examples of lower alkyl ester include methyl ester, ethyl ester, isopropyl ester, and the like.

The mixing mass ratio, DIC:TC, of dicarboxylic acid (DIC) and polycarboxylic acid having 3 or more valence (TC) is not particularly limited and may be selected accordingly, and it is preferably 100:0.01 to 100:10 and more preferably 100:0.01 to 100:1.

A mixing ratio of polyol (PO) and polycarboxylic acid (PC) at the time of polycondensation reaction is not particularly limited and may be selected accordingly. For example, the equivalent ratio, [OH]/[COOH], of hydroxyl group [OH] of polyol (PO) and carboxyl group [COOH] of polycarboxilic acid (PC) in general is preferably 2/1 to 1/1 and more preferably 1.5/1 to 1/1 and most preferably 1.3/1 to 1.02/1.

The content of polyol (PO) in the isocyanate group-containing polyester prepolymer (A) is not particularly limited and may be adjusted accordingly, for example, it is preferably 0.5% by mass to 40% by mass, more preferably 1% by mass to 30% by mass and most preferably 2% by mass to 20% by mass.

If the content is less than 0.5% by mass, hot off-set resistance may be deteriorated, making it difficult to pursue anti-heat preservability and fixing property at low temperature at the same time. If the content is more than 40% by mass, fixing property at low temperature may be deteriorated.

The polyisocyanate (PIC) is not particularly limited and may be selected accordingly. Examples of polyisocyanate (PIC) include aliphatic polyisocyanate, alicyclic polyisocyanate, aromatic diisocyanate, aromatic aliphatic diisocyanate, isocyanurates, blocked-out ones thereof with phenol derivatives, oxime, capro lactam, and the like.

Examples of aliphatic polyisocyanate include tetramethylene diisocyanate, hexamethylene diisocyanate, 2,6-diisocyanate methyl caproate, octamethylene diisocyanate, decamethylene diisocyanate, dodecamethylene diisocyanate, tetradecamethylene diisocyanate, torimethylhexane diisocyanate, tetramethylhexane diisocyanate, and the like. Examples of alicyclic polyisocyanate include isophorone diisocyanate, cyclohexylmethane diisocyanate, and the like. Examples of aromatic diisocyanate include trilene diisocyanate, diphenylmethane diisocyanate, 1,5-naphtylene diisocyanate, diphenylene-4,4'-diisocyanate, 4,4'-diisocyanato-3,3'-dimethyldiphenyl, 3-methyldiphenylmethane-4,4'-diisocyanate, diphenylether-4,4'-diisocyanate, and the like. Examples of aromatic aliphatic diisocyanate include $\alpha,\alpha,\alpha',\alpha'$-tetramethylxylylene diisocyanate, and the like. Examples of isocyanurates include tris-iosyanatoalky-isocyanurate, tri-iocyanatocycloalkyl-isocyanurate, and the like.

These may be used alone or in combination.

Generally, the equivalent mixing ratio, [NCO]/[OH], of isocyanate group [NCO] of polyisocyanate (PIC) to hydroxyl group [OH] of active hydrogen group-containing polyester resin such as hydroxyl group-containing polyester resin at the time of reaction, is preferably 5/1 to 1/1, more preferably 4/1 to 1.2/1 and most preferably 3/1 to 1.5/1.

If the value of isocyanate group [NCO] is more than 5, fixing property at low temperature may be deteriorated, and if it is less than 1, off-set resistance may be deteriorated.

The content of polyisocyanate (PIC) in the isocyanate group-containing polyester prepolymer (A) is not particularly limited and may be adjusted accordingly. It is preferably 0.5% by mass to 40% by mass, more preferably 1% by mass to 30% by mass and most preferably 2% by mass to 20% by mass.

If the content is less than 0.5% by mass, hot off-set resistance may be deteriorated, making it difficult to pursue anti-heat preservability and fixing property at low temperature simultaneously and if it is more than 40% by mass, fixing property at low temperature may be deteriorated.

The average quantity of isocyanate group contained within one molecule of the isocyanate group-containing polyester prepolymer (A) is preferably 1 or more, more preferably 1.2 to 5 and most preferably 1.5 to 4.

If the average quantity of isocyanate group is less than 1, molecular mass of polyester resin (RMPE) modified with urea bond formation group becomes low and hot off-set resistance may be deteriorated.

The average molecular mass (Mw) of the polymer reactive with active hydrogen group-containing compound, in terms of molecular mass distribution by gel permeation chromatography (GPC) of tetrahydrofuran (THF) soluble component, is preferably 1,000 to 30,000 and more preferably 1,500 to 15,000. If the average molecular mass (Mw) is less than 1,000, anti-heat preservability may be deteriorated and if it is more than 30,000, fixing property at low temperature may be deteriorated.

The measurement of molecular mass distribution by gel permeation chromatography (GPC), for example, may be performed as follow.

First, the column inside the heat chamber of 40° C. is stabilized. At this temperature, tetrahydrofuran (THF) as a column solvent is drained at a current speed of 1 ml/minute and 50 μl to 200 μl of tetrahydrofuran sample fluid of the resin whereof a sample density is adjusted to 0.05% by mass to 0.6% by mass, is poured and measured. In the measurement of molecular mass of the sample, a molecular mass distribution of the sample is calculated from the relationship between log values of the analytical curve made from several monodisperse polystyrene standard samples and counted numbers. The standard polystyrene sample for making analytical curves is preferably the one with a molecular mass of $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$ by Pressure Chemical Co. or Tosoh Corporation and at least using approximately 10 pieces of the standard polystyrene sample is preferable. A refractive index (RI) detector may be used for above-mentioned detector.

—Binder Resin—

The binder resin is not particularly limited and may be selected accordingly. Examples thereof are polyester resin, and the like and unmodified polyester resin, that is a polyester resin not being modified, is especially preferable.

Containing unmodified polyester resin in a toner can improve fixing property at low temperature and glossiness.

Examples of unmodified polyester resin include the one similar to urea bond formation group-containing polyester resin such as polycondensation of polyol (PO) and polycarboxylic acid (PC), and the like. The unmodified polyester resin of which a part is compatible with the urea bond formation group-containing polyester resin (RMPE), that is, having similar structures that are compatible to each other, is preferable in terms of fixing property at low temperature and hot off-set resistance.

The average molecular mass (Mw) of unmodified polyester resin, in terms of the molecular mass distribution by GPC (Gel permeation chromatography) of tetrahydrofuran (THF) soluble component, is preferably 1,000 to 30,000 and more preferably 1,500 to 15,000. The content of the component of which the average molecular mass (Mw) is less than 1,000, should be 8% by mass to 28% by mass in order to prevent deterioration of anti-heat preservability. If the average molecular mass (Mw) is more than 30,000, fixing property at low temperature may be deteriorated.

The glass transition temperature of the unmodified polyester resin is generally 30° C. to 70° C., preferably 35° C. to 70° C., more preferably 35° C. to 50° C. and most preferably 35° C. to 45° C. If the glass transition temperature is less than 30° C., anti-heat preservability of the toner may be deteriorated and if it is more than 70° C., fixing property at low temperature may be insufficient.

The hydroxyl value of unmodified polyester resin is preferably 5 mgKOH/g or more, more preferably 10 mgKOH/g to 120 mgKOH/g and most preferably 20 mgKOH/g to 80 mgKOH/g. If the hydroxyl value is less than 5 mgKOH/g, it is difficult to pursue anti-heat preservability and fixing property at low temperature simultaneously.

The acid value of unmodified polyester resin is preferably 1.0 mgKOH/g to 50.0 mgKOH/g, more preferably 1.0 mgKOH/g to 45.0 mgKOH/g and most preferably 15.0 mgKOH/g to 45.0 mgKOH/g. In general a toner tends to become electrically negative by having acid values.

When unmodified polyester resin is contained in a toner, the mixing mass ratio, RMPE/PE, of urea bond formation group-containing polyester resin (RMPE) to unmodified polyester resin (PE) is preferably 5/95 to 25/75 and more preferably 10/90 to 25/75.

If the mixing mass ratio of unmodified polyester resin is more than 95, hot off-set resistance may be deteriorated, making it difficult to pursue anti-heat preservability and fixing property at low temperature simultaneously, and if it is less than 25, glossiness may be deteriorated.

The content of unmodified polyester resin in the binder resin, for example, is preferably 50% by mass to 100% by mass, more preferably 70% by mass to 95% by mass and most preferably 80% by mass to 90% by mass. If the content is less than 50% by mass, fixing property at low temperature or glossiness of the image may be deteriorated.

—Other Elements—

Other elements are not particularly limited and may be selected accordingly. Examples thereof include colorants, releasing agents, charge controlling agents, inorganic fine particles, flowability improvers, cleaning ability improvers, magnetic materials, metal soaps, and the like.

The colorants are not particularly limited and may be selected from known dyes and pigments accordingly. Examples thereof include carbon black, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, and lithopone, and the like.

These may be used alone or in combination.

The content of the colorant in the toner is not particularly limited and may be adjusted accordingly and it is preferably 1% by mass to 15% by mass and more preferably 3% by mass to 10% by mass.

It the content is less than 1% by mass, tinctorial power of the colorant is degraded, and if the content is more than 15% by mass, a dispersion failure of pigments in the toner may occur, resulting in degradation of tinctorial power or electric properties of the toner.

The colorant may be used as a master batch being combined with a resin. Such resin is not particularly limited and may be selected from known colorants accordingly. Examples thereof include polymers of styrene or substituted styrenes, styrene copolymers, polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyral, polyacrylic acid resin, rosin, modified rosin, terpene resins, aliphatic or alicyclic hydrocarbon resins, aromatic petroleum resins, chlorinated paraffin, paraffin, and the like. These may be used alone or in combination.

Examples of polymers of styrene or substituted styrenes include polyester resin, polystyrene, poly-p-chlorostyrene, polyvinyl toluene, and the like. Examples of styrene copolymers include styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic ester copolymer, and the like.

The master batch can be obtained by mixing and kneading a resin for master batch and the colorant with high shear force. To improve interaction between colorant and resin, an organic solvent may be used. In addition, the "flushing process" in which a wet cake containing colorant can be applied directly, is preferable because it requires no drying. In the flushing process, a water-based paste containing colorant and water is mixed and kneaded with the resin and an organic solvent so that the colorant moves towards the resin and that water and the organic solvent are removed. The materials are preferably mixed and kneaded using a triple roll mill and other high-shear dispersing devices.

The releasing agent is not particularly limited and may be selected from known agents accordingly and examples include waxes, and the like.

Examples of wax include carbonyl group-containing wax, polyolefin wax, long-chain hydrocarbon, and the like. These may be used alone or in combination. Of these examples, carbonyl group-containing wax is preferable.

Examples of carbonyl group-containing wax include polyalkanoic acid ester, polyalkanol ester, polyalkanoic acid amide, polyalkyl amide, dialkyl ketone, and the like. Examples of polyalkanoic ester include carnauba wax, montan wax, trimethylolpropane tribehenate, pentaerythritol tetrabehenate, pentaerythritol diacetate dibehenate, glycerin tribehenate, 1,18-octadecanediol distearate, and the like. Examples of polyalkanol ester include trimellitic tristearate, distearyl maleate, and the like. Examples of polyalkanoic acid amide include dibehenyl amide and the like. Examples of polyalkyl amide include trimellitic acid tristearyl amide, and the like. Examples of dialkyl ketone include distearyl ketone, and the like. Of these carbonyl group-containing waxes, the polyalkanoic acid ester is particularly preferable.

Examples of polyolefin wax include polyethylene wax, polypropylene wax, and the like.

Examples of long-chain hydrocarbon include paraffin wax, Sasol Wax, and the like.

A melting point of the releasing agent is not particularly limited and may be selected accordingly. It is preferably 40° C. to 160° C., more preferably 50° C. to 120° C., and most preferably 60° C. to 90° C.

When the melting point is less than 40° C., the wax may adversely affect anti-heat preservability. When the melting point is more than 160° C., it is liable to cause cold offset at the time of fixing at low temperatures.

A melt viscosity of the releasing agent is preferably 5 cps to 1,000 cps, and more preferably 10 cps to 100 cps by a measurement at a temperature of 20° C. higher than the melting point of the wax.

If the melt viscosity is less than 5 cps, releasing ability may be deteriorated. If the melt viscosity is more than 1,000 cps, on the other hand, it may not improve offset resistance, and fixing property at low temperature.

The content of releasing agent in the toner is not particularly limited and may be adjusted accordingly and it is preferably 0% by mass to 40% by mass and more preferably 3% by mass to 30% by mass.

If the content is more than 40% by mass, flowability of the toner may be deteriorated.

The charge controlling agent is not particularly limited, and may be selected from known agents accordingly. The charge controlling agent is preferably made of a material with color close to transparent and/or white because colored materials may change color tone. Examples of charge controlling agent include triphenylmethane dye, molybdic acid chelate pigment, rhodamine dye, alkoxy amine, quaternary ammonium salt such as fluoride-modified quaternary ammonium salt, alkylamide, phosphoric simple substance or compound thereof, tungsten simple substance or compound thereof, fluoride activator, salicylic acid metallic salt, salicylic acid derivative metallic salt, and the like. These may be used alone or in combination.

The charge controlling agent may be selected from the commercially available products. Specific examples thereof include Bontron P-51 of a quaternary ammonium salt, Bontron E-82 of an oxynaphthoic acid metal complex, Bontron E-84 of a salicylic acid metal complex and Bontron E-89 of a phenol condensate by Orient Chemical Industries, Ltd.; TP-302 and TP-415 of a quaternary ammonium salt molybdenum metal complex by Hodogaya Chemical Co.; Copy charge PSY VP2038 of a quaternary ammonium salt, Copy Blue PR of a triphenylmethane derivative and Copy charge NEG VP2036 and Copy charge NX VP434 of a quaternary ammonium salt by Hoechst Ltd.; LRA-901, and LR-147 of a boron metal complex by Japan Carlit is Co., Ltd.; quinacridone, azo pigment, and other high-molecular mass compounds having functional group of sulfonic acid, carboxyl, quaternary ammonium salt, or the like.

The charge controlling agent may be dissolved and/or dispersed in the toner material after melt kneading with the master batch. The charge controlling agent may also be added directly at the time of dissolving and dispersing in the organic solvent together with the toner material. In addition, the charge controlling agent may be added onto the surface of the toner particles after toner particle production.

The content of the charge controlling agent in the toner depends on the type of binder resin, presence or absence of external additives, and the dispersion process selected to use and there is no defined prescription. However, the content of charge controlling agent is preferably 0.1 part by mass to 10 parts by mass and more preferably 0.2 part by mass to 5 part by mass relative to 100 parts by mass of the binder resin, for example. When the content is less than 0.1 parts by mass, charge may not be appropriately controlled. If the content is more than 10 parts by mass, charge ability of the toner becomes excessively large, which lessens the effect of charge controlling agent itself and increases electrostatic attraction force with a developing roller, leading to developer flowability or image density degradation.

The inorganic fine particle is not particularly limited, and may be selected from known inorganic fine particles accordingly. Specific examples of inorganic fine particles include silica, alumina, titanium oxide, barium titanate, magnesium titanate, calcium titanate, strontium titanate, zinc oxide, tin oxide, quartz sand, clay, mica, silicic pyroclastic rock, diatomaceous earth, chromic oxide, cerium oxide, iron oxide red, antimony trioxide, magnesium oxide, zirconium oxide, barium sulfate, barium carbonate, calcium carbonate, silicon carbide and silicon nitride. Among them, silica and titanium dioxide are especially preferable.

The primary particle diameter of the inorganic fine particle is preferably 5 nm to 2 μm, more preferably 5 nm to 500 nm. The specific surface are of the inorganic fine particle by BET method is preferably 20 $m^2/g$ to 500 $m^2/g$.

The content of the inorganic fine particle in the toner is preferably 0.01% by mass to 5.0% by mass, more preferably 0.01% by mass to 2.0% by mass.

If these fluidizers are surface-treated to increase hydrophobicity, degradation of flowability or charging ability can be prevented even under a high humidified condition. Examples of suitable surface treatment agents include silane coupling agents, silyl agents, silane coupling agents having fluorinated alkyl group, organic titanate coupling agents, aluminium coupling agents, silicone oils and modified silicone oils.

Examples of cleaning ability improver for removing residual developer on the photoconductor or primary transferring medium after transferring process include fatty acid metal salts such as zinc stearate, calcium stearate, stearic acid, and the like; polymeric particles manufactured by soap-free emulsion polymerization or the like such as polymethylmethacrylate particles, polystyrene particles; and the like. The polymeric particles preferably have a relatively narrow particle size distribution, and a volume average particle diameter of 0.01 μm to 1 μm.

The magnetic material is not particularly limited, and may be selected from known inorganic fine particles accordingly. Examples thereof include iron powder, magnetite, ferrite, and the like. Among these, those with white color are preferable in terms of color tone.

—Resin Fine Particles—

Preferably, the resin fine particles for use in the toner according to the second aspect of the invention have a glass-transition temperature (Tg) of 50° C. to 70° C., and have an average molecular mass of 100,000 to 300,000.

When the glass-transition temperature is less than 50° C., blocking of toner deteriorates, and when the glass-transition temperature is more than 70° C., softening of toner particle at the time of fixing is prevented.

The resin fine particles adhere to uppermost surface of toner particle after emulsification, and thereby the toner particle has a toner structure which prevents blocking of a low softening polymer inside the particle. Resin fine particles may be spherical as 621 of FIG. 15, or may be irregular. In addition, the resin fine particles may form layer so as to coat the toner surface due to the influence of an organic solvent or subsequent processes for producing toner.

The resin fine particles according to the first and second aspects are not particularly limited as long as they are capable of forming an aqueous dispersion in an aqueous medium, and may be selected from known resins accordingly. The resin fine particles may be formed of thermoplastic resin or thermoset resin. Examples of resin fine particles include vinyl resin, polyurethane resin, epoxy resin, polyester resin, polyamide resin, polyimide resin, silicone resin, phenol resin, melamine resin, urea resin, aniline resin, ionomer resin, polycarbonate resin, and the like. Of these, vinyl resin is the most preferable.

These may be used alone or in combination. Among these examples, the resin fine particles formed of at least one selected from the vinyl resin, polyurethane resin, epoxy resin, and polyester resin by which an aqueous dispersion of fine spherical-shaped resin particles is easily obtained, are preferable.

The vinyl resin is a polymer in which vinyl monomer is mono- or co-polymerized. Examples of vinyl resin include styrene-(meth)acrylic acid ester resin, styrene-butadiene copolymer, (meth)acrylic acid-acrylic acid ester copolymer, styrene-acrylonitrile copolymer, styrene-maleic anhydride copolymer, styrene-(meth)acrylic acid copolymer, and the like.

Moreover, the resin fine particles may be formed of copolymer containing a monomer having at least two or more unsaturated groups.

The monomer having at least two or more unsaturated groups is not particularly limited and may be selected accordingly. Examples of such monomer include sodium salt of sulfuric acid ester of methacrylic acid ethylene oxide adduct (Eleminol RS-30 by Sanyo Chemical Industries Co.), divinylbenzene, 1,6-hexanediol acrylate, and the like.

The resin fine particles are formed by polymerization performed by the method appropriately selected from known methods. The resin fine particles are preferably obtained in a form of aqueous dispersion of the resin fine particles. Examples of preparation method of such aqueous dispersion include (1) a direct preparation method of aqueous dispersion of the resin fine particles in which, in the case of the vinyl resin, a vinyl monomer as a raw material is polymerized by suspension-polymerization method, emulsification-polymerization method, seed polymerization method or dispersion-polymerization method; (2) a preparation method of aqueous dispersion of the resin fine particles in which, in the case of the polyaddition and/or condensation resin such as polyester resin, polyurethane resin, or epoxy resin, a precursor (monomer, oligomer or the like) or solvent solution thereof is dispersed in an aqueous medium in the presence of a dispersing agent, and heated or added with a curing agent so as to be cured, thereby obtaining the aqueous dispersion of the resin fine particles; (3) a preparation method of aqueous dispersion of the resin fine particles in which, in the case of the polyaddition and/or condensation resin such as polyester resin, polyurethane resin, or epoxy resin, an arbitrary selected emulsifier is dissolved in a precursor (monomer, oligomer or the like) or solvent solution thereof (preferably being liquid, or being liquidized by heating), and then water is added so as to induce phase inversion emulsification, thereby obtaining the aqueous dispersion of the resin fine particles; (4) a preparation method of aqueous dispersion of the resin fine particles, in which a resin, previously prepared by polymerization method which may be any of addition polymerization, ring-opening polymerization, polyaddition, addition condensation, or condensation polymerization, is pulverized by means of a pulverizing mill such as mechanical rotation-type, jet-type or the like, and classified to obtain resin fine particles, and then the resin fine particles are dispersed in an aqueous medium in the presence of an arbitrary selected dispersing agent, thereby obtaining the aqueous dispersion of the resin fine particles; (5) a preparation method of aqueous dispersion of the resin fine particles, in which a resin, previously prepared by a polymerization method which may be any of addition polymerization, ring-opening polymerization, polyaddition, addition condensation or condensation polymerization, is dissolved in a solvent, the obtained resin solution is sprayed in the form of a mist to thereby obtain resin fine particles, and then the obtained resin fine particles are dispersed in an aqueous medium in the presence of an arbitrary selected dispersing agent, thereby obtaining the aqueous dispersion of the resin fine particles; (6) a preparation method of aqueous dispersion of the resin fine particles, in which a resin, previously prepared by a polymerization method, which may be any of addition polymerization, ring-opening polymerization, polyaddition, addition condensation or condensation polymerization, is dissolved in a solvent, the obtained resin solution is subjected to precipitation by adding a poor solvent or cooling after heating and dissolving, the solvent is sequentially removed to thereby obtain resin fine particles, and then the obtained resin fine particles are dispersed in an aqueous medium in the presence of an arbitrary selected dispersing agent, thereby obtaining the aqueous dispersion of the resin fine particles; (7) a preparation method of aqueous dispersion of the resin fine particles, in which a resin, previously prepared by a polymerization method, which may be any of addition polymerization, ring-opening polymerization, polyaddition, addition condensation or condensation polymerization, is dissolved in a solvent to thereby obtain a resin solution, the resin solution is dispersed in an aqueous medium in the presence of an arbitrary selected dispersing agent, and then the solvent is removed by heating or reduced pressure to thereby obtain the aqueous dispersion of the resin fine particles; (8) a preparation method of aqueous dispersion of the resin fine particles, in which a resin, previously prepared by a polymerization method, which is any of addition polymerization, ring-opening polymerization, polyaddition, addition condensation or condensation polymerization, is dissolved in a solvent to thereby obtain a resin solution, an arbitrary selected emulsifier is dissolved in the resin solution, and then water is added to the resin solution so as to induce phase inversion emulsification, thereby obtaining the aqueous dispersion of the resin fine particles.

Examples of toner according to one of the first and second aspects of the invention include a toner which is produced by known methods such as suspension-polymerization method, emulsion-aggregation method, emulsion-dispersion method, and the like. The toner is preferably produced by dissolving the toner material containing an active hydrogen group-containing compound and a polymer reactive with the compound in an organic solvent to prepare a toner solution, dispersing the toner solution in an aqueous medium so as to form a dispersion, allowing the active hydrogen group-containing compound and the polymer reactive with the compound to react so as to form an adhesive base material in the form of particles, and removing the organic solvent.

—Toner Solution—

The toner solution is prepared by dissolving the toner material in an organic solvent.

—Organic Solvent—

The organic solvent is not particularly limited and may be selected accordingly, provided that the organic solvent allows the toner material to be dissolved and/or dispersed therein. It is preferable that the organic solvent is a volatile organic solvent having a boiling point of less than 150° C. in terms of easy removal from the solution or dispersion. Suitable examples thereof are toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethylacetate, methyl ethyl ketone, methyl isobutyl ketone, and the like. Among these solvents, toluene, xylene, benzene, methylene chloride, 1,2-dichloroethane, chloroform, carbon tetrachloride are preferable and furthermore, ethyl acetate is more preferable. These solvents may be used alone or in combination.

The used amount of organic solvent is not limited and may be adjusted accordingly. It is preferably 40 parts by mass to 300 parts by mass, more preferably 60 parts by mass to 140 parts by mass and most preferably 80 parts by mass to 120 parts by mass with respect to 100 parts by mass of the toner material.

—Dispersion—

The dispersion is prepared by dispersing toner solution in an aqueous medium.

When the toner solution is dispersed in an aqueous medium, a dispersing element (oilspot) is formed in the aqueous medium.

—Aqueous Medium—

The aqueous medium is not particularly limited and may be selected from known mediums such as water, water-miscible solvent, and a combination thereof. Of these, water is particularly preferable.

The water-miscible solvent is not particularly limited, provided that it is miscible with water, and examples thereof include alcohol dimethylformamide, tetrahydrofuran, Cellsolves, lower ketones, and the like.

Examples of alcohol include methanol isopropanol ethylene grycol, and the like. Examples of lower ketones include acetone, methyl ethyl ketone, and the like.

These may be used alone or in combination.

It is preferable to disperse the toner solution in the aqueous medium while stirring.

The method for dispersion is not particularly limited and may be selected from known dispersers such as low-speed-shear disperser, high-speed-shear disperser, friction disperser, high-pressure-jet disperser, supersonic disperser, and the like. Of these, high-speed-shear disperser is preferable, because it is capable of controlling particle diameter of the dispersing element (oilspot) to be within a range of 2 μm to 20 μm.

When the high-speed shear disperser is used, conditions like rotating speed, dispersion time, dispersion temperature, and the like are not particularly limited and may be adjusted accordingly. However, rotating speed is preferably 1,000 rpm to 30,000 rpm and more preferably 5,000 rpm to 20,000 rpm. The dispersion time is preferably 0.1 minute to 5 minutes for batch method. The dispersion temperature is preferably 0° C. to 150° C. and more preferably 40° C. to 98° C. under pressure. Generally speaking, the dispersion is more easily carried out at a high dispersing temperature.

An exemplary manufacturing process of the toner according to the first and second aspects of the invention in which toner is manufactured by producing adhesive base material in a form of particles is described below.

In the process in which toner is manufactured by producing adhesive base material in a form of particles, a preparation of an aqueous medium phase, a preparation of toner solution, a preparation of dispersion, an addition of aqueous medium and other processes such as synthesis of active hydrogen group-containing compound and reactive prepolymer thereof or synthesis of active hydrogen group-containing compound, and the like, for example.

The preparation of aqueous medium phase may be, for example, done by dispersing resin fine particles in the aqueous medium. The amount of resin fine particles added to the aqueous medium is not limited and may be adjusted accordingly and it is preferably 0.5% by mass to 10% by mass, for example.

The preparation of toner solution may be done by dissolving and/or dispersing toner materials such as active hydrogen group-containing compound, reactive polymer thereof, colorant, releasing agent, charge controlling agent and unmodified polyester resin, and the like in the organic solvent.

These toner materials except reactive polymer (prepolymer) with active hydrogen group-containing compound may be added and blended in the aqueous medium when resin fine particles are being dispersed in the aqueous medium in the aqueous medium phase preparation, or they may be added into the aqueous medium phase together with toner solution when toner solution is being added into the aqueous medium phase.

The preparation of dispersion may be carried out by emulsifying and/or dispersing the previously prepared toner solution in the previously prepared aqueous medium phase. At the time of emulsifying and/or dispersing, the active hydrogen group-containing compound and the polymer reactive with the compound are subjected to elongation and/or crosslinking reaction, thereby forming the adhesive base material.

The adhesive base material (e.g. the aforementioned urea-modified polyester) is formed, for example, by (1) emulsifying and/or dispersing the toner solution containing the polymer reactive with the compound (e.g. isocyanate group-containing polyester prepolymer (A)) in the aqueous medium phase together with the active hydrogen group-containing compound (e.g. amines (B)) so as to form a dispersion, and then the active hydrogen group-containing compound and the polymer reactive with the compound are subjected to elongation and/or crosslinking reaction in the aqueous medium phase; (2) emulsifying and/or dispersing toner solution in the aqueous medium previously added with the active hydrogen group-containing compound to form a dispersion, and then the active hydrogen group-containing compound and the polymer reactive with the compound are subjected to elongation and/or crosslinking reaction in the aqueous medium phase; (3) after adding and mixing toner solution in the aqueous medium, the active hydrogen group-containing compound is sequentially added thereto so as to form a dispersion, and then the active hydrogen group-containing compound and the polymer reactive with the compound are subjected to elongation and/or crosslinking reaction at an interface of dispersed particles in the aqueous medium phase. In the process (3), it should be noted that modified polyester resin is preferentially formed on the surface of manufacturing toner particles, thus it is possible to generate concentration gradient in the toner particles.

Condition of reaction for forming adhesive base material by emulsifying and/or dispersing is not particularly limited and may be adjusted accordingly with a combination of active hydrogen group-containing compound and the polymer reactive with the compound. A suitable reaction time is preferably from 10 minutes to 40 hours and more preferably from 2 hours to 24 hours. A suitable reaction temperature is preferably from 0° C. to 150° C. and more preferably from 40° C. to 98° C.

A suitable formation of the dispersion containing the polymer reactive with active hydrogen group-containing compound (e.g. the isocyanate group-containing polyester prepolymer (A)) in the aqueous medium phase is, for example, a process in which the toner solution, produced from toner materials such as the polymer reactive with the active hydrogen group-containing compound (e.g. the isocyanate group-containing polyester prepolymer (A)), colorant, releasing agent, charge controlling agent, unmodified polyester, and the like that are dissolved and/or dispersed in the organic solvent, is added in the aqueous medium phase and dispersed by shear force. The detail of the dispersion process is as described above.

When preparing dispersion, a dispersing agent is preferably used in order to stabilize the dispersing element (oil droplets formed from toner solution) and sharpen the particle size distribution while obtaining a predetermined shape of the dispersing element.

The dispersing agent is not particularly limited and may be selected accordingly. Examples of dispersing agent include surfactant, water-insoluble inorganic dispersing agent, polymeric protective colloid, and the like. These may be used alone or in combination. Of these examples, surfactant is most preferable.

Examples of surfactant include anionic surfactant, cationic surfactant, nonionic surfactant, ampholytic surfactant, and the like.

Examples of anionic surfactant include alkylbenzene sulfonic acid salts, α-olefin sulfonic acid salts, phosphoric acid ester, and the like. Among these, an anionic surfactant having fluoroalkyl group is preferable. Examples of anionic surfactant having fluoroalkyl group include fluoroalkyl carboxylic acid having 2 to 10 carbon atoms or metal salt thereof, disodium perfluorooctanesulfonylglutamate, sodium-3-{omega-fluoroalkyl (Carbon number 6 toll)oxy}-1-alkyl (Carbon number 3 to 4) sulfonate, sodium-3-{omega-fluoroalkanoyl (Carbon number 6 to 8)-N-ethylamino}-1-propanesulfonate, fluoroalkyl(Carbon number 11 to 20) carboxylic acid or metal salt thereof perfluoroalkyl(Carbon number 7 to 13) carboxylic acid or metal salt thereof, perfluoroalkyl(Carbon number 4 to 12) sulfonic acid or metal salt thereof, perfluorooctanesulfonic acid diethanol amide, N-propyl-N-(2-hydroxyethyl) perfluorooctanesulfone amide, perfluoroalkyl (Carbon number 6 to 10) sulfoneamidepropyltrimethylammonium salt, perfluoroalkyl (Carbon number 6 to 10)-N-ethylsulfonyl glycin salt, monoperfluoroalkyl(Carbon number 6 to 16)ethylphosphate ester, and the like. Examples of commercially available surfactant containing fluoroalkyl group are: Surflon S-111, S-112 and S-113 by Asahi Glass Co.; Frorard FC-93, FC-95, FC-98 and FC-129 by Sumitomo 3M Ltd.; Unidyne DS-101 and DS-102 by Daikin Industries, Ltd.; Megafac F-110, F-120, F-113, F-191, F-812 and F-833 by Dainippon Ink and Chemicals, Inc.; ECTOP EF-102, 103, 104, 105, 112, 123A, 123B, 306A, 501, 201 and 204 by Tohchem Products Co.; Futargent F-100 and F150 by Neos Co.

Examples of cationic surfactant include amine salt surfactant, quaternary ammonium salt surfactant, and the like. Examples of amine salt surfactant include alkyl amine salt, aminoalcohol fatty acid derivative, polyamine fatty acid derivative, imidazoline, and the like. Examples of quaternary ammonium salt surfactant include alkyltrimethyl ammonium salt, dialkyldimethyl ammonium salt, alkyldimethyl benzyl ammonium salt, pyridinium salt, alkyl isoquinolinium salt, benzethoniumi chloride, and the like. Among these, preferable examples are primary, secondary or tertiary aliphatic amine acid having fluoroalkyl group, aliphatic quaternary ammonium salt such as perfluoroalkyl (Carbon number 6 to 10) sulfoneamidepropyltrimethylammonium salt, benzalkonium salt, benzetonium chloride, pyridinium salt, imidazolinium salt, and the like. Specific examples of commercially available product thereof are Surflon S-121 by Asahi Glass Co., Frorard FC-135 by Sumitomo 3M Ltd., Unidyne DS-202 by Daikin Industries, Ltd., Megafack F-150 and F-824 by Dainippon Ink and Chemicals, Inc., Ectop EF-132 by Tohchem Products Co., and Futargent F-300 by Neos Co.

Examples of nonionic surfactant include fatty acid amide derivative, polyhydric alcohol derivative, and the like.

Examples of ampholytic surfactant include alanine, dodecyldi(aminoethyl)glycin, di(octylaminoethyl)glycin, N-alkyl-N,N-dimethylammonium betaine, and the like.

Examples of water-insoluble inorganic dispersing agent include tricalcium phosphate, calcium carbonate, titanium oxide, colloidal silica, hydroxyl apatite, and the like.

Examples of polymeric protective colloid are acids, (meta) acrylic monomers having hydroxyl group, vinyl alcohol or esters thereof, esters of vinyl alcohol and compound having carboxyl group, amide compounds or methylol compounds thereof, chlorides, monopolymers or copolymers having nitrogen atom or heterocyclic rings thereof, polyoxyethylenes, celluloses, and the like.

Examples of acids include acrylic acid, methacrylic acid, α-cyanoacrylic acid, α-cyanomethacrylic acid, itaconic acid, crotonic acid, fumaric acid, maleic acid, maleic anhydride, and the like.

Examples of (meta) acrylic monomers having hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycol monoacrylic ester, diethyleneglycol monomethacrylic ester, glycerin monoacrylic ester, glycerin monomethacrylic ester, N-methylol acrylamido, N-methylol methacrylamide, and the like.

Examples of vinyl alcohol or ethers of vinyl alcohol include vinyl methyl ether, vinyl ethyl ether, vinyl propyl ether, and the like.

Examples of ethers of vinyl alcohol and compound having carboxyl group include vinyl acetate, vinyl propionate, vinyl butyrate, and the like.

Examples of amide compound or methylol compound thereof include acryl amide, methacryl amide, diacetone acrylic amide acid, or methylol thereof, and the like.

Examples of chlorides include acrylic chloride, methacrylic chloride, and the like.

Examples of monopolymers or copolymers having nitrogen atom or heterocyclic rings thereof include vinyl pyridine, vinyl pyrrolidone, vinyl imidazole, ethylene imine, and the like.

Examples of polyoxyethylenes include polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenyl ester, polyoxyethylene nonylphenyl ester, and the like.

Examples of celluloses include methyl cellulose, hydroxyethyl cellulose, hydroxypropyl cellulose, and the like.

In the preparation of dispersion, a dispersing stabilizer may be employed as necessary. The dispersing stabilizer is, for example, acid-soluble or alkali-soluble compound such as calcium phosphate, and the like.

When dispersing stabilizer is employed, the dispersing stabilizer is dissolved by acid such as hydrochloric acid, and then washed with water or decomposed by enzyme, etc. to be removed from particles.

In the preparation of dispersion, a catalyst for the elongation and/or crosslinking reaction may be employed as necessary. The catalyst is, for example, dibutyltin laurate, dioctyltin laurate, and the like.

The organic solvent is removed from the obtained dispersion (emulsified slurry). The removal of organic solvent is carried out, for example, by the following methods: (1) the temperature of the dispersion is gradually increased, and the organic solvent in the oil droplets is completely evaporated and removed; (2) emulsified dispersion is sprayed in a dry atmosphere and the water-insoluble organic solvent is completely evaporated and removed from the oil droplets to form toner particles, while aqueous dispersing agent is evaporated and removed simultaneously.

The circularity of the toner can be controlled by the strength of liquid stirring before this removal of organic solvent and the time for removing the solvent. When the removal of the solvent is slowly performed, the shape becomes near to perfect sphere and the circularity increases to 0.980 or more. When the stirring is performed vigorously and the removal of the solvent is performed within a short period of time, the shape becomes uneven or irregular and the circularity decreases to 0.900 to 0.960. When the emulsified liquid, obtained after emulsification and dispersion in an aqueous medium, and further by being subjected to an extension reaction, is stirred with a strong stirring force at a temperature of 30° C. to 50° C. in a stirring tank during removal of the solvent, it is possible to control the circularity in a range of 0.850 to 0.990. This is considered to be attained by occurrence of volume shrinkage during formation of particles due to abrupt removal of ethyl acetate contained therein, and the shape can be controlled by stirring force and time. The time for removing the solvent is within one hour. If the time is one hour or more, pigment begins to aggregate, leading to the reduction of volume specific resistance.

The emulsified dispersion is sprayed in a dry atmosphere and the water-insoluble organic solvent is completely evaporated and removed from the oil droplets to form toner particles, and simultaneously, aqueous dispersing agent can also be evaporated and removed. Generally, the dry atmosphere into which the dispersion is sprayed may be a heated gas, such as air, nitrogen, carbon dioxide or combustion gas, particularly, a gas flow heated above the boiling point of the solvent having the highest boiling point of the solvents used. A short-time treatment with a spray drier, a belt drier or a rotary kiln can provide toner particles with intended quality.

When the particle size distribution during emulsification and dispersion is wide and washing and dry treatment is carried out keeping the particle size distribution, the particle size distribution can be adjusted by classifying into desired particle size distribution.

Once organic solvent is removed, toner particles are formed. The toner particles are then preceded with washing, drying, and the like. And then toner particles may be classified as necessary. The classification is, for example, carried out by cyclone, decanter, or centrifugal separation thereby removing particles in the solution. Alternatively, the classification may be carried out after toner particles are obtained as powder by drying.

The obtained toner particles are subjected to mixing with particles such as colorant, releasing agent, charge controlling agent, etc., and mechanical impact, thereby preventing particles such as releasing agent failing off from the surface of the toner particles.

Examples of the method for imparting mechanical impact include a method in which an impact is imparted by rotating a blade at high speed, and a method in which an impact is imparted by introducing the mixed particles into a high-speed flow and accelerating the speed of the flow so as to make the particles to clash with each other or to make the composite particles to clash with an impact board. Examples of device employed for such method are angmill by Hosokawa Micron Corporation, modified I-type mill by Nippon Pneumatic Mfg. Co., Ltd. to decrease crushing air pressure, hybridization system by Nara Machinery Co., Ltd., kryptron system by Kawasaki Heavy Industries, Ltd., automatic mortar, and the like.

The coloration of the toner according to one of the first and second aspects of the invention is not particularly limited and may be selected accordingly. For example, the coloration is at least one selected from black toner, cyan toner, magenta toner and yellow toner. Each color toner is obtained by appropriately selecting the colorant to be contained therein. It is preferably a color toner.

(Developer)

The developer of the invention at least contains the toner according to one of the first and second aspects of the invention and further contains other appropriately selected components such as the aforementioned carrier. The developer can be either one-component developer or two-component developer. However, the two-component developer is preferable in terms of improved life span when the developer is used, for example, in a high-speed printer that corresponds to the improvement of recent information processing speed.

The one-component developer using the toner of the invention exhibits less fluctuation in the toner particle diameter after toner inflow/outflow, and the toner filming to the developing roller or the fusion of toner onto the members such as blades for reducing toner layer thickness are absent, therefore providing excellent and stable developing property and images over long-term use (stirring) of the developing unit. The two-component developer using toner of the invention exhibits less fluctuation in the toner particle diameter after toner inflow/outflow for prolonged periods, and the excellent and stable developing property can be obtained after stirring in a developing unit for prolonged periods.

The carrier is not particularly limited and may be selected accordingly. It is preferably the one having a core material and a resin layer coating the core material.

The core material is not particularly limited and may be selected from known materials. For example, 50 emu/g to 90 emu/g of manganese, strontium (Mn, Sr) materials, manganese, magnesium (Mn, Mg) materials, and the like are preferred. Highly magnetizable materials such as iron powder (100 emu/g or more), magnetite (75 emu/g to 120 emu/g), and the like are preferred in terms of ensuring appropriate image density. Weak magnetizable materials such as copper-zinc (Cu—Zn) materials (30 emu/g to 80 emu/g) are preferred in terms of reducing the impact on photoconductor where toner is forming a magnetic brush, therefore advantageous for improving image quality. These may be used alone or in combination.

The average particle diameter (volume average particle diameter ($D_{50}$)) of the core material is preferably 10 μm to 200 μm and more preferably 40 μm to 100 μm.

When the average particle diameter (volume average particle diameter ($D_{50}$)) is less than 10 μm, the amount of fine powder in the carrier particle size distribution increases whereas magnetization per particle decreases resulting in the carrier scattering. When the average particle diameter is more than 150 μm, toner scattering may be caused due to the decrease of specific surface area. Therefore, for a full-color image having many solid parts, reproduction of the solid parts in particular may be insufficient.

The resin material is not particularly limited and may be selected from known resins accordingly. Examples of resin material include amino resin, polyvinyl resin, polystyrene resin, halogenated olefin resin, polyester resin, polycarbonate resin, polyethylene resin, polyvinyl fluoride resin, polyvinylidene fluoride resin, polytrifluoroethylene resin, polyhexafluoropropylene resin, copolymers of vinylidene fluoride and acryl monomer, copolymers of vinylidene fluoride and vinyl fluoride, fluoroterpolymer such as terpolymer of tetrafluoroethylene, vinylidene fluoride and non-fluoride monomer, silicone resin, and the like. These may be used alone or in combination.

Examples of amino resin include urea-formaldehyde resin, melamine resin, benzoguanamine resin, urea resin, polyamide resin, epoxy resin, and the like. Examples of polyvinyl resin include acryl resin, polymethylmetacrylate resin, polyacrylonitrile resin, polyvinyl acetate resin, polyvinyl alcohol resin, polyvinyl butyral resin, and the like. Examples of polystyrene resin include polystyrene resin, styrene acryl copolymer resin, and the like. Examples of halogenated olefin resin include polyvinyl chloride, and the like. Examples of polyester resin include polyethyleneterephtalate resin and polybutyleneterephtalate resin, and the like.

The resin layer may contain, for example, conductive powder, etc. as necessary. Examples of conductive powder include metal powder, carbon black, titanium oxide, tin oxide, zinc oxide, and the like. The average particle diameter of conductive powder is preferably 1 μm or less. When the average particle diameter is more than 1 μm, controlling electrical resistance may be difficult.

The resin layer may be formed by, for example, dissolving silicone resin, etc. in a solvent to prepare a coating solution, uniformly applying the coating solution to the surface of core material by known method, drying, and baking. Examples of application method include immersion, spray, and brushing, etc.

The solvent is not particularly limited and may be selected accordingly. Examples of solvent include toluene, xylene, methyethylketone, methylisobutylketone, cerusolbutylacetate, and the like.

The baking is not particularly limited and may be done by external heating or internal heating. Examples of baking method include the one using fixed electric furnace, flowing electric furnace, rotary electric furnace, burner or microwave.

The content of resin layer in the carrier is preferably 0.01% by mass to 5.0% by mass. When it is less than 0.01% by mass, the resin layer may not be formed uniformly on the surface of the core material. When it is more than 5.0% by mass, the resin layer may become excessively thick causing granulation between carriers, and the uniform carrier particles may not be obtained.

When developer is a two-component developer, the content of the carrier in the two-component developer is not particularly limited and may be selected accordingly. For example, the content is preferably 90% by mass to 98% by mass and more preferably 93% by mass to 97% by mass.

The mixing ratio of toner to carrier of the two-component developer is 1 part by mass to 10.0 parts by mass of toner relative to 100 parts by mass of carrier, in general.

The developer of the invention contains the toner according to one of the first and second aspects of the invention and has excellent offset resistance and anti-heat preservability, therefore it is capable of forming excellent, clear and high-quality images constantly.

The developer of the invention may be suitably used in forming images by various electrophotographic methods known such as magnetic one-component developing, non-magnetic one-component developing, two-component developing, and the like. In particular, the developer of the invention may be suitably used in the toner container, process cartridge, image forming apparatus, and image forming method of the invention as described below.

(Toner Container)

The toner container of the invention comprises a container; and the toner according to one of the first and second aspects of the invention and/or the developer of the invention contained therein.

The container is not particularly limited and may be selected from known containers. Preferable examples of the container include one having a toner container body and a cap.

The toner container body is not particularly limited in size, shape, structure or material and may be selected accordingly. The shape is preferably a cylinder. It is particularly preferable that a spiral ridge is formed on the inner surface and the contained toner is movable toward discharging end when rotated and the spiral part, whether partly or entirely, serves as bellows.

The material of the toner container body is not particularly limited and preferably being dimensionally accurate. For example, resins are preferable. Among resins, polyester resin, polyethylene resin, polypropylene resin, polystyrene resin, polyvinyl chloride resin, polyacrylic acid, polycarbonate resin, ABS resin, polyacetal resin, and the like are preferable.

The toner container of the invention is easy to preserve and ship and is handy. It is suitably used by being detachably mounted on the process cartridge, image forming apparatus, and the like which are described later, for supplying toner.

(Process Cartridge)

The process cartridge of the invention at least comprises a latent electrostatic image bearing member for bearing a latent electrostatic image and a developing unit for developing the latent electrostatic image on the latent electrostatic image bearing member using developer and further comprises charging unit, exposing unit, developing unit, transferring unit, cleaning unit, discharging unit and other units selected accordingly.

The developing unit at least contains a developer container for storing the toner and/or developer of the invention and a developer carrier for carrying and transferring the toner and/or developer stored in the developer container and may further contain a layer thickness control member for controlling the thickness of carried toner layer.

The process cartridge of the invention may be detachably mounted on a variety of electrophotographic apparatuses, facsimile and printers and is preferably detachably mounted on the electrophotographic apparatus of the invention, which is described later.

The process cartridge comprises, for example as shown in FIG. 1, photoconductor 102, charging unit 103, developing unit 104, and cleaning unit 105 and, 101 represents an entire process cartridge.

In this process cartridge, plural constituent elements, among constituent elements such as a photoconductor, developing unit, charging unit, cleaning unit, etc., may be constructed as the process cartridge and this process cartridge is placed onto the main body of image forming apparatus such as a copier and printer as detachable.

In the image forming apparatus comprising the process cartridge of the invention, the photoconductor is rotationally driven at a predetermined circumferential speed. The photoconductor receives uniform charge of positive or negative predetermined potential from a charging unit in the roating process, then is exposed to image exposure light from an image exposing unit such as a slit exposure and laser beam, and thus latent electrostatic images are sequentially formed on the surface of the photoconductor. Thus formed latent electrostatic images are developed by toner with a developing unit, developed toner images are sequentially transferred on a transfer material by a transferring unit, which is fed from a paper-feeding part between the photoconductor and a transferring unit so as to match the rotation of the photoconductor. The transfer material having transferred images is separated from the surface of the photoconductor, introduced to an image fixing unit, and images are fixed, and printed out as a copy to the outside of the apparatus. The surface of the photoconductor after image transfer is cleaned as a result of removal of residue toner remaining after transfer, further discharged, and then is used for image forming repeatedly.

(Image Forming Apparatus and Image Forming Method)

The image forming apparatus of the invention contains photoconductor, latent electrostatic image forming unit, developing unit, transferring unit, fixing unit and other units such as discharging unit, cleaning unit, recycling unit and control unit as necessary.

The image forming method of the invention include latent electrostatic image forming, developing, transferring, fixing and other steps such as discharging, cleaning, recycling, controlling, etc. as necessary.

The image forming method of the invention may be favorably implemented by the image forming apparatus of the invention. The latent electrostatic image forming may be performed by the latent electrostatic image forming unit, the developing may be performed by the developing unit, the transferring may be performed by the transferring unit, and the fixing may be performed by the fixing unit. And other steps may be performed by other units respectively.

—Latent Electrostatic Image Forming and Latent Electrostatic Image Forming Unit—

The latent electrostatic image forming is a step that forms a latent electrostatic image on the photoconductor.

Materials, shapes, structures or sizes, etc. of the latent electrostatic image bearing member (may be referred to as "photoconductive insulator", "photoconductor") are not limited and may be selected accordingly and it is preferably drum-shaped. The materials thereof are, for example, inorganic photoconductors such as amorphous silicon, selenium; organic photoconductors such as polysilane, phthalopolymethine, and the like. Of these examples, amorphous silicon is preferred for its longer operating life.

For the amorphous silicon photoconductor, a photoconductor, (hereafter may be referred to as "a-Si series photoconductor") having a photo-conductive layer made of a-Si that is formed on the support by coating method such as vacuum deposition, sputtering, ion-plating, thermo-CVD, photo-CVD, plasma-CVD, and the like, while support is being heated at 50° C. to 400° C., may be used. Of these coating methods, plasma-CVD, whereby a-Si cumulo-layer is formed on the support by decomposition of the material gas by direct current, high-frequency wave or microwave glow discharge, is preferable.

Examples of the layer structure of the amorphous silicon photoconductor are as follows. FIGS. 7 through 10 are schematic diagrams for explaining the layer structure of the photoconductor.

Figure 7:
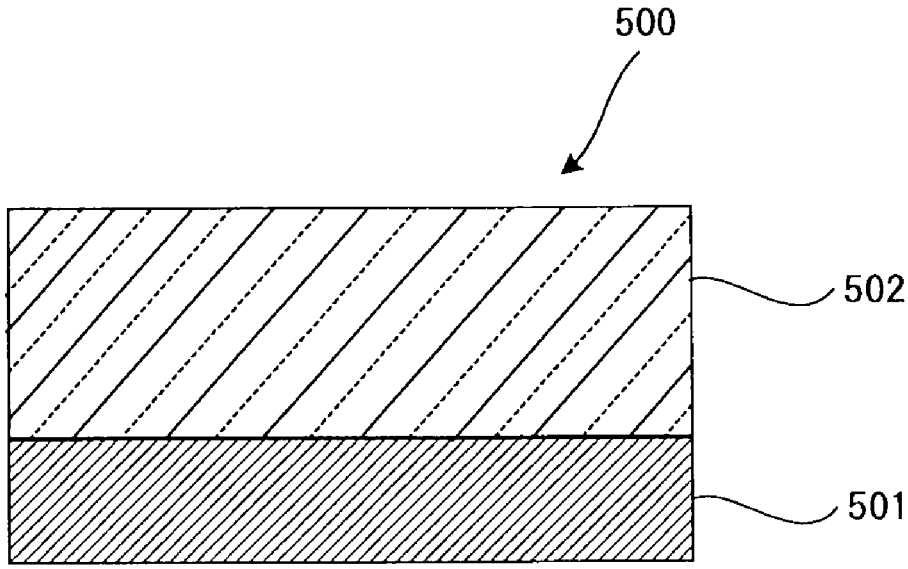
FIG. 7 is a schematic view showing an example of the structure of the photoconductor of the invention.

With reference to FIG. 7, a photoconductor for electrophotography 500 comprises a support 501 and a photoconductive layer 502 thereon. The photoconductive layer 502 is formed of a-Si:H, X, and exhibits photoconductivity.

Figure 8:
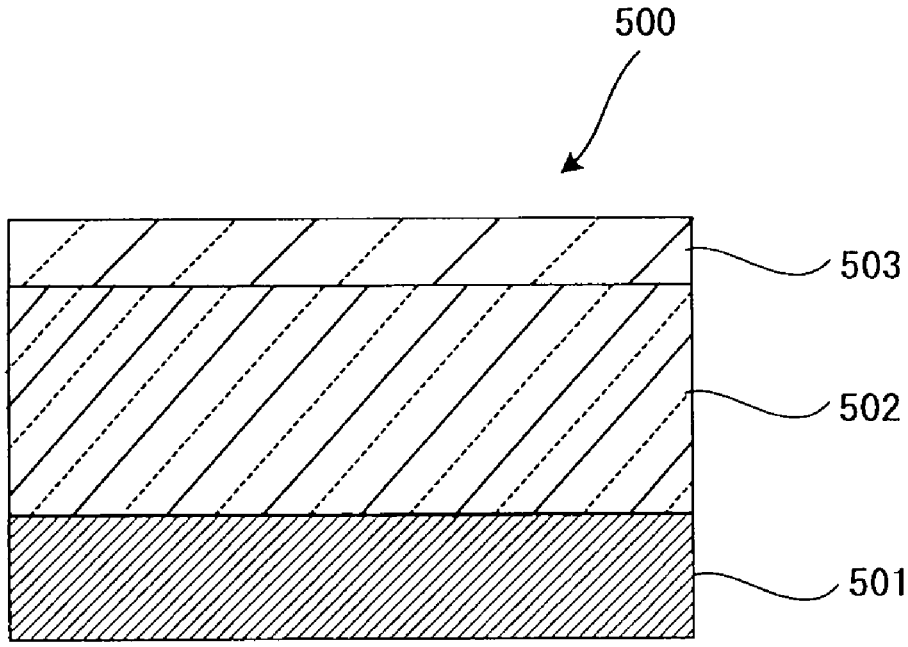
FIG. 8 is a schematic view showing another example of the structure of the photoconductor of the invention.

With reference to FIG. 8, a photoconductor for electrophotography 500 comprises a support 501, a photoconductive layer 502 and an amorphous silicon surface layer 503 arranged on the support 501. The photoconductive layer 502 is formed of a-Si:H, X, and exhibits photoconductivity.

Figure 9:
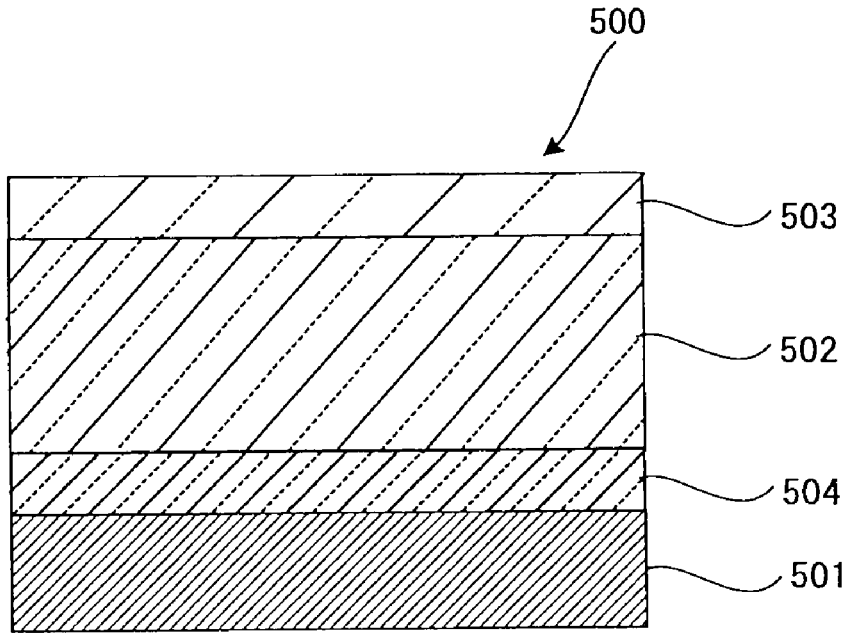
FIG. 9 is a schematic view showing another example of the structure of the photoconductor of the invention.

With reference to FIG. 9, a photoconductor for electrophotography 500 comprises a support 501, and on the support 501, a photoconductive layer 502, an amorphous silicon surface layer 503 and an amorphous silicon charge injection inhibiting layer 504. The photoconductive layer 502 is formed of a-Si:H, X, and exhibits photoconductivity.

Figure 10:
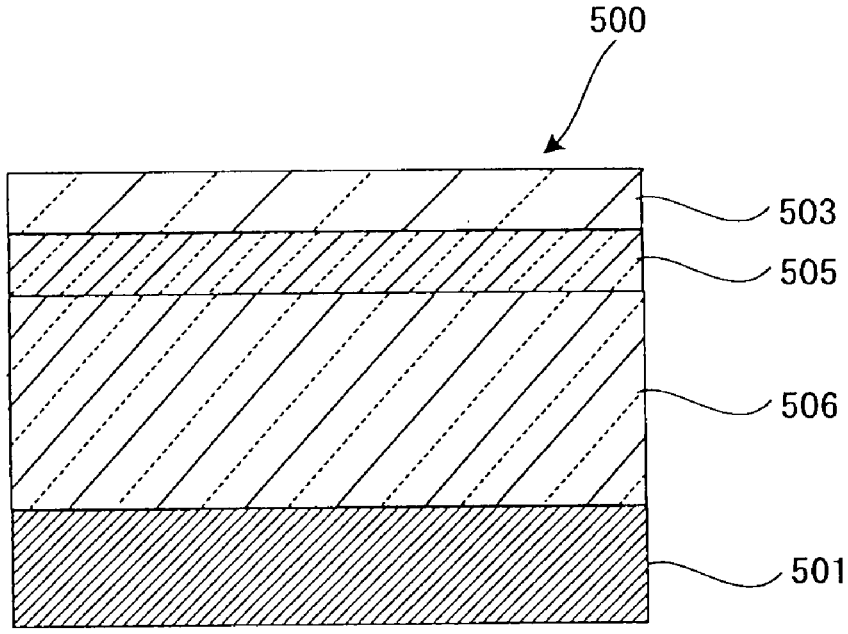
FIG. 10 is a schematic view showing another example of the structure of the photoconductor of the invention.

With reference to FIG. 10, a photoconductor for electrophotography 500 comprises a support 501 and a photoconductive layer 502 thereon. The photoconductive layer 502 includes a charge generating layer 505 formed of a-Si:H, X and a charge transport layer 506. An amorphous silicon surface layer 503 is arranged on the photoconductive layer 502.

The support of the photoconductor may be conductive or electrically insulating. Examples of the conductive support include metals such as Al, Cr, Mo, Au, In, Nb, Te, V, Ti, Pt, Pd, and Fe, or alloys thereof e.g. stainless steel. The support may also be an electrically insulating support of a film or sheet of synthetic resin such as polyester, polyethylene, polycarbonate, cellulose acetate, polypropylene, polyvinyl chloride, polystyrene, and polyamide, or of glass, ceramic, or the like, wherein at least a surface on the photosensitive layer formed side of the electrically insulating support is treated to have conductivity.

The shape of the support may be a cylinder, plate, or endless belt having a smooth or uneven surface, its thickness may be determined appropriately so that a desired photoconductor for image forming apparatus can be formed; however, when bendability as a photoconductor for image forming apparatus is required, the thickness can be made as thin as possible as the function of the support can be well exhibited. However, the support is normally required to be 10 μm or more in thickness from the points of production and handling, mechanical strength, etc.

In the amorphous photoconductor, it is effective to dispose a charge injection inhibiting layer between the conductive support and the photoconductive layer according to necessity (See, FIG. 9). The charge injection inhibiting layer inhibits a charge injection from the conductive support. The charge injection inhibiting layer has a dependency on the polarity. Specifically, when charges of a certain polarity are applied to a free surface of the photoconductor, the charge injection inhibiting layer inhibits a charge from being injected into the photosensitive layer from the support. However, the charge injection inhibiting layer does not when charges of the opposite polarity are applied, i.e., the charge injection inhibiting layer has a dependency on the polarity. In order to attain such function, the charge injection inhibiting layer contains relatively larger amounts of atoms controlling conductivity, compared with the photoconductive layer.

The thickness of the charge injection inhibiting layer is preferably 0.1 μm to 5 μm, more preferably 0.3 μm to 4 μm, and most preferably 0.5 μm to 3 μm for desired electrophotographic properties and better economical efficiency.

The photoconductive layer may be disposed on an undercoat layer according to necessity. The thickness of the photoconductive layer 502 is determined appropriately as desired in terms of electrophotographic properties and better economical efficiency. The thickness is preferably 1 μm to 100 μm, more preferably 20 μm to 50 μm, and most preferably 23 μm to 45 μm.

When the photoconductive layer is constructed with plural layers to separate its function, the charge transport layer mainly serves as a layer to transport charge. The charge transport layer comprises at least a silicon atom, carbon atom, and fluorine atom as its essential components, and optionally comprises a hydrogen atom and oxygen atom so that the charge transport layer is formed of a-SiC(H,F,O). Such charge transport layer exhibits desirable photoconductivity, especially charge holding property, charge generating property, and charge transporting property. In the invention, it is particularly preferable that the charge transport layer comprises an oxygen atom.

The thickness of the charge transport layer is determined appropriately as desired in terms of electrophotographic properties and better economical efficiency. The thickness thereof is preferably 5 μm to 50 μm, more preferably 10 μm to 40 μm, and most preferably 20 μm to 30 μm.

When the photoconductive layer is constructed with plural layers to separate its function, the charge generating layer mainly serves as a layer to generate charge. The charge generating layer comprises at least a silicon atom as its essential component does not substantially comprise a carbon atom, and optionally comprises a hydrogen atom so that the charge generating layer is formed of a-Si:H. Such charge generating layer exhibits desirable photoconductivity, especially charge generating property and charge transporting property.

The thickness of the charge generating layer is determined appropriately as desired in terms of electrophotographic properties and better economical efficiency. The thickness thereof is preferably 0.5 μm to 15 μm, more preferably 1 μm to 10 μm, and most preferably 1 μm to 5 μm.

The amorphous silicon photoconductor may further comprise a surface layer disposed on the photoconductive layer on the support as mentioned above according to necessity. The surface layer is preferably an amorphous silicon layer. The surface layer has a free surface and is disposed to attain an object of the invention mainly in moisture resistance, usability in continuous repeated use, electric strength, stability in operating environment, and durability.

In general, the thickness of the surface layer is preferably 0.01 μm to 3 μm, more preferably 0.05 μm to 2 μm, and most preferably 0.1 μm to 1 μm. If the thickness is less than about 0.01 μm, the surface layer may be lost during the use of the photoconductor due to abrasion. If it is more than 3 μm, electrophotographic properties may be impaired such as an increase of residual potential.

The amorphous silicon photoconductor has a high surface hardness and high sensitivity with light with long wavelength, such as semiconductor laser light (770 nm to 800 nm). In addition, little deterioration is observed after repeated use, and thus the amorphous silicon photoconductor is used as a photoconductor for electrophotography, for example, in a high-speed copier or a laser beam printer (LBP).

The latent electrostatic image may be formed, for example, by uniformly charging the surface of photoconductor, and exposing it imagewise, and this may be performed by the latent electrostatic image forming unit.

The latent electrostatic image forming unit, for example, contains a charger which uniformly charges the surface of latent electrostatic image bearing member, and an irradiator which exposes the surface of latent electrostatic image bearing member imagewise.

Charging may be performed, for example, by applying a voltage to the surface of latent electrostatic image bearing member using the charger.

The charger is not limited and may be selected accordingly. Examples of charger include known contact chargers equipped with conductive or semi-conductive roller, brush, film or rubber blade and non-contact chargers using corona discharges such as corotron or scorotron, etc.

Figure 6:
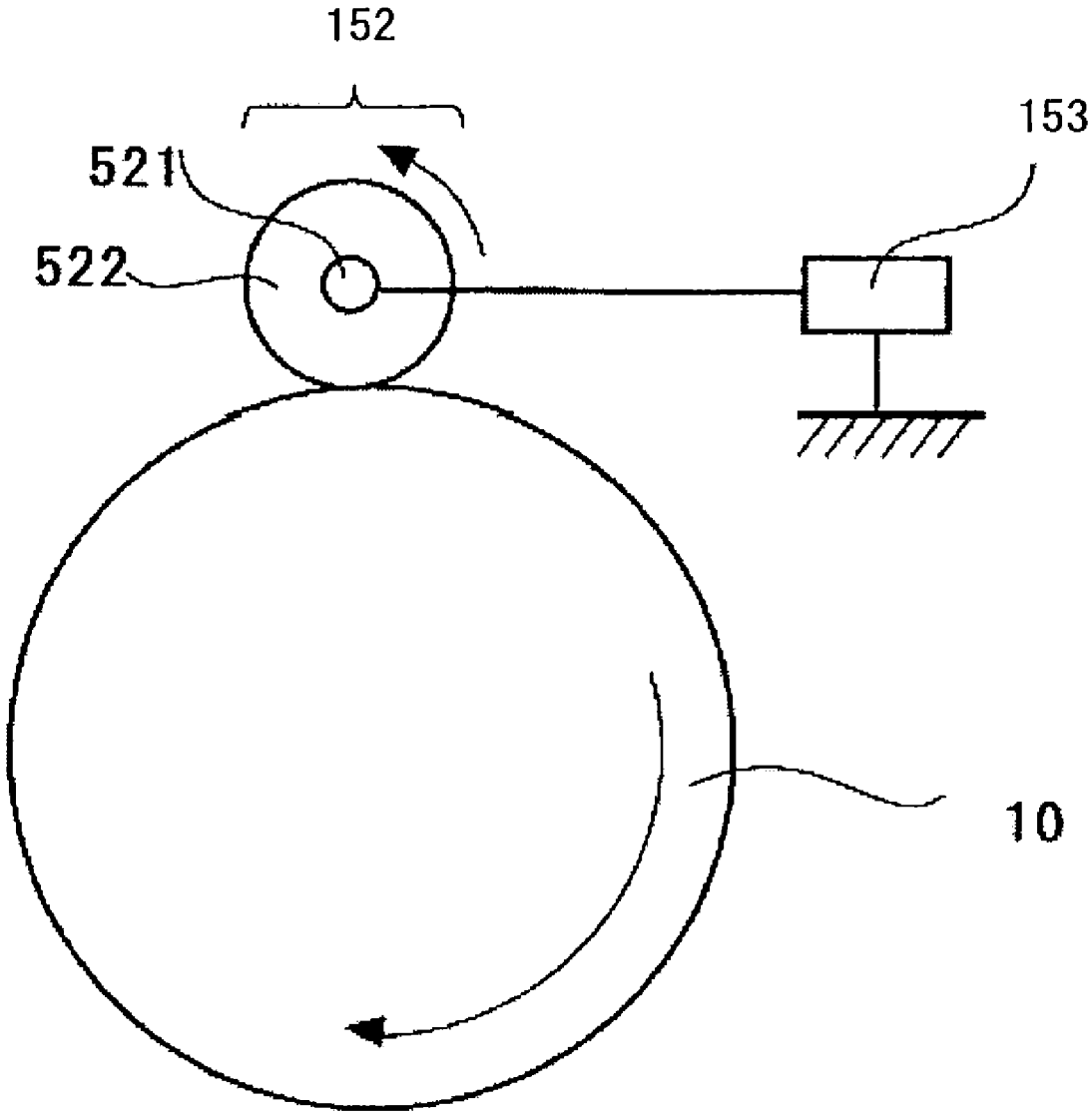
FIG. 6 is a schematic diagram showing an example of the roller type contact charger.

Here, FIG. 6 shows a schematic configuration of an example of the image forming apparatus using a contact charger. A photoconductor 10 as a member to be charged or image bearing member, is rotationally driven in the arrow direction at a predetermined speed (process speed). A charging roller 152 as a charging member is brought into contact with this photosensitive drum 10 and comprises, as a basic configuration, a cored bar 521 and a conductive rubber layer 522 formed on the outside circumferential surface of this cored bar in the form of roller concentrically. The both terminals of the cored bar are supported with e.g. bearings (not shown) so that the charging roller can rotate freely, and the charging roller is pressed to the photosensitive drum at a predetermined pressure by a pressurization unit (not shown). This charging roller in this figure rotates along with the rotational driven of the photosensitive drum. The charging roller is formed with a diameter of 16 mm in which a cored bar having a diameter of 9 mm is coated with a rubber layer having a moderate resistance of approximately 100,000 Ω·cm.

A power supply 153 shown in the figure is electrically connected with the cored bar 521 of the charging roller, and a predetermined bias is applied to the charging roller by the power supply. Thus, the surface of the photoconductor is uniformly charged at a predetermined polarity and potential.

The configuration of charging members may be of magnetic brush, fur brush or any other configurations other than of the roller, and may be selected according to the specification or configuration of the electrophotographic apparatus. In the apparatus where magnetic brush is used, the magnetic brush is constructed with various ferrite particles such as Zn—Cu ferrite that are used as charging members, nonmagnetic conductive sleeve supporting the charging member, and the magnet roll contained in the nonmagnetic conductive sleeve. When a brush is used, for example, fur is made conductive by carbon, copper sulfide, metal or metal oxide and it is winded around, or stuck to the cored bar which has been made conductive by metal and others to use as a charger.

The charger is not limited to above-mentioned contact chargers, however, it is preferable to use contact chargers because of the ability to decrease the ozone generated from charger in the image-forming apparatus.

Exposures may be performed by exposing the surface of photoconductor imagewise using exposure machines, for example.

The exposure machine is not limited as long as it is capable of exposing the surface of photoconductor that has been charged by a charger to form an image as it is expected, and may be selected accordingly. Examples thereof include various exposure machines such as copy optical system, rod lens array system, laser optical system, and liquid crystal shutter optical system, etc.

A backlight system may be employed in the invention by which the photoconductor is exposed imagewise from the rear surface.

—Developing and Developing Unit—

Developing is a step by which a latent electrostatic image is developed using the toner according to one of the first and second aspects of the invention and/or the developer to form a visible image.

The visible image may be formed, for example, by developing a latent electrostatic image using toner and/or developer, which may be performed by a developing unit.

The developing unit is not limited as long as it is capable of developing an image by using the toner according to one of the first and second aspects of the invention and/or developer, for example, and may be selected from known developing unit accordingly. Suitable examples thereof include those having developing units that contain the toner according to one of the first and second aspects of the invention and/or developer that can supply toners to the latent electrostatic images by contact or with no contact, developing units that contain the toner container of the invention are more preferable.

The developing unit may be of dry developing system or wet developing system and may also be for single or multiple colors. Preferred examples include one having mixer whereby toner and/or developer is charged by friction-stirring and rotatable magnet rollers.

In the developing unit, the toner and the carrier may, for example, be mixed and stirred together. The toner is thereby charged by friction, and forms a magnetic brush on the surface of the rotating magnet roller. Since the magnet roller is arranged near the latent electrostatic image bearing member (photoconductor), a part of the toner constructing the magnetic brush formed on the surface of the magnet roller is moved toward the surface of the latent electrostatic image bearing member (photoconductor) due to the force of electrical attraction. As a result, a latent electrostatic image is developed by the use of toner, and a visible toner image is formed on the surface of the photoconductor.

In the developing unit, a vibration bias voltage formed of a direct-current voltage overlapped with an alternating voltage is applied to a developing sleeve from a power supply as a developing bias. Potentials of a background and an image portions are positioned between a maximum value and a minimum value of the vibration bias potential. Thus, an alternate electric filed alternating its direction is formed in a developing section. In this alternate electric filed, a toner and a carrier in the developer vibrate hard, and the toner escapes from an electrostatic binding force to the developing sleeve and/or carrier. Then, the toner soars to a photoconductive drum and adheres to the photoconductive drum in accordance with a latent image thereon.

A difference between maximum and minimum values of the vibration bias voltage (a voltage between peaks) is preferably from 0.5 kV to 5 kV, and a frequency is preferably from 1 kHz to 10 kHz. Waveform of the vibration bias voltage may be a rectangular wave, a sine wave, a triangular wave, or the like. The direct-current voltage of the vibration bias is a value between the potentials of the background and image as mentioned above, and the value is preferably closer to the potential of the background than to that of the image to prevent foggy images in a potential area of the background, or a toner adhesion.

When the vibration bias voltage has a rectangular waveform, it is desirable that a duty ratio be not greater than 50%. Here, the duty ratio is a time ratio while the toner goes for the photoconductor in a cycle of the vibration bias. In this way, the difference between a peak value of the toner going for the photoconductor and an average time of the bias can be large. Consequently, the movement of the toner becomes further activated hence the toner is accurately adheres to the potential distribution on a surface of a latent image, and surface roughness and an image resolution can be improved. Moreover, the difference between a peak value of the carrier, having a charge of the opposite polarity to the toner, going for the photoconductor and an average time of the bias can be small. Therefore, the movement of the carrier can be restrained and the possibility of the carrier adhesion to the background of a latent image can largely be reduced.

The applied bias of the developing unit used in the invention is not limited as mentioned above, but it is preferable to apply a bias in such a way as mentioned above in order to obtain images with high resolution without surface roughness.

The developer contained in the developing unit is the developer containing the toner according to one of the first and second aspects of the invention, and it may be one-component or two-component developer. The toner contained in the developer is the toner according to one of the first and second aspects of the invention.

—Transferring and Transferring Unit—

Transferring is a step that transfers the visible image to a recording medium. In a preferable aspect, the first transferring is performed, using an intermediate transferring member by which the visible image is transferred to the intermediate transferring member, and the second transfer is performed wherein the visible image is transferred to the recording medium. In a more preferable aspect, using toner of two or more colors and preferably of full-color, and the first transferring is performed by transferring the visible image to the intermediate transferring member to form a compounded transfer image, and the second transferring is performed by transferring the compounded transfer image to the recording medium.

Transferring of the visible image may be carried out, for example, by charging the latent electrostatic image bearing member (photoconductor) using a transferring charger, which can be performed by the transferring unit. In a preferable aspect, the transferring unit contains the first transferring unit which transfers the visible image to the intermediate transferring member to form a compounded transfer image, and the second transferring unit which transfers the compounded transfer image to the recording medium.

The intermediate transferring member is not limited and may be selected from known transferring members and preferred examples include transfer belts.

The stationary friction coefficient of intermediate transferring member is preferably 0.1 to 0.6 and more preferably 0.3 to 0.5. The volume resistance of intermediate transferring member is preferably more than several Ωcm and less than $10^3$ Ωcm. By keeping the volume resistance within a range of several Ωcm to $10^3$ Ωcm, the charge over intermediate transferring member itself can be prevented and the charge given by the charging unit is unlikely to remain on the intermediate transferring member. Therefore transfer nonuniformity at the time of secondary transferring can be prevented and the application of transfer bias at the time of secondary transferring becomes relatively easy.

The materials making up the intermediate transferring member is not particularly limited, and may be selected from known materials accordingly. Examples are named hereinafter. (1) Materials with high Young's modulus (tension elasticity) used as a single layer belt such as polycarbonates (PC), polyvinylidene fluoride (PVDF), polyalkylene terephthalate (PAT), blend materials of PC/PAT, ethylene tetrafluoroethylene copolymer (ETFE)/PC, and ETFE/PAT, thermosetting polyimides of carbon black dispersion, and the like. These single layer belts having high Young's modulus are small in their deformation against stress during image formation and are particularly advantageous in that registration error is least likely to occur during color image formation. (2) A double or triple layer belt using above-described belt having high Young's modulus as a base layer, added with a surface layer and an optional intermediate layer around the peripheral side of the base layer. The double or triple layer belt has a capability of preventing dropouts in a lined image that is caused by hardness of the single layer belt. (3) A belt with relatively low Young's modulus that incorporates a rubber or an elastomer. This belt is advantageous in that there is almost no print defect of unclear center portion in a line image due to its softness. Additionally, by making width of the belt wider than drive roller or tension roller and thereby using the elasticity of edge portions that extend over rollers, it can prevent meandering of the belt. It is also cost effective for not requiring ribs or units to prevent meandering.

Conventionally, intermediate transfer belts have been adopting fluorine resins, polycarbonate resins, polyimide resins, and the like; however, recently, elastic belts in which elastic members are used in all layers or a part thereof are used as the intermediate transfer belts. There are some issues over transfer of color images by resin belt as described below.

Color images are typically formed by four colors of color toners. In one color image, toner layers of layer 1 to layer 4 are formed. Toner layers are pressurized as they pass through the primary transferring (in which toner is transferred to the intermediate transfer belt from the photoconductor) and the secondary transferring (in which toner is transferred to the sheet from the intermediate transfer belt), and the cohesive force among toner particles increases. As the cohesive force increases, phenomena such as dropouts of letters or dropouts of edges of solid images are likely to occur. Since resin belts are too hard to deform corresponding to the toner layers, they tend to compress the toner layers and therefore letter drop outs are likely to occur.

Recently, the demand toward printing full color images on various types of paper such as Japanese paper or the paper having a rough surface is increasing. However, the paper having a rough surface is likely to have a gap between toner and sheet at the time of transferring and therefore leading to transfer errors. When the transfer pressure of secondary transfer section is increased in order to increase adhesiveness, the cohesive force of the toner layers becomes high, resulting in the letter drop outs as described above.

Elastic belts are used for the following purpose. Elastic belts deform corresponding to the surface roughness of toner layers and the sheet having low smoothness in the transfer section. In other words, since elastic belts deform complying with local roughness and an appropriate adhesiveness can be obtained without excessively increasing the transfer pressure against toner layers, it is possible to obtain transfer images having excellent uniformity with no letter drop outs even with the paper of low flatness.

The resin of the elastic belts is not limited and may be selected accordingly. Examples thereof include polycarbonates, fluorine resins (ETFE, PVDF), styrene resins (homopolymers and copolymers including styrene or substituted styrene) such as polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylate copolymers (styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylate copolymers (styrene-methyl methacrylate copolymer, styrene-ethyl methacrylate copolymer, styrene-phenyl methacrylate copolymer, and the like), styrene-α-chloromethyl acrylate copolymer, styrene-acrylonitrile acrylate copolymer, and the like, methyl methacrylate resin, butyl methacrylate resin, ethyl acrylate resin, butyl acrylate resin, modified acrylic resins (silicone-modified acrylic resin, vinyl chloride resin-modified acrylic resin, acrylic urethane resin, and the like), vinyl chloride resin, styrene-vinyl acetate copolymer, vinyl chloride-vinyl acetate copolymer, rosin-modified maleic acid resin, phenol resin, epoxy resin, polyester resin, polyester polyurethane resin, polyethylene, polypropylene, polybutadiene, polyvinylidene chloride, ionomer resin, polyurethane resin, silicone resin, ketone resin, ethylene-ethylacrylate copolymer, xylene resin and polyvinylbutylal resin, polyamide resin, modified polyphenylene oxide resin, and the like. These may be used alone or in combination.

Rubber and elastomer of the elastic materials are not limited and may be selected accordingly. Examples thereof include butyl rubber, fluorine rubber, acrylic rubber, ethylene propylene rubber (EPDM), NBR, acrylonitrile-butadiene-styrene natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorohydrin rubber, silicone rubber, fluorine rubber, polysulfurized rubber, polynorbornen rubber, hydrogenated nitrile rubber, thermoplastic elastomers (polystyrene elastomers, polyolefin elastomers, polyvinyl chloride elastomers, polyurethane elastomers, polyamide elastomers, polyurea elastomers, polyester elastomers, and fluorine resin elastomers), and the like. These may be used alone or in combination.

The conductive agents for resistance adjustment are not limited and may be selected accordingly. Examples thereof include carbon black, graphite, metal powders such as aluminum, nickel, and the like and electric conductive metal oxides such as tin oxide, titanium oxide, antimony oxide, indium oxide, potassium titanate, antimony tin oxide (ATO), indium tin oxide (ITO), and the like. The conductive metal oxides may be coated with insulating particles such as barium sulfate, magnesium silicate, calcium carbonate, and the like. The conductive agents are not limited to those mentioned above.

Materials of the surface layer are required to prevent contamination of the photoconductor by elastic material as well as to reduce the surface friction of the transfer belt so that toner adhesion is lessened while cleaning ability and the secondary transfer property are improved. Materials which reduces surface energy and enhances lubrication by the use of alone or combination of polyurethane, polyester, epoxy resin, and the like may be dispersed for use. Examples of such materials include alone, combination of two or more or combination of different particle diameters of powders or particles such as fluorine resin, fluorine compound, carbon fluoride, titanium dioxide, silicon carbide, and the like. In addition, it is possible to use a material such as fluorine rubber that is treated with heat so that a fluorine-rich layer is formed on the surface and the surface energy is reduced.

Examples of manufacturing processes of the belts include, but not limited to centrifugal forming in which material is poured into a rotating cylindrical mold to form a belt, spray application in which a liquid paint is sprayed to form a film, dipping method in which a cylindrical mold is dipped into a solution of material and then pulled out, injection mold method in which material is injected between inner and outer mold, a method in which a compound is applied onto a cylindrical mold and the compound is vulcanized and grounded. In general, two or more processes are combined for manufacturing belts.

Methods to prevent elongation of the elastic belt include using a core resin layer that is difficult to elongate on which a rubber layer is formed, incorporating a material that prevents elongation into the core layer, and the like, but the methods are not particularly limited to the manufacturing processes.

Examples of the materials constructing the core layer that prevent elongation include alone or combination of natural fibers such as cotton, silk and the like; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, phenol fibers, and the like; inorganic fibers such as carbon fibers, glass fibers, boron fibers, and the like, metal fibers such as iron fibers, copper fibers, and the like, and materials that are in a form of a weave or thread may be used. It should be noted that the materials are not limited to those described above.

A thread may be one or more of filaments twisted together, and any twisting and plying forms are accepted such as single twisting, multiple twisting, doubled yarn, and the like. Further, fibers of different materials selected from above-mentioned group may be spun together. The thread may be treated before use in such a way that it becomes electrically conductive. On the other hand, the weave may be of any type including plain knitting, and the like. It is possible to use a union weave for making it electrically conductive.

The manufacturing process of the core layer is not particularly limited. Examples include a method in which a weave that is woven in a cylindrical shape is placed on a mold or the like and a coating layer is formed on top of it, a method in which a cylindrical weave is dipped in a liquid rubber or the like so that coating layer(s) is formed on one side or on both sides of the core layer and a method in which a thread is wound helically to a mold or the like in an arbitrary pitch, and then a coating layer is formed thereon.

If the elastic layer is too thick, elongation and contraction of the surface becomes large and may cause cracks on the surface layer depending on the hardness of the elastic layer. Moreover, as the amount of elongation and contraction increases, the size of images are also elongated and contracted significantly. Therefore, too much thickness, about 1 mm or more, is not preferable.

The transferring units of the first and the second transferring preferably contain an image-transferring unit which releases the visible image formed on the photoconductor to the recording medium side by charging. There may be one, two or more of the transferring unit.

The transferring unit may be a corona transferring unit based on corona discharge, transfer belt, transfer roller, pressure transfer roller, or adhesion transferring unit, for example.

The recording medium is not limited as long as it is capable of transferring unfixed images after development and may be selected accordingly. The recording medium is typically plain paper, and other materials such as polyethylene terephthalate (PET) sheets for overhead projector (OHP) may be utilized.

The fixing is a step that fixes the visible image transferred to the recording medium using a fixing unit. The fixing may be carried out for each color when being transferred to the recording medium, or simultaneously when all colors are being laminated.

The fixing unit is not limited and may be selected accordingly, however it is preferably known heat application and pressurization unit. Examples of such unit include a combination of heating roller and pressure roller, and a combination of heating roller, pressure roller, and endless belt, and the like.

The heating temperature in the heat application and pressurization unit is preferably 80° C. to 200° C.

Further, known optical fixing unit may be used in addition to or in place of fixing and fixing unit, depending on the application.

In a preferable aspect, the fixing unit is a heat fixing unit which fixes a toner image on a recording medium while the recording medium is passed between a heating member and a pressure member and is transported.

In this case, it is preferable that the heat fixing unit comprises a cleaning member which removes the toner adhered to at least one of the heating member and the pressure member and that the surface pressure (roller load/contact area) applied between the heating member and pressure member is $1.5\times10^5$ Pa or less.

Figure 17:
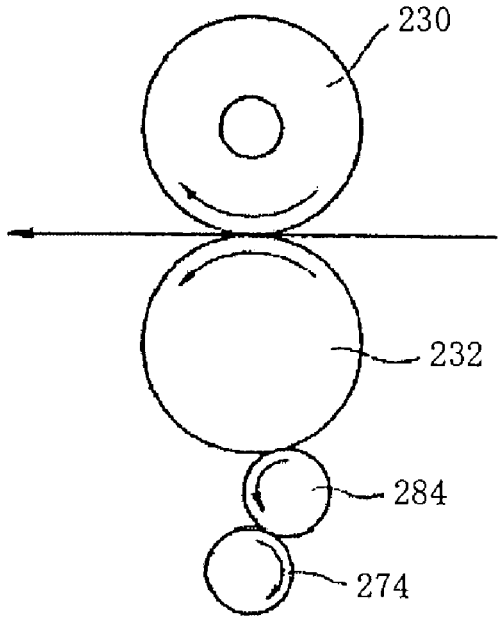
FIG. 17 is a schematic view showing an example of the heat fixing unit for use in the image forming apparatus of the invention.

As shown in FIG. 17, the fixing unit is, for example, a heat fixing unit in which a recording medium is passed between a heating member 230 and pressure member 232 and while the recording medium being transported, toner images on the recording medium are fixed. The heat fixing unit comprises a cleaning member 274 which removes toners adhered to the heating member and the surface pressure (roller load/contact area) applied between the heating member and pressure member is adjusted to 1.5×105 Pa or less. Higher surface pressure improves the fixing and/or prevents hot offset in a wider range; however, strong pressure cause e.g. crumple on a paper easily. The cleaning member 274 may be directly brought into contact with the heating member 230 or pressure member 232 to remove toners adhered thereto, but not limited to this case, as shown in this FIG. 20, the cleaning member may remove toners adhered to the pressure member 232 via a toner removing member 284. Alternatively, the cleaning member may remove toners adhered to the heating member 232 via a toner removing member 284 to be brought into contact with the heating member 230 although drawing is omitted.

In a preferable aspect, the fixing unit comprises a heating member equipped with a heat generator, a heating member equipped with a heat generator; a film which contacts with the heating member; and a pressure member which makes pressure contact with the heating member via the film, wherein a recording medium, on which an unfixed image is formed after electrostatic transfer, is passed between the film and the pressure member to thereby heat and fix the unfixed image.

Figure 11:
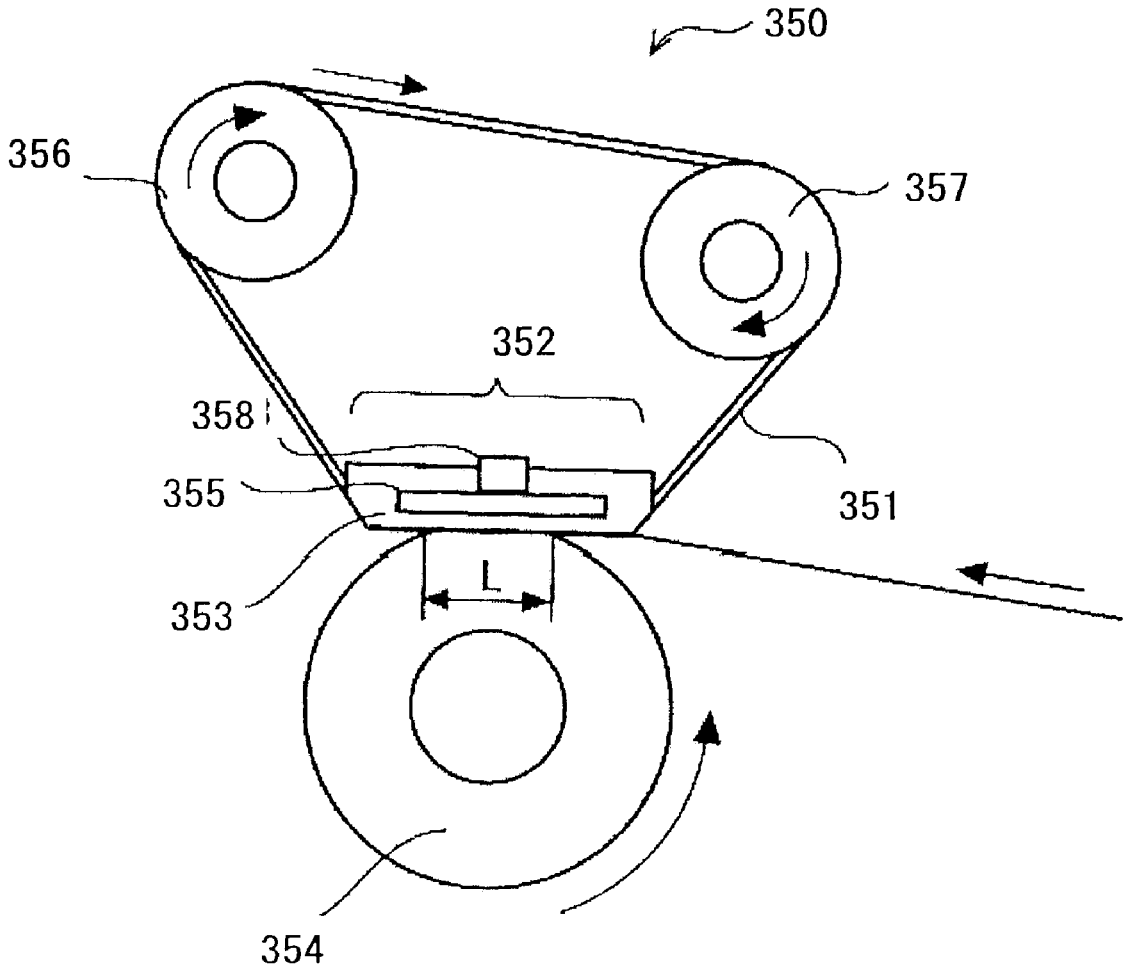
FIG. 11 is a schematic diagram showing an example of the surf fixing device of the invention.

Such fixing unit includes, for example, so-called surf fixing device, in which a fixing film is rotated to fix an image, as shown in FIG. 11.

In this surf fixing device, the fixing film 351 is a heat resistant film having the shape of an endless belt, which is spanned around a driving roller 356, driven roller 357 and heating member 352 which is fixedly supported by a heater supporter located between and below both of these rollers.

The driven roller 357 also serves as a tension roller of the fixing film, and the fixing film 351 rotates clockwise due to a clockwise rotation, shown in the figure, of the driving roller. This rotational speed of the fixing film is adjusted to be equivalent to the speed of a transfer material at a fixing nip area L where a pressure roller and the fixing film contact each other.

Here, the pressure roller has a rubber elastic layer having good releasability such as silicone rubbers, and rotates counterclockwise while pressure contacting the fixing nip area L at an overall contact pressure of from 4 kg to 10 kg.

Such film that is excellent in heat resistance, releasability and durability is preferable as the fixing film 351, and its total thickness is not more than 100 μm, preferably, not more than 40 μm. Examples include a monolayer film of heat resistant resin such as polyimide, polyetherimide, polyethersulfide (PES), PFA (tetrafluorostyrene-perfluoroalkylvinylether copolymer resin), or the like; or multi-layer film comprising, for example, a 20 μm thick base layer, and, in the side coming in contact with the image, a 10 μm thick parting layer of fluoro-resin such as PTFE (tetrafluoro-ethylene resin), PAF, or the like, which is coated on the base layer and contains electrically conductive material, or an elastic layer of e.g. a fluorocarbon rubber or a silicone rubber, which is coated on the base layer.

In FIG. 11, the heating member 352 in this aspect is composed of a flat substrate 353 and a fixing heater 355, and the flat substrate 353 is formed of a material having a high heat conductivity and a high electric resistance such as alumina. A fixing heater formed of a resistance heat generator is arranged on a surface of the heating member contacting the fixing film in the longitudinal direction. The fixing heater is one obtained by coating an electric resistant material such as Ag/Pd and Ta2N by e.g. a screen printing so as to have a linear shape or belt shape. Both ends of the fixing heater have electrodes (not shown) and the resistance heat generator generates a heat when electricity passes though the electrodes. Further, a fixing temperature sensor 358 formed of a thermistor is provided to the substrate on the surface opposite to the surface on which the fixing heater is arranged.

Temperature information of the substrate detected by the fixing temperature sensor 358 is transmitted to a controller (not shown), then an electric energy supplied to the fixing heater by the controller, and the heating member is controlled to a predetermined temperature.

The fixing unit is not limited to the above-mentioned surf fixing device; however, it is preferable to use the surf fixing device because of availability of image forming apparatus such that a fixing unit which is efficient and can shorten the rise time.

In a preferable aspect, the fixing unit comprises a heating roller, a fixing roller, an endless belt-like toner heating medium, and a pressure roller, wherein the heating roller is formed of a magnetic metal and is heated by electromagnetic induction, the fixing roller is arranged parallel to the heating roller, the toner heating medium is spanned over the heating roller and the fixing roller, is heated by the heating roller, and is rotated by these rollers, the pressure roller is brought into pressure contact with the fixing roller via the toner heating medium and rolls in the forward direction towards the toner heating medium to form a fixing nip portion, and wherein a recording medium, on which an unfixed image is formed after electrostatic transfer, is passed between the toner heating medium and the pressure member to thereby heat and fix the unfixed image.

Figure 12:
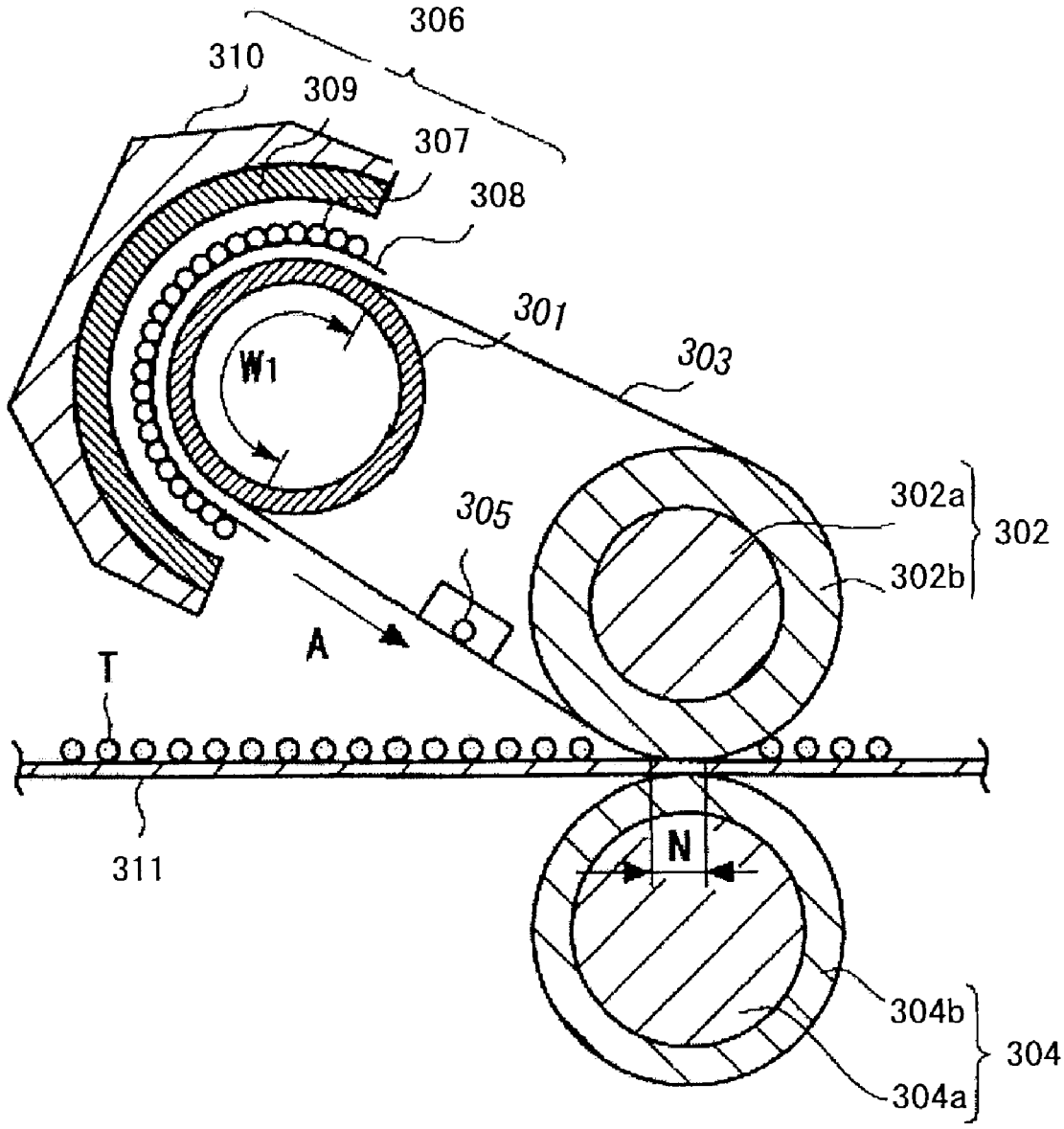
FIG. 12 is a schematic cross-section view showing an example of the fixing unit according to an electromagnetic induction heating (IH) process.

Suitable examples of such fixing unit include the fixing unit according to an electromagnetic induction heating (IH) process as shown in FIG. 12.

The IH fixing unit used was so-called electromagnetic induction heating fixing unit (fixing unit according to an IH process) in which a heating unit thereof is, as shown in FIG. 12, a unit configured to cause a heating member containing a metal member to generate heat by electromagnetic induction, namely, the Joule heat caused by eddy current generated to a magnetic metal member due to an alternating magnetic field.

The image-fixing apparatus shown in FIG. 12 comprises a heating roller 301, fixing roller 302, heat resistant belt (toner heating medium) 303, and pressure roller 304. The heating roller 301 is heated by electromagnetic induction of an induction heating unit 306. The fixing roller 302 is arranged parallel to the heating roller 301. The endless heat resistant belt 303 is spanned over the heating roller 301, fixing roller 302 and is heated by the heating roller 301, and rolls in the arrow A direction by the rolling of one of these roller. The pressure roller 304 is brought into pressure contact with the fixing roller 302 via the belt 303, and rolls in the forward direction towards the belt 303.

The heating roller 301 comprises hollow circular cylindrical magnetic metal member made of, for example, iron, cobalt, nickel, or alloys of these metals, and this configuration enables low thermal capacity and fast temperature rising.

The fixing roller 302 comprises a cored bar 302*a* made of metal such as stainless-steel and an elastic member 302*b* which is made of silicon rubber having heat resistance in solid form or in foam form and coats the cored bar 302*a*. In order to form contact parts with a predetermined width between the pressure roller 304 and the fixing roller 302 by a pressing force from the pressure roller 304, the outside diameter of the fixing roller is set to larger than that of the heating roller 301. This configuration makes the thermal capacity of the heating roller 301 to be smaller than that of the fixing roller 302, and thus the heating roller 301 is rapidly heated and warm up time is shortened.

The belt 303 which is spanned over the heating roller 301 and the fixing roller 302, is heated at a contact site W1 between itself and the heating roller 301 which is heated by the induction heating unit 306. Then, by rolling of rollers 301 and 302, inside of the belt 303 is consecutively heated and as a result, the entire belt is heated. The pressure roller 304 comprises a cored bar 304*a* which is a circular member made of metal having good heat conductance such as, for example, copper or aluminum; and an elastic member 304*b* which is arranged on the surface of this cored bar 304*a* and has high heat resistance and toner releasing properties. Besides the above-mentioned metals, stainless (SUS) may be used in the cored bar 204*a*.

The pressure roller 304 presses the fixing roller 302 via the belt 303 to form a fixing nip portion N. In this aspect, the pressure roller 304 has higher hardness than the fixing roller 302, and thus the pressure roller 304 makes inroads into the fixing roller 302 (and belt 303), which causes the recording medium 311 to be arranged along the circumferential shape of the surface of the pressure roller 304. In this way, the effect that the separation of the recording medium 311 from the belt 303 is facilitated is achieved.

Figure 13A:
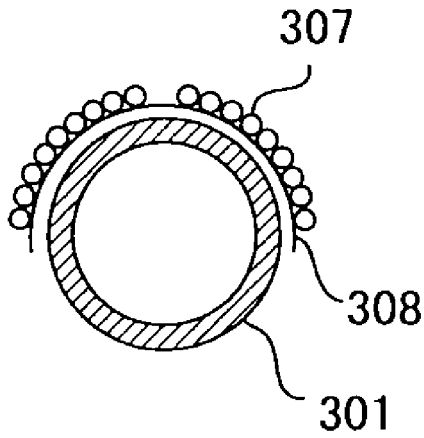
FIG. 13A is a vertical cross-section view of the heating roller part in the fixing unit according to an IH process of FIG. 12.
Figure 13B:
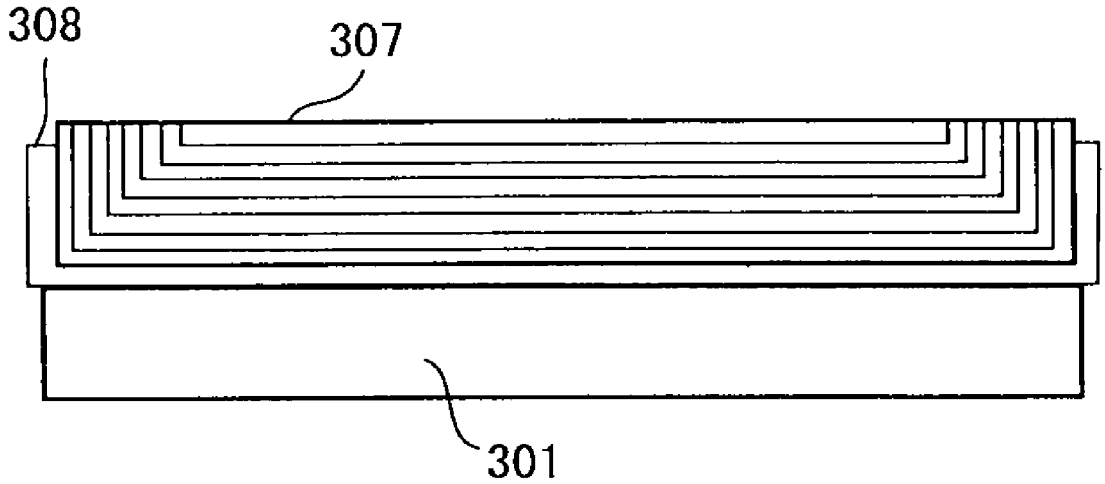
FIG. 13B is a longitudinal cross-section view of the heating roller in the fixing unit according to an IH process of FIG. 12.

The induction heating unit 306 which heats the heating roller 301 by means of electromagnetic induction comprises, as shown in FIGS. 12, 13A and 13B, an exciting coil 307 as a magnetic field generating unit, and a coil guide plate 308 around which the exciting coil 307 is winded. The coil guide plate 308 is closely arranged to the outer circumferential surface of the heating roller 301 and is in a half cylinder shape. As shown in FIG. 13B, a long piece of wire rod for an exciting coil is alternately winded along the coil guide plate 308 in the axial direction of the heating roller 301 to form the exciting coil 307. Note that the oscillation circuit of the exciting coil 307 is connected to a frequency-variable driving power source (not shown). Outside the exciting coil 307, an exciting coil core 309 which is formed of a ferromagnetic material such as ferrite and is in a half cylinder shape is fixed to an exciting coil core supporting member 310 and closely arranged to the exciting coil 307. Note that an exciting coil core 309 for use in this aspect has a relative magnetic permeability of 2,500. A high-frequency alternating current of 10 to 1 MHz, and preferably 20 kHz to 800 kHz is supplied from the driving power source to the exciting coil 307, thereby an alternating magnetic field is generated. The alternating magnetic field works on the heating roller 301 and the heat generating layer of the belt 303 in the contact region W1 of the heating roller 301 and the fixing belt 303 and in the vicinity thereof. Inside them, eddy currents I flow in the direction B preventing change of the alternating magnetic field. This eddy currents I cause to generate the Joule heat depending on the resistance of the heat roller 201 and the heat generation layer of the belt 303, i.e., mainly in the contact region of the heat roller 301 and the belt 303 and in the vicinity thereof the belt 303 comprising the heat roller 301 and the heat generating layer is heated by means of electromagnetic induction.

The inner surface temperature of the thus-heated belt 303 is detected by means of temperature detecting means 305 which is arranged in contact with the inner surface of the belt 303 in the vicinity of the entrance of the fixing nip portion N and comprises temperature-sensitive element having high thermal responsiveness such as a thermistor.

The fixing unit used in the invention is not limited to above-mentioned fixing unit according to an IH process. However, it is preferable to use a fixing unit according to an IH process because it has higher efficiency of heat transfer than that of the hear roller type fixing unit, enabling the shortening of warm-up time and an image forming apparatus, in which a fixing unit allowing quick start-up or energy-saving is utilized, is achieved.

The charge-eliminating is a step that applies a discharge bias to the photoconductor to discharge it, and may be performed by a charge-eliminating unit.

The charge-eliminating unit is not particularly limited as long as it is capable of applying discharge bias to the photoconductor such as discharge lamps, and may be selected from known charge-eliminating units accordingly.

The cleaning is a step in which residual electrophotographic toner on the latent electrostatic image bearing member is removed, and typically performed by a cleaning unit.

Any known cleaning unit that is capable of removing residual electrophotographic toner on the latent electrostatic image bearing member may be used, the cleaning unit may be properly selected from known cleaner and examples include magnetic brush cleaner, electrostatic brush cleaner, magnetic roller cleaner, blade cleaner, brush cleaner, and web cleaner, etc.

The recycling is a step in which the electrophotographic color toner removed by the cleaning is recycled for use in the developing, and typically performed by a recycling unit.

The recycling unit may be properly selected from known transport units.

The controlling is a step in which the respective processes are controlled and typically carried out by a controlling unit.

Any known controlling unit that is capable of controlling the performance of each unit may be selected accordingly. Examples include instruments such as sequencers or computers, etc.

Figure 2:
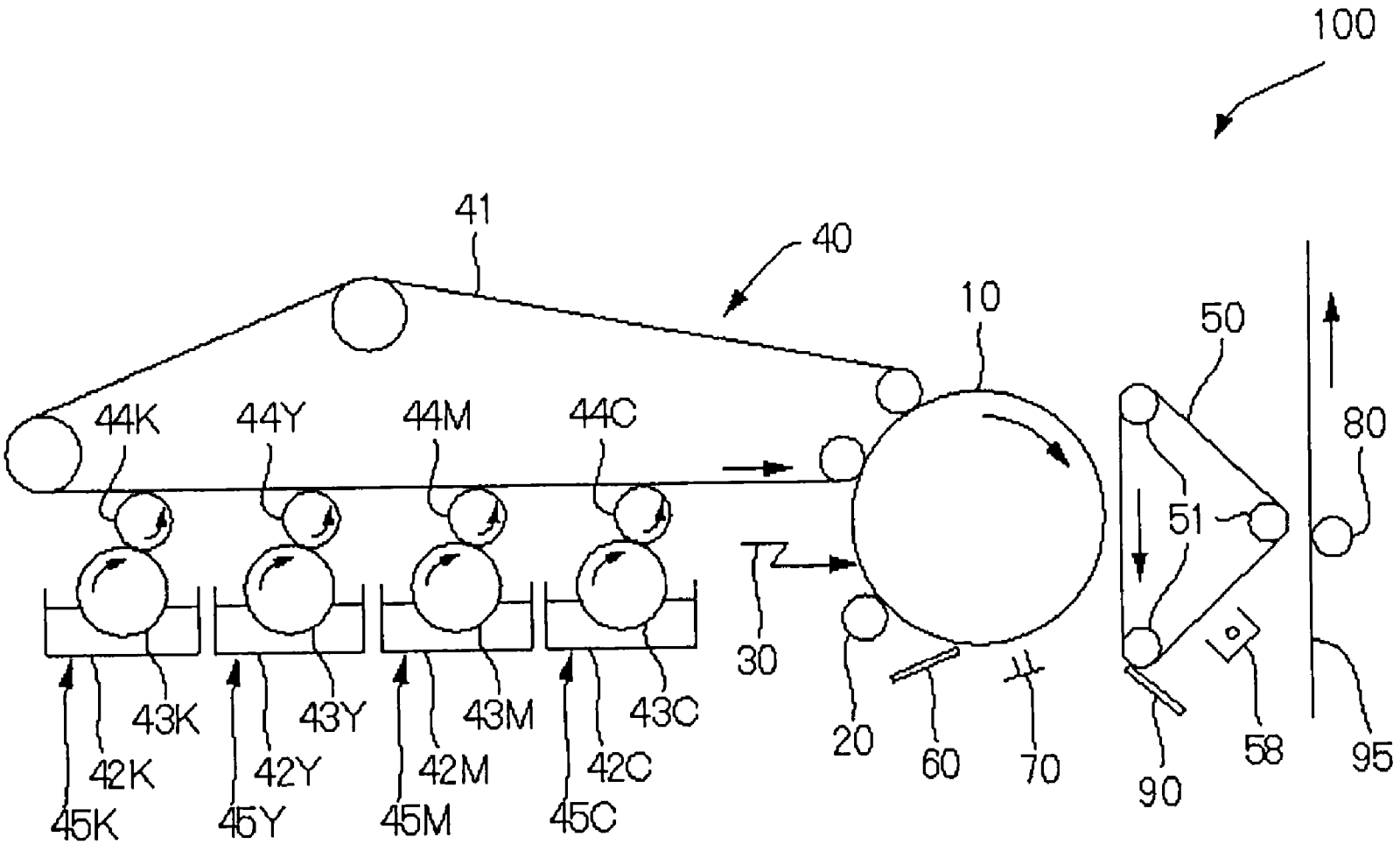
FIG. 2 is a schematic diagram of an example of the image forming apparatus of the invention.

An aspect of the operation of the image forming method performed by the image forming apparatus of the invention is described referring to FIG. 2. The image forming apparatus 100 shown in FIG. 2 is equipped with the photoconductor drum 10 (hereafter referred to as "photoconductor 10") as a latent electrostatic image bearing member, the charge roller 20 as a charging unit, the exposure apparatus 30 as an exposure unit, the developing unit 40 as a developing unit, the intermediate transferring member 50, the cleaning device 60 having a cleaning blade as a cleaning unit and the discharge lamp 70 as a discharging unit.

The intermediate transferring member 50 is an endless belt that is being extended by the three roller 51 placed inside the belt and designed to be moveable in arrow direction. A part of three roller 51 function as a transfer bias roller that can imprint a specified transfer bias, the primary transfer bias, to the intermediate transferring member 50. The cleaning unit 90 with a cleaning blade is placed near the intermediate transferring member 50, and the transfer roller 80, as a transferring unit which can imprint the transfer bias for transferring the developed image, toner image (second transferring), onto the transfer paper 95 as the final transfer material, is placed face to face with the clearing unit 90. In the surrounding area of the intermediate transferring member 50, the corona charger 58, for charging toner image on the intermediate transferring member 50, is placed between contact area of the photoconductor 10 and the intermediate transferring member 50 and contact area of the intermediate transferring member 50 and the transfer paper 95 in the rotating direction of the intermediate transferring member 50.

The development unit 40 is constructed with developing belt 41 as a developer bearing member, black developing unit 45K, yellow developing unit 45Y, magenta developing unit 45M and cyan developing unit 45C that are juxtapositioned in the surrounding area of developing belt 41. The black developing unit 45K is equipped with developer container 42K, developer feeding roller 43K and developing roller 44K whereas yellow developing unit 45Y is equipped with developer container 42Y, developer feeding roller 43Y and developing roller 44Y. The magenta developing unit 45M is equipped with developer container 42M, developer feeding roller 43M and developing roller 44M whereas the cyan developing unit 45C is equipped with developer container 42C, developer feeding roller 43C and developing roller 44C. The developing belt 41 is an endless belt and is extended between a number of belt rollers as rotatable and the part of developing belt 41 is in contact with the photoconductor 10.

For example, the charge roller 20 charges the photoconductor drum 10 evenly in the image forming apparatus 100 as shown in FIG. 2. The exposure apparatus 30 exposes imagewise on the photoconductor drum 10 and forms a latent electrostatic image. The latent electrostatic image formed on the photoconductor drum 10 is then developed with the toner fed from the developing unit 40 to form a toner image. The toner image is then transferred onto the intermediate transferring member 50 by the voltage applied from the roller 51 as the primary transferring and it is further transferred onto the transfer paper 95 as the secondary transferring. As a result, a transfer image is formed on the transfer paper 95. The residual toner on the photoconductor 10 is removed by the cleaning unit 60 and the charge built up over the photoconductor 10 is temporarily removed by the discharge lamp 70.

Figure 3:
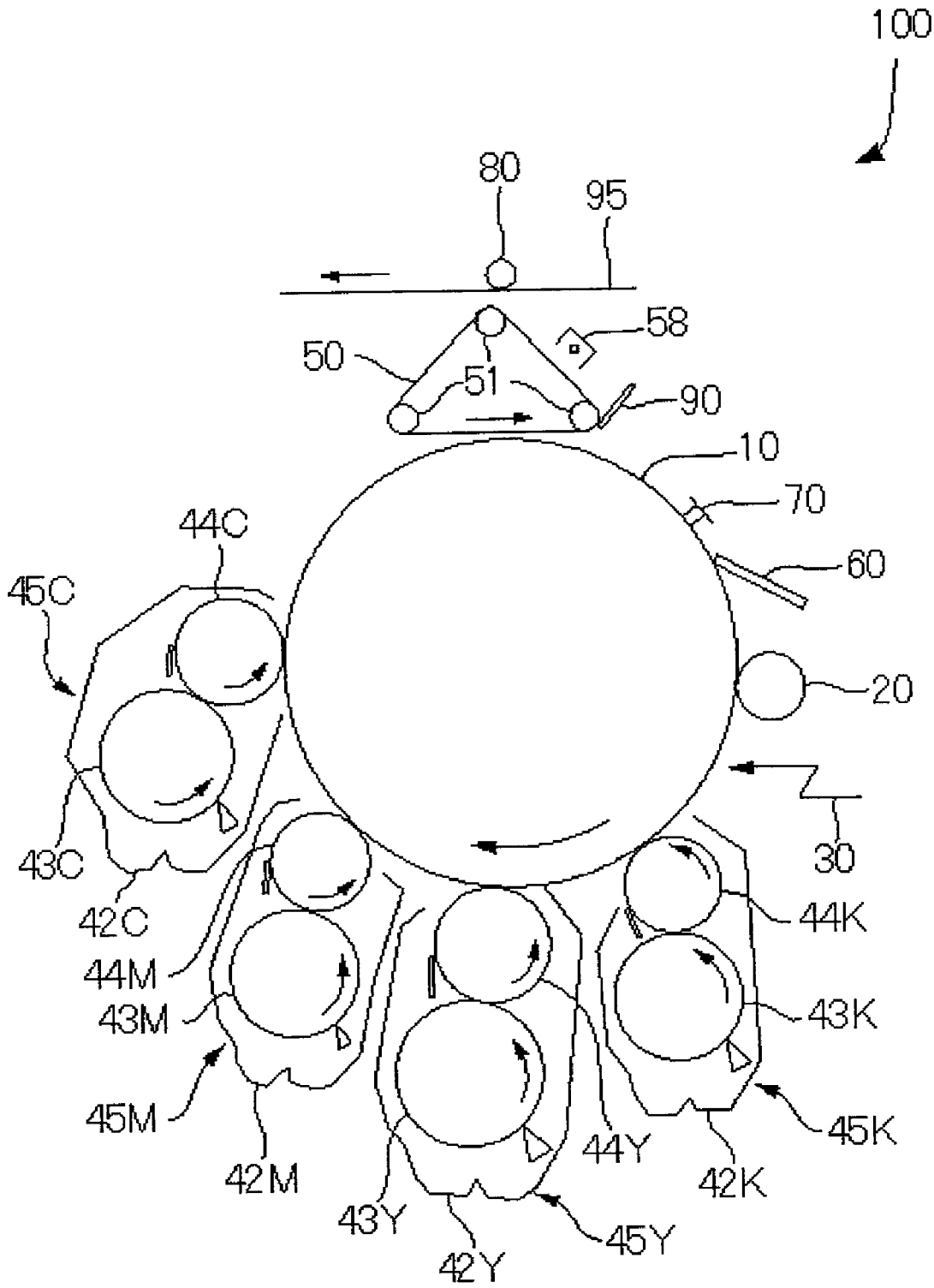
FIG. 3 is a schematic diagram of another example of the image forming apparatus of the invention.

The other aspect of the operation of image forming methods of the invention by image forming apparatuses of the invention is described referring to FIG. 3. The image forming apparatus 100 as shown in FIG. 3 has the same lineups and effects as the image forming apparatus 100 shown in FIG. 2 except for the developing belt 41 is not equipped and the black developing unit 45K, the yellow developing unit 45Y, the magenta developing unit 45M and the cyan developing unit 45C are placed directly facing the photoconductor 10. The symbols used in FIG. 3 correspond to the symbols used in FIG. 2.

Figure 4:
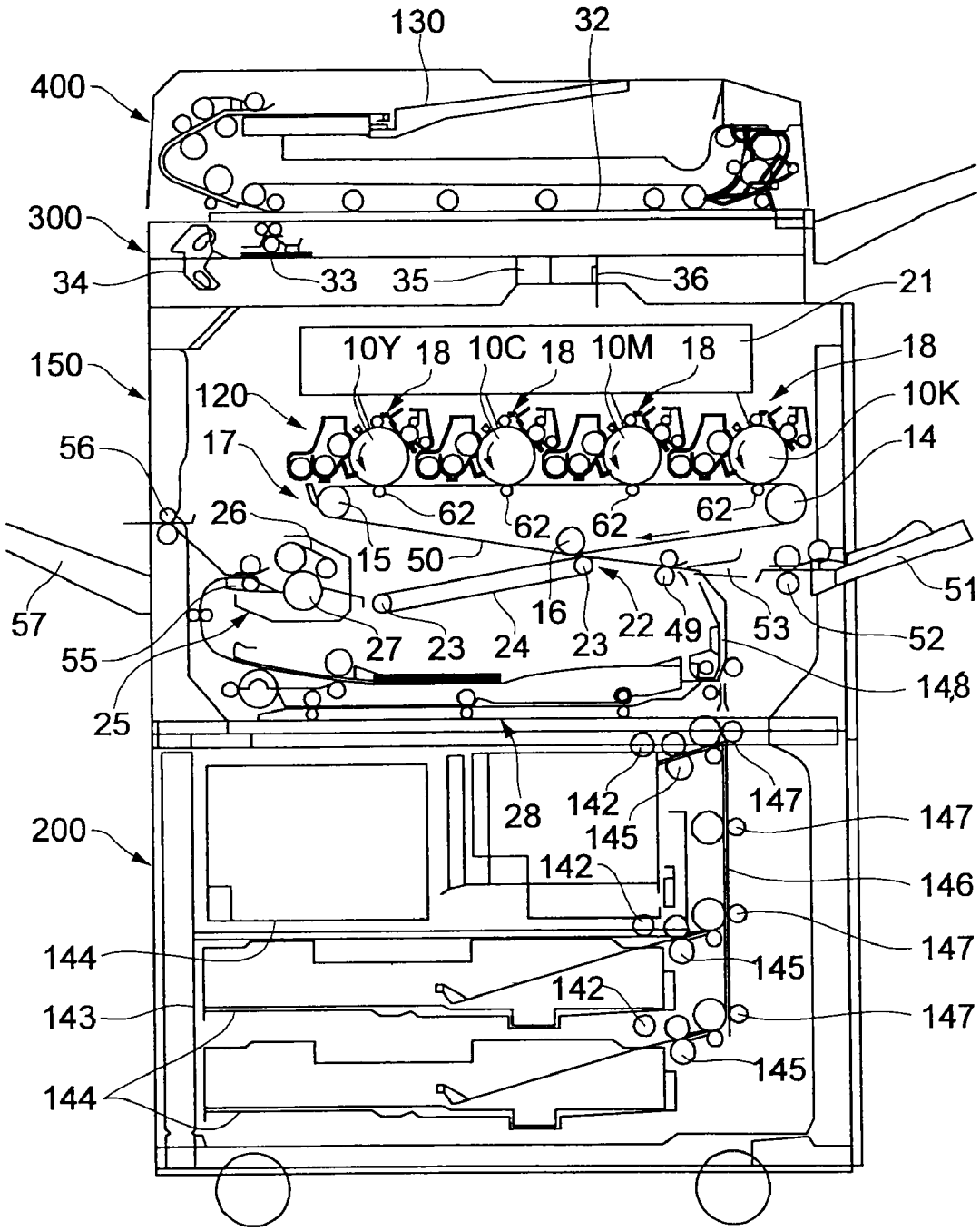
FIG. 4 is a schematic diagram showing an example of the operation of the image forming method of the invention performed by the image forming apparatus (tandem color image forming apparatus) of the invention.

The tandem image forming apparatus 100 as shown in FIG. 4 is a tandem color image forming apparatus. The tandem image forming apparatus 120 is equipped with the copier main body 150, the feeding paper table 200, the scanner 300 and the automatic document feeder (ADF) 400.

The intermediate transferring member 50 in a form of an endless belt is placed in the center part of the copier main body 150. The intermediate transferring member 50 is extended between the support roller 14, 15 and 16 as rotatable in the clockwise direction as shown in FIG. 4. The intermediate transferring member cleaning unit 17 is placed near the support roller 15 in order to remove the residual toner on the intermediate transferring member 50. The tandem developing unit 120 is placed on the intermediate transferring member 50. In the tandem developing unit, four image forming units 18, yellow, cyan, magenta and black, are positioned in line along the transport direction in the intermediate transferring member 50, which is being extended between the support roller 14 and 15. The exposure unit 21 is placed near the tandem developing unit 120. The secondary transferring unit 22 is placed on the opposite side where tandem developing unit 120 is placed in the intermediate transferring member 50. The secondary transfer belt 24, an endless belt, is extended between a pair of the roller 23 and the transfer paper transported on the secondary transfer belt 24 and the intermediate transferring member 50 are accessible to each other in the secondary transferring unit 22. The fixing unit 25 is placed near the secondary transferring unit 22.

The sheet inversion unit 28 is placed near the secondary transferring unit 22 and the fixing unit 25 in the tandem image forming apparatus 100, in order to invert the transfer paper to form images on both sides of the transfer paper.

The full-color image formation, color copy, using the tandem developing unit 120 is explained. At the start, a document is set on the document table 130 of the automatic document feeder (ADF) 400 or the automatic document feeder 400 is opened and a document is set on the contact glass 32 of the scanner 300 and the automatic document feeder 400 is closed.

By pushing the start switch (not shown), the scanner 300 is activated after the document was transported and moved onto the contact glass 32 when the document was set on the automatic document feeder 400, or the scanner 300 is activated right after, when the document was set onto the contact glass 32, and the first carrier 33 and the second carrier 34 will start running. The light from the light source is irradiated from the first carrier 33 simultaneously with the light reflected from the document surface is reflected by the mirror of second carrier 34. Then the scanning sensor 36 receives the light via the imaging lens 35 and the color copy (color image) is scanned to provide image information of black, yellow, magenta and cyan.

Figure 5:
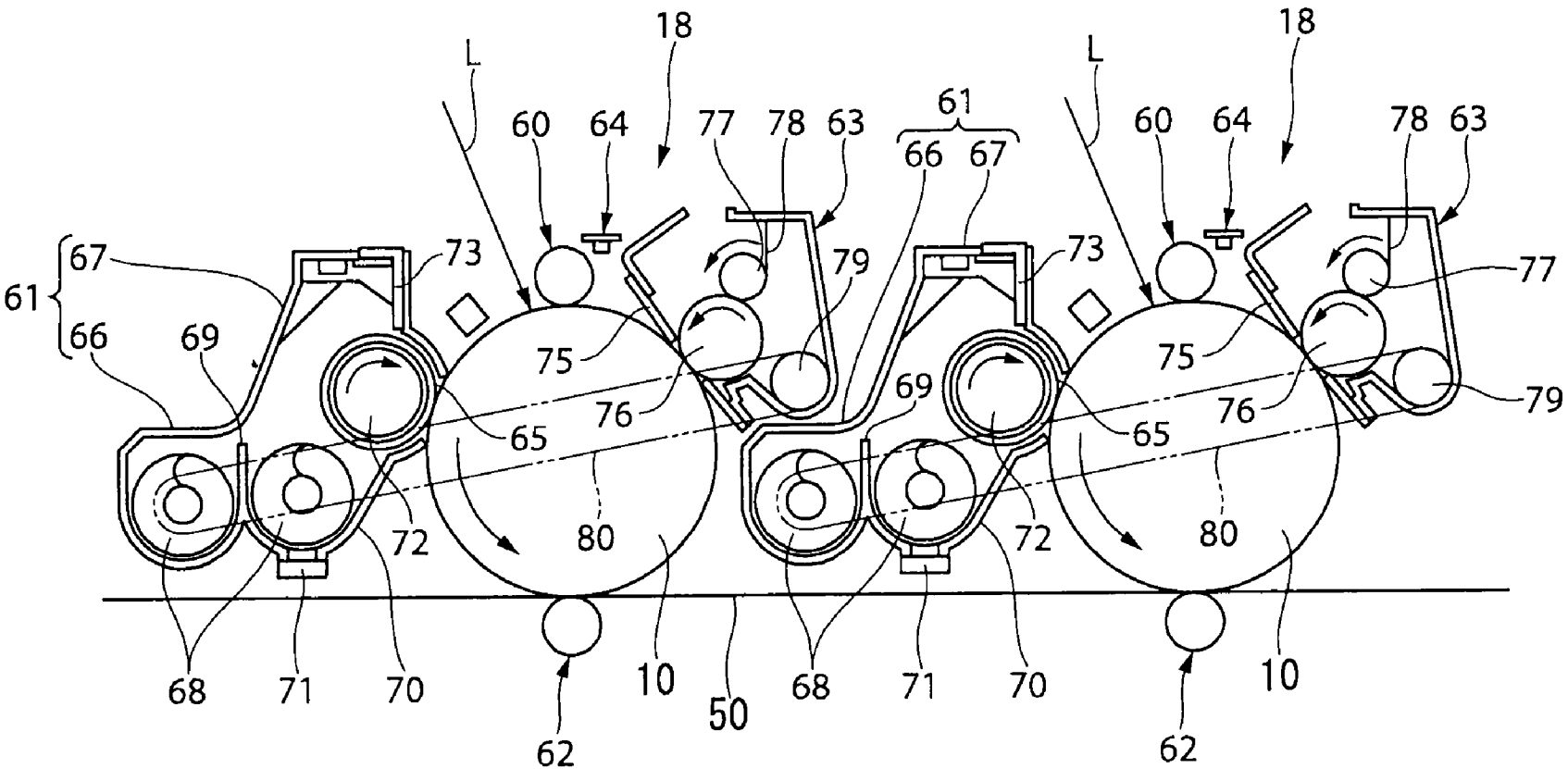
FIG. 5 a partially enlarged schematic diagram of image forming apparatus shown in FIG. 4.

Each image information for black, yellow, magenta and cyan is transmitted to each image forming unit 18: black image forming unit, yellow image forming unit, magenta image forming unit and cyan image forming unit, of the tandem developing unit 120 and each toner image of black, yellow, magenta and cyan is formed in each image forming unit. The image forming unit 18: black image forming unit, yellow image forming unit, magenta image forming unit and cyan image forming unit of the tandem image forming apparatus 120 as shown in FIG. 5 is equipped with the photoconductor 10: photoconductor 10K for black, photoconductor 10Y for yellow, photoconductor 10M for magenta and photoconductor 10C for cyan, the charger 60 that charges photoconductor evenly, an exposing unit by which the photoconductor is exposed imagewise corresponding to each color images based on each color image information as indicated by L in FIG. 5 to form a latent electrostatic image corresponding to each color image on the photoconductor, the developing unit 61 by which the latent electrostatic image is developed using each color toner: black toner, yellow toner, magenta toner and cyan toner to form toner images, the charge-transferring unit 62 by which the toner image is transferred onto the intermediate transferring member 50, the photoconductor cleaning unit 63 and the discharger 64. The image forming unit 18 is able to form each single-colored image: black, yellow, magenta and cyan images, based on each color image information. These formed images: black image formed on the photoconductor 10K for black, yellow image formed on the photoconductor 10Y for yellow, magenta image formed on the photoconductor 10M for magenta and cyan image formed on the photoconductor 10C for cyan, are transferred sequentially onto the intermediate transferring member 50 which is being rotationally transported by the support rollers 14, 15 and 16 (the primary transferring). And the black, yellow, magenta and cyan images are overlapped to form a synthesized color image, a color transfer image.

In the feeding table 200, one of the feeding rollers 142 is selectively rotated and sheets (recording paper) are rendered out from one of a plurality of feeding cassettes in the paper bank 143 and sent out to feeding path 146 after being separated one by one by the separation roller 145. The sheets are then transported to the feeding path 148 in the copier main body 150 by the transport roller 147 and are stopped running down to the resist roller 49. Alternatively, sheets (recording paper) on the manual sheet tray 51 are rendered out by rotating a feeding roller 142, inserted into the manual feeding path 53 after being separated one by one by the separation roller 52 and stopped by running down to the resist roller 49 in the same way. Generally, the resist roller 49 is used being grounded; however, it is also usable while bias is imposed for the sheet powder removal.

The resist roller 49 is rotated in synchronism with the synthesized color image (color transfer image) on the intermediate transferring member 50, and a sheet (recording paper) is sent out between the intermediate transferring member 50 and the secondary transferring unit 22. The color image is then formed on the sheet (recording paper) by transferring (secondary transferring) the synthesized color image (color transfer image) by the secondary transferring unit 22. The residual toner on the intermediate transferring member 50 after the image transfer is cleaned by the intermediate transferring member cleaning unit 17.

The sheet (recording paper) on which the color image is transferred and formed is taken out by the secondary transferring unit 22 and sent out to the fixing unit 25 in order to fix the synthesized color image (color transfer image) onto the sheet (recording paper) under the thermal pressure. Triggered by the switch claw 55, the sheet (recording paper) is discharged by the discharge roller 56 and stacked on the discharge tray 57. Alternatively, triggered by the switch claw 55, the sheet is inverted by the sheet inversion unit 28 and led to the transfer position again. After recording an image on the back side, the sheet is then discharged by the discharge roller 56 and stacked on the discharge tray 57.

The image forming method and image forming apparatus of the invention can produce high quality images efficiently since the method and apparatus uses the toner of the invention which corresponds to a low-temperature fixing system, is excellent in both of offset resistance and anti-heat preservability and especially, even after a large number of copies are to be produced over a long period, the toner does not aggregate to each other, deterioration of flowability, transferability, and fixing ability is extremely rare, the toner makes it possible to form stable images on any transferring medium without transfer errors and with good reproducibility, and further does not contaminate fixing unit and images.

Herein below, with referring to Examples, the invention is explained in detail and the following Examples should not be construed as limiting the scope of this invention. All "parts" and "%" are expressed by mass unless indicated otherwise.

EXAMPLE A-1

—Synthesis of Organic Particle Emulsion—

To a reaction vessel provided with stirrer and thermometer, 683 parts of water, 11 parts of sodium salt of sulfuric acid ester of methacrylic acid ethylene oxide adduct (ELEMINOL RS-30 by Sanyo Chemical Industries, Ltd.), 83 parts of styrene, 83 parts of methacrylic acid, 110 parts of butyl acrylate and 1 part of ammonium persulphate were introduced, and stirred at 400 rpm for 15 minutes to give a white emulsion. This was heated, the temperature in the system was raised to 75° C. and the reaction was performed for 5 hours. Next, 30 parts of an aqueous solution of 1% ammonium persulphate was added, and the reaction mixture was matured at 75° C. for 5 hours to obtain an aqueous dispersion of a vinyl resin (copolymer of styrene-methacrylic acid-butyl acrylate-sodium salt of sulfuric acid ester of methacrylic acid ethylene oxide adduct). This is referred to as "particle dispersion 1".

The volume average particle diameter of particles contained in the "particle dispersion 1" measured by the particle size distribution measuring apparatus (LA-920 by Horiba Ltd.) in which laser light scattering technique is adopted was 105 nm. After drying a part of the "particle dispersion 1", the resin was isolated. The glass-transition temperature, Tg of the resin was 59° C. and the average molecular mass, Mw was 150,000.

—Preparation of Aqueous Phase—

To 990 parts of water, 80 parts of the "particle dispersion 1," 37 parts of 48.5% aqueous solution of sodium dodecyl diphenylether disulfonic acid (ELEMINOL MON-7 by Sanyo Chemical Industries, Ltd.) and 90 parts of ethyl acetate were mixed and stirred together to obtain a milky liquid. This is referred to as "aqueous phase 1."

—Production of Low Molecular Mass Polyester—

In a reaction vessel equipped with condenser tube, stirrer, and nitrogen inlet tube, 670 parts of bisphenol A ethylene oxide dimolar adduct and 335 parts of terephthalic acid were placed, and subjected to polycondensation under normal pressure at 210° C. for 10 hours. Thereafter, reaction was performed under a reduced pressure of 10 mmHg to 15 mmHg for 5 hours and then cooled to 160° C. Then 46 parts of phthalic anhydride was introduced into the reaction vessel and the reaction was performed for 2 hours to obtain "low molecular mass polyester 1".

The "low molecular mass polyester 1" had a glass-transition temperature, Tg, of 43.7° C., average molecular mass, Mw, of 6,700, number average molecular mass of 3,300 and acid value of 4.4.

—Synthesis of Prepolymer—

In a reaction vessel equipped with condenser tube, stirrer, and nitrogen inlet tube, 410 parts by mass of "low molecular mass polyester 1", 89 parts of isophorone diisocyanate and 500 parts by mass of ethyl acetate were introduced, and the reaction was performed at 100° C. for 5 hours to synthesize addition products. In this way, "prepolymer 1" was synthesized.

—Synthesis of Ketimine—

Into a reaction vessel equipped with stirrer and thermometer, 170 parts of isohorone diamine and 75 parts of methyl ethyl ketone were introduced, and the reaction was performed at 50° C. for 5 hours to obtain blocked amine. This is referred to as "ketimine compound 1". The amine value of "ketimine compound 1" was 418.

—Preparation of Masterbatch—

40 parts of carbon black (REGAL 400R by Cabot Corporation), 60 parts of polyester resin (RS801 by Sanyo Chemical Industries, Ltd.) and 30 parts of water were added and mixed in HENSCHEL MIXER (by Mitsui Mining. Then the mixture was kneaded at 150° C. for 30 minutes using two rollers, and subjected to rolling-cooling and crushed with a pulverizer to obtain carbon black masterbatch. This is referred to as "masterbatch 1".

—Preparation of Oil Phase—

400 parts of "low molecular mass polyester 1", 110 parts of carnauva wax and 947 parts of ethyl acetate were introduced into a reaction vessel provided with stirrer and thermometer, and the temperature was raised to 80° C. with stirring, maintained at 80° C. for 5 hours, and cooled to 30° C. over 1 hour. Next, 500 parts of "masterbatch 1" and 500 parts of ethyl acetate were introduced into the reaction vessel and mixed for 1 hour to obtain a lysate. This is referred to as "raw material solution 1".

1,324 parts of "raw material solution 1" were transferred to a reaction vessel and wax was dispersed using a bead mill (Ultra Visco Mill by Aimex Co., Ltd.) under the condition of liquid feed rate 1 kg/hr, disk circumferential speed 6 m/sec, 0.5 mm zirconia beads packed to 80% by volume and 3 passes.

Next, 1,324 parts of 65% ethyl acetate solution of the "low molecular mass polyester 1" was added and dispersed in 1 pass by the bead mill under the aforesaid condition to obtain a dispersion. This is referred to as "pigment/wax dispersion 1".

—Emulsification—

1772 parts of "pigment/wax dispersion 1", 100 parts of 50% ethyl acetate solution of "prepolymer 1" (number average molecular mass (Mn) 3,800, average molecular mass (Mw) 15,000, glass-transition temperature (Tg) 60° C., acid value 0.5, hydroxyl value 51, and the content of free isocyanate was 1.53% by mass), and 8.5 parts of "ketimine compound 1" were placed in a reaction vessel and mixed at 5,000 rpm for 1 minute using TK homomixer by Tokushu Kika Kogyo Co., Ltd. Then 1,200 parts of "aqueous phase 1" were added to the reaction vessel and mixed in the TK homomixer at a rotation speed of 10,000 rpm for 20 minutes to obtain an aqueous medium dispersion. This is referred to as "emulsion slurry 1".

—Organic Solvent Removal—

The "Emulsion slurry 1" was placed in a reaction vessel equipped with stirrer and thermometer, then the solvent was removed at 30° C. for 8 hours and the product was matured at 45° C. for 4 hours to obtain dispersion of which organic solvent is removed. This is referred to as "dispersion slurry 1."

—Rinsing and Drying—

After filtering 100 parts of "dispersion slurry 1" under the reduced pressure, rinsing and drying processes were performed by following procedures.

(1) 100 parts of ion exchange water were added to the filter cake and mixed in a TK homomixer at a rotation speed of 12,000 rpm for 10 minutes and filtered.

(2) 100 parts of 10% sodium hydroxide solution were added to the filter cake of (1) and mixed in a TK homomixer at a rotation speed of 12,000 rpm for 30 minutes and filtered under the reduced pressure.

(3) 100 parts of 10% hydrochloric acid were added to the filter cake of (2) and mixed in a TK homomixer at a rotation speed of 12,000 rpm for 10 minutes and filtered.

(4) 300 parts of ion exchange water were added to the filter cake of (3) and mixed in a TK homomixer at a rotation speed of 12,000 rpm for 10 minutes and filtered twice to obtain a filter cake.

The filter cake was then dried in a circulating air dryer at 45° C. for 48 hours, and sieved through a sieve of 75 μm mesh to obtain a toner-base particle. This is referred to as "toner-base particle 1".

—Mixture of External Additive 100 parts by mass of "toner—base particle 1", obtained as described above, 1.0 part by mass of hydrophobized silica (HDK H2000, by Clariant (Japan) K. K.) as an external additive, and 0.5 parts by mass of hydrophobized titanium oxide (MT-150AFM, by Tayca Corporation) were mixed in HENSCHEL MIXER, and allowed to pass through a sieve of 38 μm mesh to remove coagulation. Thus, toner was obtained. This is referred to as "toner 1".

<Results of Toner Evaluation>

For the obtained "toner 1", volume average particle diameter (Dv), particle size distribution (Dv/Dn), average circularity, ½ flown-out temperature Tma, ½ flown-out temperature after melt kneading of toner Tmb, difference between Tma and Tmb, ΔTm, gel content, molecular mass peak, and glass-transition temperature (Tg) were measured as follows. Results are shown in Table 2.

<Volume Average Particle Diameter (Dv) and Particle Size Distribution (Dv/Dn)>

The volume average particle diameter and particle size distribution of a toner at an aperture diameter of 100 μm was measured using a particle size meter, Coulter Counter TA-II by Coulter Electronics Ltd. And the figure of volume average particle diameter/number average particle diameter was calculated based on these results.

<Average Circularity>

The average circularity of the toner was measured by a flow type particle image analyzer, FPIA-2100 by Sysmex Corporation. Specifically, the measurement was performed by adding 0.1 ml to 0.5 ml of alkylbenzene sulfonate surfactant as a dispersing agent to 100 ml to 150 ml of water from which solid impurities had been removed in advance, in a container, and then 0.1 g to 0.5 g of each toner was added and dispersed. The dispersion was subjected to dispersion treatment for 1 minute to 3 minutes using an ultrasonic disperser by Honda Electronics, and the toner shapes and distribution were measured by the above apparatus at a dispersion concentration of 3,000/μl to 10,000/μl and the average circularity was calculated from the result above.

<½ Flown-Out Temperature, Tma, ½ Flown-Out Temperature After Melt-Kneading of Toner, Difference Between Tma, and Tmb ΔTm>

The ½ flown-out temperature of toner was measured using a capillary type flow tester (CFT-500C, by Shimadzu Corporation) under the conditions of Load 30 kg, Die diameter 1 mm, Temperature rising rate 3° C./min.

The toner was melt-kneaded by batch type kneading using a Labo Plastomill 4C 150 type (by Toyo Seiki Seisaku-sho, Ltd.). The toner amount was 45 g, heating temperature 130° C., rotation number 50 rpm, and kneading time 15 minutes.

<Gel Content>

The gel content was measured as follows. 1 g of toner was weighed, to this, 100 g of tetrahydrofuran (THF) was added, and left at 10° C. for 20 hours to 30 hours. After 20 hours to 30 hours, gel fraction, THF insoluble components, absorbed THF as a solvent, and swelled to precipitate, and then this was separated with a filter paper. Separated gel fraction was heated at 120° C. for 3 hours, absorbed THF was volatilized, and then mass was weighed. Thus, gel fraction was measured.

<Molecular Mass Peak>

Molecular mass peak of the toner was measured as follows. The column inside the heat chamber of 40° C. was stabilized. At this temperature, THF as a column solvent was drained at a current speed of 1 ml/minute and 50 μl to 200 μl of THF sample fluid whereof a sample density was adjusted to 0.05% by mass to 0.6% by mass, was poured and measured. In the measurement of molecular mass of the sample, a molecular mass distribution of the sample was calculated from the relationship between log values of the analytical curve made from several monodisperse polystyrene standard samples and counted numbers. The standard polystyrene sample for making analytical curves was the one with a molecular mass of $6\times10^2$, $2.1\times10^2$, $4\times10^2$, $1.75\times10^4$, $5.1\times10^4$, $1.1\times10^5$, $3.9\times10^5$, $8.6\times10^5$, $2\times10^6$ and $4.48\times10^6$ by Tosoh Corporation. A refractive index (RI) detector was used for the detector.

<Glass-Transition Temperature (Tg)>

The glass-transition temperature can be measured using TG-DSC system TAS-100 (available from Rigaku Denki Co., Ltd.) according to the following method. Initially, about 10 mg of toner is placed in an aluminum sample vessel. The vessel is placed on a holder unit, which is then set in an electric furnace. The sample is heated from room temperature to 150° C. at a temperature rising rate of 10° C./min. After being allowed to stand at 150° C. for 10 minutes, the sample is cooled to room temperature and allowed to stand for 10 minutes. Then, in a nitrogen flow, DSC measurement is carried out using a differential scanning calorimeter (DSC) while heating the sample to 150° C. at a temperature rising rate of 10° C./min. Glass-transition temperature (Tg) is determined using the analyzing system of the TG-DSC system TAS-100 system as a temperature at the intersection of the base line and a tangential line of the endothermic curve near the glass-transition temperature (Tg).

EXAMPLE A-2

"toner 2" was produced in the same way as in Example A-1, except that, in Example A-1, "low molecular mass polyester 1" was changed to "low molecular mass polyester 2" having characteristics shown in Table 1.

For the obtained toner, characteristics of toner were measured in the Same way as in Example a-1. Results are shown in table 2.

COMPARATIVE EXAMPLE A-1

"toner 3" was produced in the same way as in Example A-1, except that, in Example A-1, "low molecular mass polyester 1" was changed to "low molecular mass polyester 3" having characteristics shown in Table 1 and the amount of "ketimine compound 1" added was changed to 10.3 parts.

For the obtained toner, characteristics of toner were measured in the same way as in Example A-1. Results are shown in Table 2.

COMPARATIVE EXAMPLE A-2

"toner 4" was produced in the same way as in Example A-1, except that, in Example A-1, "low molecular mass polyester 1" was changed to "low molecular mass polyester 3" having characteristics shown in Table 1 and the amount of "ketimine compound 1" added was changed to 10.3 parts.

For the obtained toner, characteristics of toner were measured in the same way as in Example A-1. Results are shown in Table 2.

COMPARATIVE EXAMPLE A-3

"toner 5" was obtained in the same way as in Example A-1, except that, in Example A-1, "low molecular mass polyester 1" was changed to "low molecular mass polyester 3" having characteristics shown in Table 1 and the amount of "ketimine compound 1" added was changed to 4.2 parts.

For the obtained toner, characteristics of toner were measured in the same way as in Example A-1. Results are shown in Table 2.

EXAMPLE A-3

"toner 6" was produced in the same way as in Example A-1, except that, in Example A-1, "low molecular mass polyester 1" was changed to "low molecular mass polyester 4" having characteristics shown in Table 1.

For the obtained toner, characteristics of toner were measured in the same way as in Example A-1. Results are shown in Table 2.

EXAMPLE A-4

"toner 7" was produced in the same way as in Example A-1, except that, in Example A-1, "low molecular mass polyester 1" was changed to "low molecular mass polyester 4" having characteristics shown in Table 1, in the emulsification process, the amount of "pigment/wax dispersion 1" added and the amount of 50% ethyl acetate solution of "prepolymer 1" added were changed to 1610 parts and 231 parts, respectively.

For the obtained toner, characteristics of toner were measured in the same way as in Example A-1. Results are shown in Table 2.

EXAMPLE A-5

"toner 8" was produced in the same way as in Example A-1, except that, in Example A-1, "low molecular mass polyester 1" was changed to "low molecular mass polyester 5" having characteristics shown in Table 1, in the emulsification process, the amount of "pigment/wax dispersion 1" added and the amount of 50% ethyl acetate solution of "prepolymer 1" added were changed to 1705 parts and 154 parts, respectively.

For the obtained toner, characteristics of toner were measured in the same way as in Example A-1. Results are shown in Table 2.

EXAMPLE A-6

"toner 9" was produced in the same way as in Example A-1, except that, in Example A-1, "low molecular mass polyester 1" was changed to "low molecular mass polyester 5" having characteristics shown in Table 1, in the emulsification process, the amount of "pigment/wax dispersion 1" added and the amount of 50% ethyl acetate solution of "prepolymer 1" added were changed to 1610 parts and 231 parts, respectively, and in the preparation of aqueous phase, the amount of 48.5% aqueous solution of sodium dodecyl diphenylether disulfonic acid added was changed to 58 parts.

For the obtained toner, characteristics of toner were measured in the same way as in Example A-1. Results are shown in Table 2.

EXAMPLE A-7

"toner 10" was produced in the same way as in Example A-1, except that, in Example A-1, "low molecular mass polyester 1" was changed to "low molecular mass polyester 5" having characteristics shown in Table 1, in the emulsification process, the amount of "pigment/wax dispersion 1" added and the amount of 50% ethyl acetate solution of "prepolymer 1" added were changed to 1516 parts and 308 parts, respectively, and in the preparation of aqueous phase, the amount of 48.5% aqueous solution of sodium dodecyl diphenylether disulfonic acid added was changed to 58 parts, further 28 parts of 3.0% aqueous solution of polymeric protective colloid carboxymethylcellulose (Celogen BSH by Sanyo Chemical Industries, Ltd.) was added in an aqueous phase.

For the obtained toner, characteristics of toner were measured in the same way as in Example A-1. Results are shown in Table 2.

EXAMPLE A-8

"toner 11" was obtained in the same way as in Example A-1, except that, in Example A-1, "low molecular mass polyester 1" was changed to "low molecular mass polyester 6" having characteristics shown in Table 1 and the amount of "ketimine compound 1" added was changed to 10.3 parts, in the emulsification process, the amount of "pigment/wax dispersion 1" added and the amount of 50% ethyl acetate solution of "prepolymer 1" added were changed to 1762 parts and 108 parts, respectively.

For the obtained toner, characteristics of toner were measured in the same way as in Example A-1. Results are shown in Table 2.

EXAMPLE A-9

"toner 12" was produced in the same way as in Example A-1, except that, "low molecular mass polyester 1" described in Example A-1 was changed to "low molecular mass polyester 6" having characteristics shown in Table 1 and the amount of "ketimine compound 1" added was changed to 6.5 parts, in the emulsification process, the amount of "pigment/wax dispersion 1" added and the amount of 50% ethyl acetate solution of "prepolymer 1" added were changed to 1781 parts and 92 parts, respectively.

For the obtained toner, characteristics of toner were measured in the same way as in Example A-1. Results are shown in Table 2.

EXAMPLE A-10

"toner 13" was produced in the same way as in Example A-1, except that, in Example A-1, "low molecular mass polyester 1" was changed to "low molecular mass polyester 5" having characteristics shown in Table 1, in the emulsification process, the amount of "pigment/wax dispersion 1" added and the amount of 50% ethyl acetate solution of "prepolymer 1" added were changed to 1705 parts and 154 parts, respectively, and in the preparation of aqueous phase, the amount of 48.5% aqueous solution of sodium dodecyl diphenylether disulfonic acid added was changed to 58 parts, further 28 parts of 3.0% aqueous solution of carboxymethylcellulose as a polymeric protective colloid was added in an aqueous phase.

For the obtained toner, characteristics of toner were measured in the same way as in Example A-1. Results are shown in Table 2.

EXAMPLE A-11

Toner was evaluated in the same way as in Example A-1, except that, in Example A-10, evaluation machine B was used as an evaluation machine for use in the evaluation of characteristics of toner. Results are shown in Table 2.

TABLE 1

| | Characteristics of low molecular mass polyester used | | | | |
|---|---|---|---|---|---|
| | Polyester | Number average molecular mass | Average molecular mass | Tg (° C.) | Acid value (mgKOH/g) |
| Toner 1 | low molecular mass polyester 1 | 3,300 | 6,700 | 43.7 | 4.4 |
| Toner 2 | low molecular mass polyester 2 | 6,600 | 23,100 | 67.2 | 12.7 |
| Toner 3 | low molecular mass polyester 3 | 2,700 | 4,000 | 39.7 | 4.4 |
| Toner 4 | low molecular mass polyester 3 | 2,700 | 4,000 | 39.7 | 4.4 |
| Toner 5 | low molecular mass polyester 3 | 2,700 | 4,000 | 39.7 | 4.4 |
| Toner 6 | low molecular mass polyester 4 | 4,200 | 6,900 | 43.8 | 15.8 |
| Toner 7 | low molecular mass polyester 4 | 4,200 | 6,900 | 43.8 | 15.8 |
| Toner 8 | low molecular mass polyester 5 | 9,800 | 21,500 | 55.3 | 22.3 |
| Toner 9 | low molecular mass polyester 5 | 9,800 | 21,500 | 55.3 | 22.3 |
| Toner 10 | low molecular mass polyester 5 | 9,800 | 21,500 | 55.3 | 22.3 |
| Toner 11 | low molecular mass polyester 6 | 3,500 | 7,100 | 44.6 | 3.5 |
| Toner 12 | low molecular mass polyester 6 | 3,500 | 7,100 | 44.6 | 3.5 |
| Toner 13 | low molecular mass polyester 5 | 9,800 | 21,500 | 55.3 | 22.3 |

TABLE 2

| | Characteristics of toner | | | | | | | | |
|---|---|---|---|---|---|---|---|---|---|
| | Volume average particle diameter Dv (μm) | Dv/Dn | Average circularity | Tma (° C.) | Tmb (° C.) | ⊿Tm (° C.) | Gel content (% by mass) | Average molecular mass peak | Tg (° C.) |
| Toner 1 | 7.2 | 1.28 | 0.92 | 132.8 | 117.7 | 15.1 | 6.2 | 4,800 | 45.6 |
| Toner 2 | 7.2 | 1.27 | 0.92 | 195.7 | 182.0 | 13.7 | 6.7 | 20,100 | 68.8 |
| Toner 3 | 7.3 | 1.28 | 0.91 | 125.1 | 103.8 | 21.3 | 6.8 | 3,900 | 43.2 |
| Toner 4 | 7.2 | 1.28 | 0.92 | 153.0 | 124.4 | 28.6 | 8.7 | 6,800 | 52.8 |
| Toner 5 | 7.3 | 1.28 | 0.92 | 120.1 | 118.7 | 1.4 | 6.7 | 4,500 | 43.4 |
| Toner 6 | 7.3 | 1.27 | 0.91 | 137.2 | 126.6 | 10.6 | 7.4 | 4,600 | 46.5 |
| Toner 7 | 7.3 | 1.27 | 0.91 | 137.2 | 126.6 | 10.6 | 14.8 | 4,600 | 51.1 |
| Toner 8 | 7.5 | 1.30 | 0.91 | 168.1 | 155.5 | 12.6 | 10.9 | 18,000 | 58.2 |
| Toner 9 | 5.5 | 1.15 | 0.92 | 155.5 | 155.4 | 0.1 | 18.7 | 17,600 | 61.1 |
| Toner 10 | 6.4 | 1.19 | 0.97 | 159.6 | 158.3 | 1.3 | 21.1 | 19,300 | 63.3 |
| Toner 11 | 7.4 | 1.29 | 0.91 | 135.3 | 115.8 | 19.5 | 7.3 | 7,500 | 47.3 |
| Toner 12 | 7.2 | 1.27 | 0.92 | 136.6 | 129.8 | 6.8 | 6.0 | 7,100 | 46.0 |
| Toner 13 | 5.6 | 1.15 | 0.98 | 166.8 | 151.9 | 14.9 | 8.9 | 12,200 | 55.1 |

<Preparation of Two-Component Developer>

Next, when each of the obtained toners of Examples and Comparative Examples was evaluated for image quality, etc. of a reproduced image, performance of toner was evaluated as a two-component developer.

The carrier for use in the two-component developer was ferrite carrier having an average particle diameter of 35 μm, coated with silicone resin with an average thickness of 0.5 μm and 7 parts by mass of toner was uniformly mixed to 100 parts by mass of the carrier and charged by a tubular mixer of which the container is rolled for agitation to prepare developer.

The carrier was prepared as follows. 5,000 parts of Mn ferrite particle (mass average particle diameter: 35 μm) was used as a core material and a coating solution was prepared by dispersing 450 parts of toluene, 450 parts of silicone resin SR2400 (by Dow Corning Toray Silicone Co., Ltd., non-volatile portion 50%), 10 parts of aminosilane SH6020 (by Dow Corning Ibray Silicone Co., Ltd.) and 10 parts of carbon black, that are coating material, were dispersed with a stirrer for 10 minutes to prepare a coating liquid. The core material and the coating liquid were poured into a coating apparatus equipped with a rotating base plate disk and stirring blades in a fluidized bed, in which coating is conducted while forming a whirling flow, and the coating liquid was applied onto the core material. The coated material was then baked in an electric oven at 250° C. for 2 hours to prepare the above-mentioned carrier.

<Machine for Evaluating Image Quality of Reproduced Image>

Each developer obtained in Examples and Comparative Examples was evaluated with the following evaluation machines. Specifically, a full-color laser printer IPSiO 8000, by Ricoh Company, Ltd., which adopts a method in which four color developing sections develop each color sequentially on one belt photoconductor, transferred to an intermediate transferring member sequentially, and four colors are transferred together to paper, etc., was modified so that a contact charger, amorphous silicon photoconductor, oilless surf fixing device are provided, and a vibration bias voltage comprising a DC voltage superimposed on an AC voltage is applied as a developing bias. Further modified machines, "evaluation machine A" comprising the photoconductor, charger, developing unit, and cleaning unit integrally as a process cartridge and "evaluation machine B" were used for evaluation. "evaluation machine B" was a modified "evaluation machine A" such that the fixing unit of the evaluation machine A was modified to an oilless IH fixing unit. In these Examples and Comparative Examples, same developer was supplied in each of four color developing sections, and images, etc. were evaluated in a single-color mode.

<Evaluation Item>

Performance of developers obtained in the Examples and Comparative Examples were evaluated for the following items. Results are shown in Table 3.

(1) Image Graininess and Fineness

Using the evaluation machine A or B, a photographic image was output by running 10,000 copies in a single-color mode, and the degree of graininess and fineness were observed with eyes and evaluated in accordance with the standards shown below.

[Evaluation Standards]

When the degree was comparable to offset printing, it is described as A, when slightly inferior to offset printing, as B, when slightly superior to conventional electrophotographic images, as C, when same degree as conventional electrophotographic images, as D, and when inferior to conventional electrophotographic images, as E.

(2) Reproducibility of Thin Line

After outputting 30,000 copies of an image chart in a single-color mode with an image occupancy of 50% as running output using the evaluation machine A or B, thin line image having 600 dpi was produced on the paper type 6000 by Ricoh Company, Ltd. The degree of blur of the thin line was compared with a grade sample, and evaluated on five levels, ranks 1 to 5.

[Evaluation Standards]

Rank 5 is the most excellent in reproducibility of thin line, and Rank 1 is poorest. Ranks 5,4,3,2, and 1 are displayed as A,B,C,D, and E, respectively.

(3) Dropout in Letter Image

After outputting 30,000 copies of an image chart in a single-color mode with an image occupancy of 50% as running output using the evaluation machine A or evaluation machine B, letter image was produced on the OHP sheet type DX by Ricoh Company, Ltd. Frequency of dropout in thin line image of letter, i.e., untransfer of toner was compared with a grade sample, and evaluated on five levels, ranks 1 to 5 below.

[Evaluation Standards]

When dropout occurred least, it was evaluated as Rank 5, and when dropout occurred most, it was evaluated as Rank 1. Ranks 5,4,3,2, and 1 are displayed as A,B,C,D, and E, respectively.

(4) Hot Offset Resistance and Fixing Property at Low Temperatures

Using the evaluation machine A or evaluation machine B, solid images were produced at a toner adhesive amount of 0.85±0.1 mg/cm$^2$ on the transfer paper of a standard paper and thick paper (type 6200 by Ricoh Company, Ltd. and Copy Paper 135 by NBS Ricoh Co. Ltd.), and fixing performance was evaluated. Fixing test was carried out by varying the temperature of a fixing belt, and upper limit temperature at which hot offset does not occur in the standard paper was defined as highest fixing temperature. In addition, lowest fixing temperature was measured using the thick paper. The lowest fixing temperature was determined as follows: obtained fixed image was subjected to drawing by means of a drawing tester at a load of 50 g and temperature of the fixing roller at which images are hardly scratched was defined as lowest fixing temperature. The highest fixing temperature (hot offset resistance) and lowest fixing temperature (fixing property at low temperatures) are displayed.

(5) Small Amount of Offset

After outputting 10,000 copies of an image chart in a single-color mode with an image occupancy of 50% as running output using a tuned evaluation machine in which a jig with a cloth was arranged on the fixing belt of evaluation machine A or B so that the cloth was brought into contact with the fixing belt was used, smear on the cloth was compared with a grade sample, and evaluated on five levels, ranks 1 to 5 below. When small amount of offset was hardly observed, it was evaluated as Rank 5, and when small amount of offset was observed greatest, it was evaluated as Rank 1

[Evaluation Standards]

Ranks 5,4,3,2, and 1 are displayed as A,B,C,D, and E, respectively.

(6) Anti-Heat Preservability 10 g of each toner was weighed and placed in a 20 ml of glass container. The glass bottles were tapped 100 times and left for 24 hours in a thermostat set to a temperature of 50° C. and a humidity of 80%. Then, the penetration was measured with a penetration meter according to the following standards.

[Evaluation Standards]

Starting from good penetration, A: 30 mm or more, B: 20 mm to 29 mm, C: 15 mm to 19 mm, D: 8 mm to 14 mm, E: 7 mm or less.

(7) Toner Spent Property

After outputting 30,000 copies of an image chart in a single-color mode with an image occupancy of 50% as running output using the evaluation machine A or B, 2 g of developer was subjected to air blow and tone was removed. 1 g of remaining carrier and 10 g of methylethylketone were placed in a 20 ml of glass container, and shaken vigorously with hands 50 times. After the glass container was left to stand completely, supernatant solution was put in a glass cell, the transmittance was measured by a fully automatic haze computer (HGM-200P by Suga Tester Co., Ltd.) and evaluated according to the following standards.

[Evaluation Standards]

Starting from good transmittance, A: 90% or more, B: 75% to 89%, C: 60% to 74%, D: 45% to 59%, E: 44% or less.

The "resin fine particle dispersion 1" was measured by the particle size distribution measuring apparatus (LA-920 by Horiba Ltd.) in which laser light scattering technique is adopted, and the volume average particle diameter was 90 nm. After drying a part of the "resin fine particle dispersion 1", the resin was isolated. The glass-transition temperature, Tg of the resin was 57° C. and the average molecular mass, Mw was 200,000.

—Preparation of Aqueous Phase—

To 990 parts of water, 83 parts of the "resin fine particle dispersion 1", 37 parts of 48.5% aqueous solution of sodium dodecyl diphenylether disulfonic acid (ELEMINOL MON-7 by Sanyo Chemical Industries, Ltd.) and 90 parts of ethyl acetate were mixed and stirred together to obtain a milky liquid. This is referred to as "aqueous phase 1."

—Production of Unmodified Polyester—

In a reaction vessel equipped with condenser tube, stirrer, and nitrogen inlet tube, 770 parts of bisphenol A ethylene oxide dimolar adduct and 220 parts of terephthalic acid were placed, and subjected to polycondensation under normal pressure at 210° C. for 10 hours. Thereafter, reaction was performed under a reduced pressure of 10 mmHg to 15 mmHg for 5 hours and then cooled to 160° C. Then 18 parts of phthalic anhydride was introduced into the reaction vessel and the reaction was performed for 2 hours to obtain "unmodified polyester a".

TABLE 3

| | Toner | Evaluation machine | Image graininess and fineness | Reproducibility of thin line | Dropout in letter image | Lowest fixing temperature (° C.) | Highest fixing temperature (° C.) | Small amount of offset | Anti-heat preservability | Toner spent property |
|---|---|---|---|---|---|---|---|---|---|---|
| Example A-1 | Toner 1 | A | B | C | C | 140 | 210< | B | B | A |
| Example A-2 | Toner 2 | A | B | C | C | 145 | 210< | A | A | A |
| Comp. Example A-1 | Toner 3 | A | B | D | C | 140 | 175 | E | E | B |
| Comp. Example A-2 | Toner 4 | A | B | C | C | 145 | 180 | E | D | A |
| Comp. Example A-3 | Toner 5 | A | B | D | C | 140 | 170 | E | E | E |
| Example A-3 | Toner 6 | A | B | B | B | 130 | 210< | B | B | B |
| Example A-4 | Toner 7 | A | B | B | B | 135 | 210< | A | A | A |
| Example A-5 | Toner 8 | A | B | B | B | 130 | 210< | A | A | A |
| Example A-6 | Toner 9 | A | A | A | B | 125 | 210< | A | A | D |
| Example A-7 | Toner 10 | A | A | A | A | 125 | 210< | A | A | D |
| Example A-8 | Toner 11 | A | B | C | C | 140 | 210< | B | B | A |
| Example A-9 | Toner 12 | A | B | C | C | 140 | 210< | B | B | B |
| Example A-10 | Toner 13 | A | A | A | A | 125 | 210< | A | A | A |
| Example A-11 | Toner 13 | B | A | A | A | 125 | 210< | A | A | A |

EXAMPLE B-1

—Synthesis of Resin Fine Particle Emulsion—

To a reaction vessel provided with stirrer and thermometer, 838 parts of water, 11 parts of sodium salt of sulfuric acid ester of methacrylic acid ethylene oxide adduct (ELEMINOL RS-30 by Sanyo Chemical Industries, Ltd.), 73 parts of styrene, 92 parts of methacrylic acid, 130 parts of butyl acrylate and 1 part of ammonium persulphate were introduced, and stirred at 400 rpm for 15 minutes to give a white emulsion. This was heated, the temperature in the system was raised to 75° C. and the reaction was performed for 5 hours. Next, 30 parts of an aqueous solution of 1% ammonium persulphate was added, and the reaction mixture was matured at 75° C. for 5 hours to obtain an aqueous dispersion of a vinyl resin (copolymer of styrene-methacrylic acid-butyl acrylate-sodium salt of sulfuric acid ester of methacrylic acid ethylene oxide adduct), "resin fine particle dispersion 1".

The "unmodified polyester a" had a glass-transition temperature, Tg of 42° C., average molecular mass of 28,000, peak top of 3,500 and acid value of 15.3.

—Production of Prepolymer—

In a reaction vessel equipped with condenser tube, stirrer, and nitrogen inlet tube, 640 parts of bisphenol A ethyleneoxide dimole adduct, 274 parts of isophthalic acid, 20 parts of trimellitic anhydride and 2 parts of dibutyl tin oxide were placed, and the reaction was performed under normal pressure at 230° C. for 8 hours. Further, the reaction was performed with dehydrating under a reduced pressure of 10 mmHg to 15 mmHg for 5 hours and then cooled to 160° C. To this, 32 parts of phthalic anhydride was added, and allowed to react for 2 hours. Next, this was cooled to 80° C. and allowed to react with 155 parts of isophorone diisocyanate in ethyl acetate for 2 hours to obtain "isocyanate-group-containing prepolymer 1".

—Synthesis of Ketimine Compound—

Into a reaction vessel equipped with stirrer and thermometer, 30 parts of isohorone diamine and 70 parts of methyl ethyl ketone were introduced, and the reaction was performed at 50° C. for 5 hours to obtain "ketimine compound 1".

—Preparation of Masterbatch (MB)—

1,200 parts of water, 540 parts of carbon black (Printex 35 by Degussa AG) [DBP oil absorption amount=42 ml/100 mg, pH=9.5] and 1,200 parts of polyester resin were added and mixed by means of a pressure kneader. Then the mixture was kneaded at 150° C. for 30 minutes using two rollers, and subjected to rolling-cooling and crushed with a pulverizer to obtain carbon black masterbatch. This is referred to as "masterbatch 1".

—Preparation of Oil Phase—

378 parts of "unmodified polyester a", 55 parts of carnauba wax and 947 parts of ethyl acetate were introduced into a reaction vessel provided with stirrer and thermometer, and the temperature was raised to 80° C. with stirring, maintained at 80° C. for 5 hours, and cooled to 30° C. over 1 hour. Next, 500 parts of "masterbatch 1" and 500 parts of ethyl acetate were introduced into the reaction vessel and mixed for 1 hour to obtain "raw material solution 1".

1,324 parts of "raw material solution 1" were transferred to the reaction vessel and carbon black and wax were dispersed using a bead mill (Ultra Visco Mill by Aimex Co., Ltd.) under the condition of liquid feed rate 1 kg/hr, disk circumferential speed 6 m/sec, 0.5 mm zirconia beads packed to 80% by volume and 3 passes.

Next, 1,324 parts of 65% ethyl acetate solution of the "unmodified polyester a" was added and dispersed in 3 passes by the bead mill under the aforesaid condition to obtain "pigment/wax dispersion 1".

—Emulsification—

749 parts of "pigment/wax dispersion 1", 115 parts of "isocyanate-group-containing prepolymer 1", and 2.9 parts of "ketimine compound 1" were placed in a reaction vessel and mixed in a TK homomixer by Tokushu Kika Kogyo Co., Ltd. at 5,000 rpm for 1 minute. Then 1,000 parts of "aqueous phase 1" were added to the reaction vessel and mixed in the FILLMIX by Tokushu Kika Kogyo Co., Ltd. at a rotation speed of 5,000 rpm for 5 minutes to obtain "emulsion slurry 1". Then, the reaction mixture was matured for 3 hours after emulsification maintaining the liquid temperature at 20° C.±2° C. The particle diameter immediately after emulsification was 2.5 μm, dried products of emulsified liquid was kneaded with Labo Plastomill and ½ flown-out temperature was measured, checking the progress of urea reaction.

Reaction of interest and particle diameter of emulsification were examined and the reaction was stopped when the particle diameter reached 4 μm to 5 μm.

The "emulsion slurry 1" was placed in a reaction vessel equipped with stirrer and thermometer, then the solvent was removed at 30° C. for 8 hours to obtain "dispersion slurry 1."

—Rinsing and Drying—

After filtering 100 parts of "dispersion slurry 1" under the reduced pressure, rinsing and drying processes were performed by following procedures.

(1) 100 parts of ion exchange water were added to the filter cake and mixed in a TK homomixer at a rotation speed of 12,000 rpm for 10 minutes and filtered.

(2) 100 parts of 10% sodium hydroxide solution were added to the filter cake of (1) and mixed in a TK homomixer at a rotation speed of 12,000 rpm for 30 minutes and filtered under the reduced pressure.

(3) 100 parts of 10% hydrochloric acid were added to the filter cake of (2) and mixed in a TK homomixer at a rotation speed of 12,000 rpm for 10 minutes and filtered.

(4) 300 parts of ion exchange water were added to the filter cake of (3) and mixed in a TK homomixer at a rotation speed of 12,000 rpm for 10 minutes and filtered twice to obtain "filter cake 1".

The "filter cake 1" was then dried in a circulating air dryer at 45° C. for 48 hours, and sieved through a sieve of 75 μm mesh to obtain "toner 1".

Next, against the base particle of obtained colored powder, 100 parts of base particle, 0.25 part of charge controlling agent (Bontron E-84 by Orient Chemical Industries, Ltd.) were introduced to a Q-type mixer (by Mitsui Mining Co., Ltd.) and were subjected to a mixing treatment at a turbine blade peripheral speed of 50 m/sec. The mixing was performed 5 cycles each including 2 minute mixing and 1 minute pause (thus, mixing time was 10 minutes in total).

This was further mixed with 0.5 part of hydrophobized silica (H2000 by Clariant (Japan) K. K.). The mixing was performed at a peripheral speed of 15 m/sec and 5 cycles each including 30 second mixing and 1 minute pause to prepare black toner (1).

The properties and evaluation results of thus obtained toner are shown in Tables 4 and 5, respectively. The obtained toner had a circularity of 0.93 and had a spindle shape. FIG. 18 shows a SEM picture of toner.

EXAMPLE B-2

"Toner 2" was obtained in the same way as in Example B-1, except that, in Example B-1, "resin fine particle dispersion 2" synthesized as described below was used in place of "resin fine particle dispersion 1", and black toner (2) was prepared.

The properties and evaluation results of thus obtained toner are shown in Tables 4 and 5, respectively. The obtained toner had a circularity of 0.92 and had a spindle shape. FIG. 18 shows a SEM picture of toner.

—Synthesis of Resin Fine Particle Emulsion—

To a reaction vessel provided with stirrer and thermometer, 683 parts of water, 11 parts of sodium salt of sulfuric acid ester of methacrylic acid ethylene oxide adduct (ELEMINOL RS-30 by Sanyo Chemical Industries, Ltd.), 80 parts of styrene, 83 parts of methacrylic acid, 110 parts of butyl acrylate, 12 parts of butyl thioglycolate, and 1 part of ammonium persulphate were introduced, and stirred at 400 rpm for 15 minutes to give a white emulsion. This was heated, the temperature in the system was raised to 75° C. and the reaction was performed for 5 hours. Next, 30 parts of an aqueous solution of 1% ammonium persulphate was added, and the reaction mixture was matured at 75° C. for 5 hours to obtain an aqueous dispersion of a vinyl resin (copolymer of styrene-methacrylic acid-butyl acrylate-sodium salt of sulfuric acid ester of methacrylic acid ethylene oxide adduct), "resin fine particle dispersion 2".

The "resin fine particle dispersion 2" was measured by the particle size distribution measuring apparatus (LA-920 by Horiba Ltd.) in which laser light scattering technique is adopted, and the volume average particle diameter was 120 nm. After drying a part of the "resin fine particle dispersion 2", the resin was isolated. The glass-transition temperature, Tg, of the resin was 52° C. and the average molecular mass, Mw was 300,000.

EXAMPLE B-3

"Toner 3" was obtained in the same way as in Example B-1, except that, in Example B-1, "resin fine particle dispersion 3" synthesized as described below was used in place of "resin fine particle dispersion 1", and black toner (3) was prepared.

The properties and evaluation results of thus obtained toner are shown in Tables 4 and 5, respectively. The obtained toner had a circularity of 0.91 and had a spindle shape.

—Synthesis of Resin Fine Particle Emulsion—

To a reaction vessel provided with stirrer and thermometer, 760 parts of water, 14 parts of sodium salt of sulfuric acid ester of methacrylic acid ethylene oxide adduct (ELEMINOL RS-30 by Sanyo Chemical Industries, Ltd.), 103 parts of styrene, 83 parts of methacrylic acid, 90 parts of butyl acrylate, 12 parts of butyl thioglycolate, and 1 part of ammonium persulphate were introduced, and stirred at 400 rpm for 15 minutes to give a white emulsion. This was heated, the temperature in the system was raised to 75° C. and the reaction was performed for 5 hours. Next, 30 parts of an aqueous solution of 1% ammonium persulphate was added, and the reaction mixture was matured at 75° C. for 5 hours to obtain an aqueous dispersion of a vinyl resin (copolymer of styrene-methacrylic acid-butyl acrylate-sodium salt of sonic acid ester of methacrylic acid ethylene oxide adduct), "resin fine particle dispersion 3".

The "resin fine particle dispersion 3" was measured by the particle size distribution measuring apparatus (LA-920 by Horiba Ltd.) in which laser light scattering technique is adopted, and the volume average particle diameter was 60 nm. After drying a part of the "resin fine particle dispersion 3", the resin was isolated. The glass-transition temperature, Tg of the resin was 63° C. and the average molecular mass, Mw was 15,000.

EXAMPLE B-4

"Toner 4" was obtained in the same way as in Example B-1, except that, in Example B-1, "resin fine particle dispersion 4" synthesized as described below was used in place of "resin fine particle dispersion 1", and black toner (4) was prepared.

The properties and evaluation results of thus obtained toner are shown in Tables 4 and 5, respectively. The obtained toner had a circularity of 0.95 and had a spindle shape.

—Synthesis of Resin Fine Particle Emulsion—

To a reaction vessel provided with stirrer and thermometer, 683 parts of water, 11 parts of sodium salt of sulfuric acid ester of methacrylic acid ethylene oxide adduct (ELEMINOL RS-30 by Sanyo Chemical Industries, Ltd.), 78 parts of styrene, 83 parts of methacrylic acid, 105 parts of butyl acrylate, 2 parts of butyl thioglycolate, and 1 part of ammonium persulphate were introduced, and stirred at 400 rpm for 15 minutes to give a white emulsion. This was heated, the temperature in the system was raised to 75° C. and the reaction was performed for 5 hours. Next, 30 parts of an aqueous solution of 1% ammonium persulphate was added, and the reaction mixture was matured at 75° C. for 5 hours to obtain an aqueous dispersion of a vinyl resin (copolymer of styrene-methacrylic acid-butyl acrylate-sodium salt of sulfuric acid ester of methacrylic acid ethylene oxide adduct), "resin fine particle dispersion 4".

The "resin fine particle dispersion 4" was measured by the particle size distribution measuring apparatus (LA-920 by Horiba Ltd.) in which laser light scattering technique is adopted, and the volume average particle diameter was 30 μm.

After drying a part of the "resin fine particle dispersion 4", the resin was isolated. The glass-transition temperature, Tg of the resin was 56° C. and the average molecular mass, Mw was 500,000.

EXAMPLE B-5

"Toner 5" was obtained in the same way as in Example B-4, except that, in Example B-4, "unmodified polyester b" synthesized as described below was used in place of "unmodified polyester a", and black toner (5) was prepared.

The properties and evaluation results of thus obtained toner are shown in Tables 4 and 5, respectively. The obtained toner had a circularity of 0.93 and had a spindle shape.

—Production of Unmodified Polyester—

In a reaction vessel equipped with condenser tube, stirrer, and nitrogen inlet tube, 196 parts of bisphenol A propylene oxide dimolar adduct, 553 parts of bisphenol A ethylene oxide dimolar adduct, 210 parts of terephthalic acid, 79 parts of adipic acid and 2 parts of dibutyl tin oxide were placed, and the reaction was performed under normal pressure at 230° C. for 8 hours. Further, reaction was performed under a reduced pressure of 10 mmHg to 15 mmHg for 5 hours. Then 26 parts of trimellitic anhydride was placed in the reaction vessel and the reaction was performed under normal pressure at 180° C. for 2 hours to obtain "unmodified polyester b".

The "unmodified polyester b" had a number average molecular mass (Mn) of 6,200, average molecular mass (Mw) of 36,000, glass-transition temperature (Tg) 33° C., acid value of 15.

COMPARATIVE EXAMPLE B-1

Initially, to 709 g of ion exchange water, 451 g of 0.1M-$Na_3PO_4$ aqueous solution was introduced and heated to 60° C., and then stirred at 12,000 rpm using TK homomixer. To the mixture, 68 g of 1.0M-$CaCl_2$ aqueous solution was gradually added to obtain an aqueous medium containing $Ca_3(PO_4)_2$.

Next, 170 g of styrene, 30 g of 2-ethylhexyl acrylate, 3.4 g of ethylene grycol diacrylate, 10 g of REGAL 400R, 60 g of paraffin wax (s.p. 70° C.), 5 g of di-tert-butyl salicylic acid metal compound, and 10 g of styrene-methacrylic acid copolymer (Average Molecular Mass, (Mw): 50,000; Acid Value: 20 mgKOH/g) were introduced into TK homomixer and was heated to 60° C., uniformly dissolved and dispersed at 12,000 rpm. To the mixture were further added and dissolved 10 g of 2,2'-azobis(2,4-dimethyl valeronitrile) as a polymerization initiator, and thereby prepared polymerizable monomers.

To the aqueous medium were introduced the polymerizable monomers, were mixed in a TK homomixer at 10,000 rpm for 20 minutes in a nitrogen flow, at 60° C. to form particles of the polymerizable monomers. Then, the granulated monomers were subjected to a reaction for 3 hours at 60° C. while stirring with a paddle-stirring blade. Thereafter, the temperature of the liquid was raised to 80° C. and subjected to a further reaction for 10 hours.

After polymerization reaction, the solution was cooled, and hydrochloric acid was added so as to dissolve calcium phosphate therein. The solution was filtered, washed and dried to obtain "comparative toner 1". To the "comparative toner 1" additives were mixed as in Example B-1 to prepare comparative toner (1).

The properties and evaluation results of thus obtained toner are shown in Tables 4 and 5, respectively. The obtained toner had a circularity of 0.97 and had a spherical shape.

COMPARATIVE EXAMPLE B-2

—Preparation of Aqueous Wax Particle Dispersion—

In a 1000 ml four necked flask equipped with stirrer, thermometer, nitrogen inlet tube and condenser tube, 500 ml of deaerated distilled water, 28.5 g of Newcol 565C (by Japan Emulsifier Inc.) and 185.5 g of candelilla wax No. 1 (by Noda Wax Co., Ltd.) were placed. The contents in the flask were then heated with stirring under a nitrogen gas flow and the temperature was raised. At the time of an inside temperature of 85° C., to the mixture 5 N sodium hydroxide solution was added and the temperature was raised to 75° C. Then, the mixture was kept with heating and stirring at 75° C. for 1 hour and then cooled to room temperature to obtain "aqueous wax particle dispersion 1".

—Preparation of Aqueous Colorant Dispersion—

100 g of carbon black (Trade name: Mogal L by Cabot Corporation) and 25 g of sodium dodecylsulfate were added to 540 ml of distilled water and the mixture was stirred sufficiently and then dispersed using a pressurizing disperser (MINI-LAB manufactured by Raney Inc.) to obtain "aqueous colorant dispersion I".

—Preparation of Aqueous Dispersion of High Molecular Mass Binder Fine Particle—

In a 1 L four necked flask equipped with stirrer, condenser tube, thermometer, and nitrogen inlet tube, 480 ml of distilled water, 0.6 g of sodium dodecylsulfate, 106.4 g of styrene, 43.2 g of n-butyl acrylate, and 10.4 g of methacrylic acid were placed and heated with stirring under a nitrogen gas flow to 70° C., to which an aqueous solution of initiator containing 2.1 g of potassium sulfate dissolved in 120 ml of distilled water was added. The mixture was stirred under a nitrogen gas flow at 70° C. for 3 hours. After completion of the polymerization, the reaction mixture was cooled to room temperature to obtain "aqueous dispersion of high molecular mass binder fine particle 1".

—Preparation of Aqueous Dispersion of Low Molecular Mass Binder Fine Particle—

In a 5 L four necked flask equipped with stirrer, condenser tube, thermometer, and nitrogen inlet tube, 2400 ml of distilled water, 2.8 g of sodium dodecylsulfate, 620 g of styrene, 128 g of n-butyl acrylate, 52 g of methacrylic acid, and 27.4 g of tert-dodecylmercaptan were placed and heated with stirring under a nitrogen gas flow to 70° C., to which an aqueous solution of initiator containing 11.2 g of potassium sulfate dissolved in 600 ml of distilled water was added. The mixture was stirred under a nitrogen gas flow at 70° C. for 3 hours. After completion of the polymerization, the reaction mixture was cooled to room temperature to obtain "aqueous dispersion of low molecular mass binder fine particle 2".

In a 1 L separable flask equipped with stirrer, condenser tube, and thermometer, 47.6 g of the "aqueous dispersion of high molecular mass binder fine particle 1", 190.5 g of the "aqueous dispersion of low molecular mass binder fine particle 2", 7.7 g of the "aqueous wax particle dispersion 1", 26.7 g of the "aqueous colorant dispersion 1" and 252.5 ml of distilled water were placed and mixed with stirring, to which a 5 N sodium hydroxide solution was added to adjust the pH of the mixture to 9.5. With stirring, aqueous sodium chloride solution containing 50 g of sodium chloride dissolved in 600 ml of distilled water, 77 ml of isopropanol and an aqueous surfactant solution containing 10 mg of Fluorad FC-170C (by Sumitomo 3M Inc.: fluorine containing nonionic surfactant) dissolved in 10 ml of distilled water were successively added to the flask, inside temperature was raised to 85° C., reacted for 6 hours, and cooled to room temperature. This reaction mixture was mixed with 5 N sodium hydroxide solution so that the pH thereof was adjusted at 13, and then the mixture was filtered. Further, the solids were resuspended in distilled water. After washing by the repeating filtration and resuspension, the solids were dried to obtain "comparative toner 2. To the "comparative toner 2" additives were mixed as in Example B-1 to prepare comparative toner (2).

The properties and evaluation results of thus obtained toner are shown in Tables 4 and 5, respectively. The obtained toner had a circularity of 0.96 and had a spindle shape.

COMPARATIVE EXAMPLE B-3

"Comparative toner 3" was obtained in the same way as in Example B-1 except that, in Example B-1, "resin fine particle dispersion 6" synthesized as described below was used in place of "resin fine particle dispersion 1". To the "comparative toner 3" additives were mixed as in Example B-1 to prepare comparative toner (3).

The properties and evaluation results of thus obtained toner are shown in Tables 4 and 5, respectively. The obtained toner had a circularity of 0.92 and had a spindle shape.

—Synthesis of Resin Fine Particle Emulsion—

To a reaction vessel provided with stirrer and thermometer, 683 parts of water, 11 parts of sodium salt of sulfuric acid ester of methacrylic acid ethylene oxide adduct (ELEMINOL RS-30 by Sanyo Chemical Industries, Ltd.), 138 parts of styrene, 138 parts of methacrylic acid, and 1 part of ammonium persulphate were introduced, and stirred at 400 rpm for 15 minutes to give a white emulsion. This was heated, the temperature in the system was raised to 75° C. and the reaction was performed for 5 hours. Next, 30 parts of an aqueous solution of 1% ammonium persulphate was added, and the reaction mixture was matured at 75° C. for 5 hours to obtain an aqueous dispersion of a vinyl resin (copolymer of styrene-methacrylic acid-sodium salt of sulfuric acid ester of methacrylic acid ethylene oxide adduct), "resin fine particle dispersion 6".

The "resin fine particle dispersion 6" was measured by the particle size distribution measuring apparatus (IA-920 by Horiba Ltd.) in which laser light scattering technique is adopted, and the volume average particle diameter was 140 nm. After drying a part of the "resin fine particle dispersion 6", the resin was isolated. The glass-transition temperature, Tg of the resin was 156° C. and the average molecular mass, Mw was 400,000.

COMPARATIVE EXAMPLE B-4

"Comparative toner 4" was obtained in the same way as in Example B-1 except that, in Example B-1, "resin fine particle dispersion 7" synthesized as described below was used in place of "resin fine particle dispersion 1".

To 100 parts of the obtained toner 0.7 parts of hydrophobized silica and 0.3 parts of hydrophobized titanium oxide were mixed in HENSCHEL MIXER to prepare comparative toner (4).

The properties and evaluation results of thus obtained toner are shown in Tables 4 and 5, respectively. The obtained toner had a circularity of 0.94 and had a spindle shape.

—Production of Resin Fine Particle—

To a reaction vessel provided with stirrer and thermometer, 683 parts of water, 11 parts of sodium salt of sulfuric acid ester of methacrylic acid ethylene oxide adduct (ELEMINOL RS-30 by Sanyo Chemical Industries, Ltd.), 63 parts of styrene, 83 parts of methacrylic acid, 130 parts of butyl acrylate, 12 parts of butyl thioglycolate, and 1 part of ammonium persulphate were introduced, and stirred at 400 rpm for 15 minutes to give a white emulsion. This was heated, the temperature in the system was raised to 75° C. and the reaction was performed for 5 hours. Next, 30 parts of an aqueous solution of 1% ammonium persulphate was added, and the reaction mixture was matured at 75° C. for 5 hours to obtain an aqueous dispersion of a vinyl resin (copolymer of styrene-methacrylic acid-butyl acrylate-sodium salt of sulfuric acid ester of methacrylic acid ethylene oxide adduct), "resin fine particle dispersion 7".

The "resin fine particle dispersion 7" was measured by the particle size distribution measuring apparatus (LA-920 by Horiba Ltd.) in which laser light scattering technique is adopted, and the volume average particle diameter was 130 nm. After drying a part of the "resin fine particle dispersion 7", the resin was isolated. The lass-transition temperature, Tg of the resin was 45° C. and the average molecular mass, Mw was 50,000.

COMPARATIVE EXAMPLE B-5

—Production of Resin Fine Particle—

To a reaction vessel provided with stirrer and thermometer, 683 parts of water, 11 parts of sodium salt of sulfuric acid ester of methacrylic acid ethylene oxide adduct (ELEMINOL RS-30 by Sanyo Chemical Industries, Ltd.), 83 parts of styrene, 83 parts of methacrylic acid, 110 parts of butyl acrylate, and 1 part of ammonium persulphate were introduced, and stirred at 400 rpm for 15 minutes to give a white emulsion. This was heated, the temperature in the system was raised to 75° C. and the reaction was performed for 5 hours. Next, 30 parts of an aqueous solution of 1% ammonium persulphate was added, and the reaction mixture was matured at 75° C. for 5 hours to obtain an aqueous dispersion of a vinyl resin (copolymer of styrene-methacrylic acid-butyl acrylate-sodium salt of sulfuric acid ester of methacrylic acid ethylene oxide adduct), "resin fine particle dispersion 8".

The "resin fine particle dispersion 8" was measured by the particle size distribution measuring apparatus (LA-920 by Horiba Ltd.) in which laser light scattering technique is adopted, and the volume average particle diameter was 80 nm. After drying a part of the "resin fine particle dispersion 8", the resin was isolated. The glass-transition temperature, Tg of the resin was 59° C. and the average molecular mass, Mw was 150,000.

—Production of Prepolymer—

In a reaction vessel equipped with condenser tube, stirrer, and nitrogen inlet tube, 724 parts of bisphenol A ethyleneoxide dimole adduct, 276 parts of isophthalic acid, and 2 parts of dibutyl tin oxide were placed, and the reaction was performed under normal pressure at 230° C. for 8 hours. Further, the reaction was performed with dehydrating under a reduced pressure of 10 mmHg to 15 mmHg for 5 hours and then cooled to 160° C. To this, 32 parts of phthalic anhydride was added, and allowed to react for 2 hours. To this, 32 parts of phthalic anhydride was added, and allowed to react for 2 hours. Next, this was cooled to 80° C. and reacted with 188 parts of isophorone diisocyanate in ethyl acetate for 2 hours to obtain "comparative isocyanate-group-containing prepolymer 3".

—Production of Unmodified Polyester—

In the same way as described above, 724 parts of bisphenol A ethyleneoxide oxide dimolar adduct, 138 parts of terephthalic acid, and 138 parts of isophthalic acid were subjected to polycondensation under normal pressure at 230° C. for 6 hours. Thereafter, reaction was performed with dehydrating under a reduced pressure of 10 mmHg to 15 mmHg for 5 hours to obtain "comparative unmodified polyester 3".

In a beaker, 15.4 parts of "comparative isocyanate-group-containing prepolymer 3", 64 parts of "comparative unmodified polyester 3", and 78.6 parts of ethyl acetate were placed and dissolved with stirring. Next, 20 parts of pentaerythritol tetrabehenate and 10 parts of carbon black (REGAL 400R by Cabot Corporation) were placed, mixed in a TK type homomixer at 12,000 rpm at 60° C., and uniformly dissolved and dispersed.

Lastly, 2.7 parts of "ketimine compound 1" was added and dissolved. This is referred to as "comparative toner material solution (1)". In a beaker, 706 parts of ion exchange water, 294 parts of hydroxyl apatite 10% suspension (SUPERTITE 10 by Nippon Chemical Industrial Co., Ltd.), and 0.2 parts of sodium dodecylbenzenesulfonate were placed and uniformly dissolved.

Next, temperature was raised to 60° C., mixed in a TK type homomixer at 12,000 rpm, and the above-mentioned "comparative toner material solution (1)" was introduced and mixed for 10 minutes. Thereafter, this mixture was transferred to a flask equipped with stirring bar and temperature indicator, and temperature was raised to 55° C. While effecting the urea-introducing reaction, the solvent was removed under 25 mmHg to 50 mmHg, filtered, washed, dried, and then classified by a wind force. Next, to 100 parts of toner particle, 0.5 part of colloidal silica (Aerosil R972: by Nippon Aerosil Co., Ltd.) was mixed in a sample mill to prepare "comparative toner 5".

The properties and evaluation results of thus obtained toner are shown in Tables 4 and 5, respectively. The obtained toner had a circularity of 0.95 and had a spindle shape.

COMPARATIVE EXAMPLE B-6

Initially, with 2 parts of dibutyltin oxide as a catalyst, 325 parts of bisphenol A ethyleneoxide oxide dimolar adduct and 155 parts of terephthalic acid were subjected to polycondensation to obtain "comparative toner binder 4". The "comparative toner binder 4" had a glass-transition temperature (Tg) of 61° C.

Next, in a beaker, 100 parts of "comparative toner binder 4", 200 parts of ethyl acetate, and 8 parts of carbon black (#44 by Mitsubishi Chemical Corporation), 5 parts of carnauba wax used in Example B-1 were placed, mixed in a TK type homomixer at 12,000 rpm at 50° C., and uniformly dissolved and dispersed. Next, toner was prepared in the same way as in Example B-1 to obtain "comparative toner 6" having a volume average particle diameter of 4.5 μm.

The properties and evaluation results of thus obtained toner are shown in Tables 4 and 5, respectively. The obtained toner had a circularity of 0.97 and had a spherical shape.

<Test Methods>

1. Kneading Test Method with Labo Plastomill (i) Labo Plastomill (Type 30C150, by Toyo Seiki Seisakusho, Ltd.)

(ii) Small grinder (Oster mixer)

(iii) Test sieve (iv) Work procedure

Toner is melt kneaded using Labo Plastomill and kneaded mixture is crushed with Oster mixer and the material remaining on a 180 μm mesh is used as a sample.

<Labo Plastomill Kneading Condition>

| | |
|---|---|
| Mixer | R60 |
| Temperature | 130° C. |
| Time | 15 minutes |
| Sample amount | 45 g |
| Mixer rotation number | 50 rpm |

2. ½ Flown-out Temperature by a Flow Tester

Figure 16A:
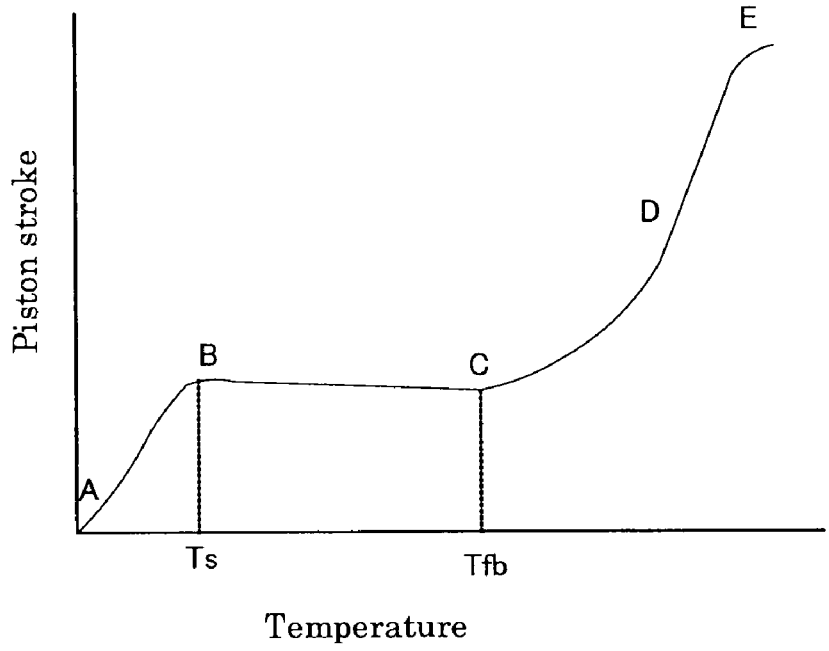
FIG. 16A is a flow curve for determining ½ flown-out temperature by a flow tester.
Figure 16B:
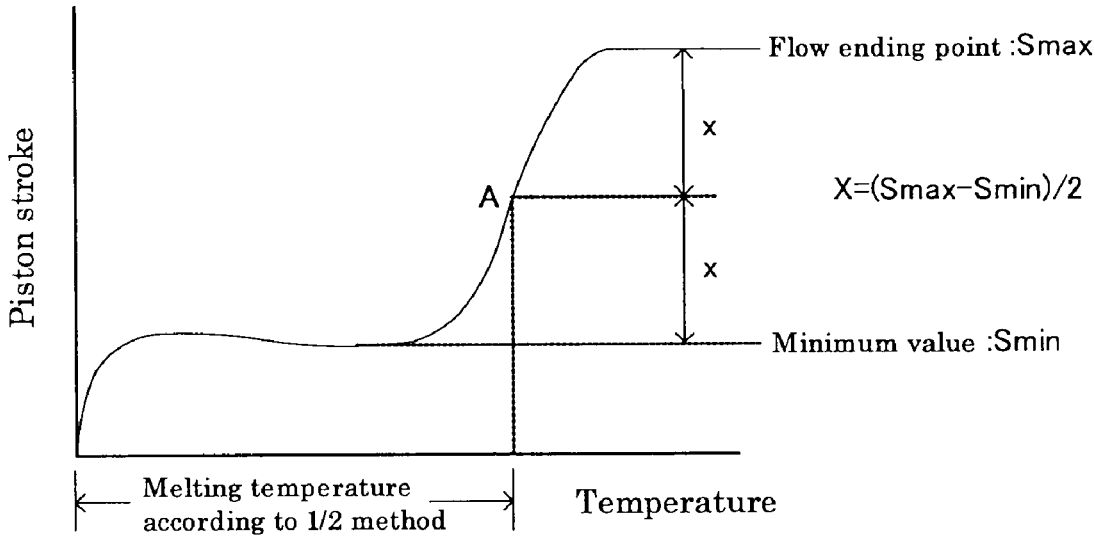
FIG. 16B is a flow curve for determining ½ flown-out temperature by a flow tester.

As a flow tester, capillary type flow tester CFT500D, by Shimadzu Corporation was used. FIGS. 16A and 16B shows a flow curve of this flow tester, and from this, each temperature can be read. In FIGS. 16A and 16B, Ts represents softening temperature and Tfb represents flow beginning temperature, and melting temperature according to ½ method represents ½ flown-out temperature by a flow tester.

<Measurement Condition>

Load: 5 kg/cm$^2$, Temperature rising rate: 3.0° C./min, Die diameter: 1.00 mm, Die length: 10.0 mm 3. Method for Measuring THF Insoluble Content About 1.0 g (A) of resin or toner is weighed. To this, about 50 g of tetrahydrofuran (THF) is added and is left to stand at 20° C. for 24 hours. This is separated by centrifugation and then filtered using filter paper for quantitative measurement. The solvent component of obtained filtrate is vacuum-dried and only resin component is weighed to measure the residual amount (B). This residual amount is THF soluble component.

The THF insoluble component (%) is calculated according to the following formula:

$$\text{THF insoluble component}(\%)=(A-B)/A$$

TABLE 4

| | Resin fine particle | | | Toner particle diameter distribution | | | | | FPIA | |
|---|---|---|---|---|---|---|---|---|---|---|
| | Tg (° C.) | Particle diameter (nm) | Mw × 1000 | Dv (μm) | Dn (μm) | Dv/Dn | 3 μm or less (%) | 8 μm or more (%) | 2 μm or less (%) | Sphericity |
| Example B-1 | 57 | 90 | 20 | 4.1 | 3.7 | 1.11 | 1.2 | 0.2 | 8 | 0.93 |
| Example B-2 | 52 | 120 | 30 | 5.2 | 4.0 | 1.30 | 2.0 | 0.7 | 6 | 0.92 |
| Example B-3 | 63 | 60 | 15 | 4.6 | 4.3 | 1.07 | 0.8 | 0.3 | 4 | 0.91 |
| Example B-4 | 56 | 30 | 50 | 3.5 | 3.1 | 1.13 | 0.9 | 0.4 | 12 | 0.95 |
| Example B-5 | 56 | 30 | 50 | 7.2 | 6.3 | 1.14 | 1.2 | 1.5 | 6 | 0.93 |
| Comp. Example B-1 | — | — | — | 6.5 | 5.6 | 1.18 | 38.0 | 1.7 | 12.0 | 0.97 |
| Comp. Example B-2 | — | — | — | 6.2 | 5.6 | 1.11 | 6.2 | 2.6 | 0.8 | 0.96 |
| Comp. Example B-3 | 156 | 140 | 40 | 5.2 | 4.7 | 1.11 | 1.8 | 1.6 | 15.8 | 0.92 |
| Comp. Example B-4 | 45 | 130 | 5 | 6.2 | 4.5 | 1.38 | 3.4 | 1.5 | 12 | 0.94 |
| Comp. Example B-5 | 59 | 80 | 15 | 5.2 | 4.8 | 1.08 | 1.9 | 1.4 | 12 | 0.95 |
| Comp. Example B-6 | — | — | — | 4.5 | 4.0 | 1.13 | 1.9 | 0.8 | 20.5 | 0.97 |

| | Toner flow tester | | Toner molecular mass | | | |
|---|---|---|---|---|---|---|
| | ½ flown-out temperature before mastication of toner (° C.) | ½ flown-out temperature after mastication of toner (° C.) | Peak top | Mn | Tg (° C.) | THF insoluble content (%) |
| Example B-1 | 130 | 101 | 3,500 | 2,100 | 43 | 4 |
| Example B-2 | 125 | 105 | 3,600 | 2,900 | 44 | 15 |
| Example B-3 | 122 | 115 | 3,600 | 2,900 | 46 | 18 |
| Example B-4 | 125 | 109 | 3,500 | 2,800 | 42 | 12 |
| Example B-5 | 140 | 118 | 5,200 | 6,500 | 42 | 22 |
| Comp. Example B-1 | 230 | 190 | 6,200 | 4,500 | 52 | 16 |
| Comp. Example B-2 | 130 | 110 | 2,800 | 3,800 | 38 | 0 |
| Comp. Example B-3 | 140 | 115 | 6,200 | 4,500 | 52 | 5 |

TABLE 4-continued

| | | | | | | |
|---|---|---|---|---|---|---|
| Comp. Example B-4 | 150 | 132 | 2,900 | 7,500 | 40 | 3 |
| Comp. Example B-5 | 115 | 92 | 2,200 | 6,500 | 45 | 2 |
| Comp. Example B-6 | 120 | 115 | 1,200 | 1,500 | 61 | 8 |

Next, following evaluation was carried out using each of obtained toners. Image evaluation was carried out using the two-component developer prepared as described below and image evaluation of 100,000 sheets was carried out using an image forming apparatus (imagio NEO450 by Ricoh Company, Ltd.

—Method for Preparing Two-component Developer—

50 parts of each toner and 950 parts of a silicone-resin coated carrier (Silicone resin, KR-250, core material carrier 70 μm, by Shin-Etsu Chemical Co., Ltd.) were mixed and completely shaken up to prepare a two-component developer.

<Lowest Fixing Temperature>

A modified image forming apparatus (Copier MF-200 by Ricoh Company, Ltd.), in which a Teflon (Trademark) roller was used as a fixing roller and the fixing section was modified, was used, type 6200 paper by Ricoh Company, Ltd. was set to this apparatus, and copying test was carried out. The lowest fixing temperature used herein is the temperature of the fixing roll at which the residual rate of the image density was 70% or more when the fixed image was rubbed with a pat.

<Hot Offset Generating Temperature (HOT)>

Image fixation was evaluated in the same way as in the above-described lowest fixing temperature. Occurrence of hot offset with respect to the fixed image was determined with naked eyes. The hot offset generating temperature used herein is the temperature of the fixing roll at which hot offset occurred.

<Toner Remelting Test Method>

Remelting means such a phenomenon that the toner, adhered to a fixing roller at the time of fixing, is transferred to a pressure roller and the toner is collected by a cleaning roller; however, the collected adhered toner starts to melt again due to the heat of a heating roller, and the remelted toner is transferred to a pressure roller, resulting in adhesion to or contamination of images.

As the test method, continuous running of remelting is carried out in which toner is allowed to adhere to a cleaning roller and whether or not the toner has remelted is observed. Images were produced according to the following condition and the number of sheets when the remelting occurred, that is, the number when images start to be smeared, was observed.

<Condition>

Copier: imagio Neo 451 by Ricoh Company, Ltd.

Fixing unit for evaluation: fixing device for imagio Neo 451 by Ricoh Company, Ltd. (Pressure diameter ϕ30)

Run mode: 1 to 15, interval 30 S, 6% chart, 15K/day

<Anti-heat Preservability>

Measuring instrument: Penetrometer (Nikka Engineering)

Tapping machine 30 mL screw vial

Storage: Thermostat bath

Method:

(1) 10.8 g of toner is placed in a screw vial (2) The toner of (1) is subjected to a tapping machine at 150 rotation/1 minute 35 seconds (3) Stored gently in a thermostat bath at predetermined temperature, 50° C., and for 24 hours.

(4) After 24 hours, allowed to stand for 2 hours.

(5) Allow a needle to drop from a penetrometer and the penetration is measured

[Evaluation Standards]

A: (Small circle): penetration of 15 mm or more

B: (Delta): penetration of 10 mm to 14 mm

C: penetration of 9 mm or less

<Flowability>

Bulk density is measured and is used as an index of flowability of toner. Bulk density was measured using Powder Tester by Hosokawa Micron Corporation. Greater the bulk density, the better is the flowability.

1. Construction of Measuring Instrument (1) Graduated cylinder (50 ml (+0.25 ml TC 20° C.))

(2) Stopwatch (3) Electronic balance (Accuracy of measurement: Within 0.1 g)

2. Measurement Procedure (1) Measure a predetermined amount 1 of the sample using an electronic balance (2) Measure the mass of graduated cylinder and read to the last digit, or not rounding the last digit (3) Start the stopwatch immediately after the sample has been placed, let it alone for 10 minutes to 11 minutes. During this period, be careful not to give vibration and/or impact.

(4) Read the volume of powder using the markings on the graduated cylinder to 0.5 ml (5) Measure the mass of sample and graduated cylinder, and read to the last digit, or not rounding the last digit (6) Calculation is carried out as follows.

$$\text{Bulk density}(g/cm^3)=\{(\text{mass of sample and graduated cylinder})-(\text{mass of graduated cylinder})\}/\text{volume of powder} \quad \text{Formula 1}$$

[Evaluation Standards]

A: (Small circle): 0.40 g/cm$^3$ or more

B: (Delta): 0.35 to 0.39 g/cm$^3$

C: 0.30 g/cm$^3$ or less

<Image Fixing Evaluation Method>

As a fixing roller, one in a modified image forming apparatus (Copier imagio NEO450 by Ricoh Company, Ltd.), in which a fixing section was modified as described below, was used. Ttype 6200 paper by Ricoh Company, Ltd. was set to this apparatus, and copying test was carried out. The fixing unit used in this apparatus had a fixing roller of which metal cylinder was made of Fe material and had a thickness of 0.34 mm, and the surface pressure was set to $1.0\times10^5$ Pa.

<Image Density Test Method>

Image density was measured using Macbeth reflection densitometer, determined as relative density by correcting with standard one, and evaluated based on the following standard. 5 mm to 10 mm circle at solid parts was measured.

[Image Density Evaluation Standard]

A: (Small circle): 1.5 or more

B: (Delta): not less than 1.4 to less than 1.5

C: less than 1.4

<Image Resolution Test Method>

Pattern images each comprising five thin lines having an equal width and an equal spacing were formed with different pitches of 2.8 patterns, 3.2 patterns, 3.6 patterns, 4.0 patterns, 4.5 patterns, 5.0 patterns, 5.6 patterns, 6.3 patterns, 7.1 patterns, and 8.0 patterns, respectively per mm, as an original. The original image was reproduced and obtained copied image was observed with a magnifying glass at a magnification of 5 times, and image resolution was determined based on the number of patterns (pattern/mm) where thin lines are clearly separated to each other.

[Image Resolution Evaluation Standard]

A: (Small circle): 6.3 patterns/mm or more

B: (Delta): 5.0 patterns/mm to 5.6 patterns/mm

C: 4.5 patterns/mm

TABLE 5

| | Fixing property at low temperatures | Hot offset property | Anti-heat preservability | Image resolution | Image density | Flowability | Toner remelting |
|---|---|---|---|---|---|---|---|
| Example B-1 | 140° C. | 200° C. | A | A | A | A | No smear until 150 K |
| Example B-2 | 145° C. | 205° C. | A | A | A | A | No smear until 151 K |
| Example B-3 | 155° C. | 215° C. | A | A | A | A | No smear until 152 K |
| Example B-4 | 155° C. | 225° C. | A | A | A | A | No smear until 153 K |
| Example B-5 | 160° C. | 225° C. | A | A | A | A | No smear until 154 K |
| Comp. Example B-1 | 180° C. | 200° C. | A | A | A | B | No smear until 155 K |
| Comp. Example B-2 | 155° C. | 155° C. | C | C | A | A | Occurrence of toner smear at 3 K sheets |
| Comp. Example B-3 | 190° C. | 220° C. | A | B | A | B | Occurrence of toner smear at 4 K sheets |
| Comp. Example B-4 | 150° C. | 165° C. | C | A | A | B | Occurrence of toner smear at 3 K sheets |
| Comp. Example B-5 | 145° C. | 160° C. | C | B | B | A | Occurrence of toner smear at 4 K sheets |
| Comp. Example B-6 | 165° C. | 140° C. | C | A | B | B | Occurrence of toner smear at 50 K sheets |

* In the column of toner remelting, 150 K sheets, 3 K sheets, 4 K sheets, and 50 K sheets represent 150,000 sheets output, 3,000 sheets output, 4,000 sheets output, and 50,000 sheets output, respectively.

What is claimed is:

1. A toner comprising:

a toner material; and resin fine particles on a surface of the toner, wherein the toner has a glass-transition temperature, Tg, of from 30° C. to 46° C., the resin fine particles have a glass-transition temperature, Tg, of from 50° C. to 70° C., and wherein, when the toner has been masticated with Labo Plastomill, the toner has a ½ flown-out temperature of from 95° C. to 120° C., and before the mastication of the toner, the toner has a ½ flown-out temperature of from 120° C. to 145° C.

2. The toner according to claim 1, wherein a tetrahydrofuran (THF) insoluble content (gel content) in the toner is from 5% by mass to 25% by mass.

3. The toner according to claim 1, wherein, in a particle size distribution measured by a flow type particle image measuring apparatus, the content of minute particles having a particle diameter of 2 μm or less is 15% or less.

4. The toner according to claim 1, wherein, in a distribution of particle diameter measured by a Coulter method, the content of large grains having a particle diameter of 8 μm or more is 2% by mass or less.

5. The toner according to claim 1, wherein, in a distribution of particle diameter measured by a Coulter method, the content of minute particles having a particle diameter of 3 μm or less is 2% by mass or less.

6. The toner according to claim 1, wherein the toner has an average circularity of from 0.900 to 0.960 and has a spindle shape.

7. The toner according to claim 1, wherein the average particle diameter of the resin fine particles is 10 nm to 200 nm.

* * * * *